US011750972B2

(12) United States Patent
Shumard et al.

(10) Patent No.: US 11,750,972 B2
(45) **Date of Patent: *Sep. 5, 2023**

(54) ONE-DIMENSIONAL ARRAY MICROPHONE WITH IMPROVED DIRECTIVITY

(71) Applicant: Shure Acquisition Holdings, Inc., Niles, IL (US)

(72) Inventors: Brent Robert Shumard, Mount Prospect, IL (US); Mark Gilbert, Palatine, IL (US); James Michael Pessin, Forest Park, IL (US); Emily Ann Wigley, Chicago, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/657,476

(22) Filed: Mar. 31, 2022

(65) Prior Publication Data

US 2022/0337946 A1 Oct. 20, 2022

Related U.S. Application Data

(63) Continuation of application No. 17/000,295, filed on Aug. 22, 2020, now Pat. No. 11,297,426.
(Continued)

(51) Int. Cl.
*H04R 3/00* (2006.01)
*H04R 1/24* (2006.01)
(Continued)

(52) U.S. Cl.
CPC ..... *H04R 3/005* (2013.01); *H04R 1/245* (2013.01); *H04R 1/406* (2013.01); *H04R 19/04* (2013.01);
(Continued)

(58) Field of Classification Search
CPC ..... H04R 3/005; H04R 1/245; H04R 1/406; H04R 19/04; H04R 29/005;
(Continued)

(56) References Cited

U.S. PATENT DOCUMENTS 1,535,408 A 4/1925 Fricke
1,540,788 A 6/1925 McClure
(Continued)

FOREIGN PATENT DOCUMENTS

CA 2359771 4/2003
CA 2475283 1/2005
(Continued)

OTHER PUBLICATIONS

"Philips Hue Bulbs and Wireless Connected Lighting System," Web page https://www.philips-hue.com/en-in, 8 pp, Sep. 23, 2020, retrieved from Internet Archive Wayback Machine, <https://web.archive.org/web/20200923171037/https://www.philips-hue.com/en-in> on Sep. 27, 2021.

(Continued)

*Primary Examiner* — William A Jerez Lora
(74) *Attorney, Agent, or Firm* — Neal, Gerber & Eisenberg LLP

(57) ABSTRACT

Embodiments include an array microphone comprising a plurality of microphone sets arranged in a linear pattern relative to a first axis and configured to cover a plurality of frequency bands. Each microphone set comprises a first microphone arranged along the first axis and a second microphone arranged along a second axis orthogonal to the first microphone, wherein a distance between adjacent microphones along the first axis is selected from a first group consisting of whole number multiples of a first value, and within each element, a distance between the first and second microphones along the second axis is selected from a second
(Continued)

group consisting of whole number multiples of a second value.

22 Claims, 9 Drawing Sheets

Related U.S. Application Data

(60) Provisional application No. 62/891,088, filed on Aug. 23, 2019.

(51) Int. Cl.
*H04R 1/40* (2006.01)
*H04R 19/04* (2006.01)

(52) U.S. Cl.
CPC .. *H04R 2201/003* (2013.01); *H04R 2201/403* (2013.01)

(58) Field of Classification Search
CPC ..... H04R 2201/003; H04R 2201/403; H04R 2201/405; H04R 2430/20; H04R 2430/21; H04R 2430/23
USPC ..... 381/56, 92, 111, 122, 313
See application file for complete search history.

(56) References Cited

U.S. PATENT DOCUMENTS 1,965,830 A 7/1934 Hammer
2,075,588 A 3/1937 Meyers
2,113,219 A 4/1938 Olson
2,164,655 A 7/1939 Kleerup
D122,771 S 10/1940 Doner
2,233,412 A 3/1941 Hill
2,268,529 A 12/1941 Stiles
2,343,037 A 2/1944 Adelman
2,377,449 A 6/1945 Prevette
2,481,250 A 9/1949 Schneider
2,521,603 A 9/1950 Prew
2,533,565 A 12/1950 Eichelman
2,539,671 A 1/1951 Olson
2,777,232 A 1/1957 Kulicke
2,828,508 A 4/1958 Labarre
2,840,181 A 6/1958 Wildman
2,882,633 A 4/1959 Howell
2,912,605 A 11/1959 Tibbetts
2,938,113 A 5/1960 Schnell
2,950,556 A 8/1960 Larios
3,019,854 A 2/1962 Obryant
3,132,713 A 5/1964 Seeler
3,143,182 A 8/1964 Sears
3,160,225 A 12/1964 Sechrist
3,161,975 A 12/1964 McMillan
3,205,601 A 9/1965 Gawne
3,239,973 A 3/1966 Hannes
3,240,883 A 3/1966 Seeler
3,310,901 A 3/1967 Sarkisian
3,321,170 A 5/1967 Vye
3,509,290 A 4/1970 Mochida
3,573,399 A 4/1971 Schroeder
3,657,490 A 4/1972 Scheiber
3,696,885 A 10/1972 Grieg
3,755,625 A 8/1973 Maston
3,828,508 A 8/1974 Moeller
3,857,191 A 12/1974 Sadorus
3,895,194 A 7/1975 Fraim
3,906,431 A 9/1975 Clearwaters
D237,103 S 10/1975 Fisher
3,936,606 A 2/1976 Wanke
3,938,617 A 2/1976 Forbes
3,941,638 A 3/1976 Horky
3,992,584 A 11/1976 Dugan
4,007,461 A 2/1977 Luedtke
4,008,408 A 2/1977 Kodama
4,029,170 A 6/1977 Phillips
4,032,725 A 6/1977 McGee
4,070,547 A 1/1978 Dellar
4,072,821 A 2/1978 Bauer
4,096,353 A 6/1978 Bauer
4,127,156 A 11/1978 Brandt
4,131,760 A 12/1978 Christensen
4,169,219 A 9/1979 Beard
4,184,048 A 1/1980 Alcaide
4,198,705 A 4/1980 Massa
D255,234 S 6/1980 Wellward
D256,015 S 7/1980 Doherty
4,212,133 A 7/1980 Lufkin
4,237,339 A 12/1980 Bunting
4,244,096 A 1/1981 Kashichi
4,244,906 A 1/1981 Heinemann
4,254,417 A 3/1981 Speiser
4,275,694 A 6/1981 Nagaishi
4,296,280 A 10/1981 Richie
4,305,141 A 12/1981 Massa
4,308,425 A 12/1981 Momose
4,311,874 A 1/1982 Wallace, Jr.
4,330,691 A 5/1982 Gordon
4,334,740 A 6/1982 Wray
4,365,449 A 12/1982 Liautaud
4,373,191 A 2/1983 Fette
4,393,631 A 7/1983 Krent
4,414,433 A 11/1983 Horie
4,429,850 A 2/1984 Weber
4,436,966 A 3/1984 Botros
4,449,238 A 5/1984 Lee
4,466,117 A 8/1984 Goerike
4,485,484 A 11/1984 Flanagan
4,489,442 A 12/1984 Anderson
4,518,826 A 5/1985 Caudill
4,521,908 A 6/1985 Miyaji
4,566,557 A 1/1986 Lemaitre
4,593,404 A 6/1986 Bolin
4,594,478 A 6/1986 Gumb
D285,067 S 8/1986 Delbuck
4,625,827 A 12/1986 Bartlett
4,653,102 A 3/1987 Hansen
4,658,425 A 4/1987 Julstrom
4,669,108 A 5/1987 Deinzer
4,675,906 A 6/1987 Sessler
4,693,174 A 9/1987 Anderson
4,696,043 A 9/1987 Iwahara
4,712,231 A 12/1987 Julstrom
4,741,038 A 4/1988 Elko
4,752,961 A 6/1988 Kahn
4,805,730 A 2/1989 O'Neill
4,815,132 A 3/1989 Minami
4,860,366 A 8/1989 Fukushi
4,862,507 A 8/1989 Woodard
4,866,868 A 9/1989 Kass
4,881,135 A 11/1989 Heilweil
4,888,807 A 12/1989 Reichel
4,903,247 A 2/1990 Van Gerwen
4,923,032 A 5/1990 Nuernberger
4,928,312 A 5/1990 Hill
4,969,197 A 11/1990 Takaya
5,000,286 A 3/1991 Crawford
5,038,935 A 8/1991 Wenkman
5,058,170 A 10/1991 Kanamori
5,088,574 A 2/1992 Kertesz, III
D324,780 S 3/1992 Sebesta
5,121,426 A 6/1992 Baumhauer
D329,239 S 9/1992 Hahn
5,189,701 A 2/1993 Jain
5,204,907 A 4/1993 Staple
5,214,709 A 5/1993 Ribic
5,224,170 A 6/1993 Waite, Jr.
D340,718 S 10/1993 Leger
5,289,544 A 2/1994 Franklin
D345,346 S 3/1994 Alfonso
D345,379 S 3/1994 Chan
5,297,210 A 3/1994 Julstrom
5,322,979 A 6/1994 Cassity

(56) References Cited

U.S. PATENT DOCUMENTS

| | | | |
|---|---|---|---|
| 5,323,459 | A | 6/1994 | Hirano |
| 5,329,593 | A | 7/1994 | Lazzeroni |
| 5,335,011 | A | 8/1994 | Addeo |
| 5,353,279 | A | 10/1994 | Koyama |
| 5,359,374 | A | 10/1994 | Schwartz |
| 5,371,789 | A | 12/1994 | Hirano |
| 5,383,293 | A | 1/1995 | Royal |
| 5,384,843 | A | 1/1995 | Masuda |
| 5,396,554 | A | 3/1995 | Hirano |
| 5,400,413 | A | 3/1995 | Kindel |
| D363,045 | S | 10/1995 | Phillips |
| 5,473,701 | A | 12/1995 | Cezanne |
| 5,509,634 | A | 4/1996 | Gebka |
| 5,513,265 | A | 4/1996 | Hirano |
| 5,525,765 | A | 6/1996 | Freiheit |
| 5,550,924 | A | 8/1996 | Helf |
| 5,550,925 | A | 8/1996 | Hori |
| 5,555,447 | A | 9/1996 | Kotzin |
| 5,574,793 | A | 11/1996 | Hirschhorn |
| 5,602,962 | A | 2/1997 | Kellermann |
| 5,633,936 | A | 5/1997 | Oh |
| 5,645,257 | A | 7/1997 | Ward |
| D382,118 | S | 8/1997 | Ferrero |
| 5,657,393 | A | 8/1997 | Crow |
| 5,661,813 | A | 8/1997 | Shimauchi |
| 5,673,327 | A | 9/1997 | Julstrom |
| 5,687,229 | A | 11/1997 | Sih |
| 5,706,344 | A | 1/1998 | Finn |
| 5,715,319 | A | 2/1998 | Chu |
| 5,717,171 | A | 2/1998 | Miller |
| D392,977 | S | 3/1998 | Kim |
| D394,061 | S | 5/1998 | Fink |
| 5,761,318 | A | 6/1998 | Shimauchi |
| 5,766,702 | A | 6/1998 | Lin |
| 5,787,183 | A | 7/1998 | Chu |
| 5,796,819 | A | 8/1998 | Romesburg |
| 5,848,146 | A | 12/1998 | Slattery |
| 5,870,482 | A | 2/1999 | Loeppert |
| 5,878,147 | A | 3/1999 | Killion |
| 5,888,412 | A | 3/1999 | Sooriakumar |
| 5,888,439 | A | 3/1999 | Miller |
| D416,315 | S | 11/1999 | Nanjo |
| 5,978,211 | A | 11/1999 | Hong |
| 5,991,277 | A | 11/1999 | Maeng |
| 6,035,962 | A | 3/2000 | Lin |
| 6,039,457 | A | 3/2000 | O'Neal |
| 6,041,127 | A | 3/2000 | Elko |
| 6,049,607 | A | 4/2000 | Marash |
| D424,538 | S | 5/2000 | Hayashi |
| 6,069,961 | A | 5/2000 | Nakazawa |
| 6,125,179 | A | 9/2000 | Wu |
| D432,518 | S | 10/2000 | Muto |
| 6,128,395 | A | 10/2000 | De Vries |
| 6,137,887 | A | 10/2000 | Anderson |
| 6,144,746 | A | 11/2000 | Azima |
| 6,151,399 | A | 11/2000 | Killion |
| 6,173,059 | B1 | 1/2001 | Huang |
| 6,198,831 | B1 | 3/2001 | Azima |
| 6,205,224 | B1 | 3/2001 | Underbrink |
| 6,215,881 | B1 | 4/2001 | Azima |
| 6,266,427 | B1 | 7/2001 | Mathur |
| 6,285,770 | B1 | 9/2001 | Azima |
| 6,301,357 | B1 | 10/2001 | Romesburg |
| 6,329,908 | B1 | 12/2001 | Frecska |
| 6,332,029 | B1 | 12/2001 | Azima |
| D453,016 | S | 1/2002 | Nevill |
| 6,386,315 | B1 | 5/2002 | Roy |
| 6,393,129 | B1 | 5/2002 | Conrad |
| 6,424,635 | B1 | 7/2002 | Song |
| 6,442,272 | B1 | 8/2002 | Osovets |
| 6,449,593 | B1 | 9/2002 | Valve |
| 6,481,173 | B1 | 11/2002 | Roy |
| 6,488,367 | B1 | 12/2002 | Debesis |
| D469,090 | S | 1/2003 | Tsuji |
| 6,505,057 | B1 | 1/2003 | Finn |
| 6,507,659 | B1 | 1/2003 | Iredale |
| 6,510,919 | B1 | 1/2003 | Roy |
| 6,526,147 | B1 | 2/2003 | Rung |
| 6,556,682 | B1 | 4/2003 | Gilloire |
| 6,592,237 | B1 | 7/2003 | Pledger |
| 6,622,030 | B1 | 9/2003 | Romesburg |
| D480,923 | S | 10/2003 | Neubourg |
| 6,633,647 | B1 | 10/2003 | Markow |
| 6,665,971 | B2 | 12/2003 | Lowry |
| 6,694,028 | B1 | 2/2004 | Matsuo |
| 6,704,422 | B1 | 3/2004 | Jensen |
| D489,707 | S | 5/2004 | Kobayashi |
| 6,731,334 | B1 | 5/2004 | Maeng |
| 6,741,720 | B1 | 5/2004 | Myatt |
| 6,757,393 | B1 | 6/2004 | Spitzer |
| 6,768,795 | B2 | 7/2004 | Feltstroem |
| 6,868,377 | B1 | 3/2005 | Laroche |
| 6,885,750 | B2 | 4/2005 | Egelmeers |
| 6,885,986 | B1 | 4/2005 | Gigi |
| D504,889 | S | 5/2005 | Andre |
| 6,889,183 | B1 | 5/2005 | Gunduzhan |
| 6,895,093 | B1 | 5/2005 | Ali |
| 6,931,123 | B1 | 8/2005 | Hughes |
| 6,944,312 | B2 | 9/2005 | Mason |
| D510,729 | S | 10/2005 | Chen |
| 6,968,064 | B1 | 11/2005 | Ning |
| 6,990,193 | B2 | 1/2006 | Beaucoup |
| 6,993,126 | B1 | 1/2006 | Kyrylenko |
| 6,993,145 | B2 | 1/2006 | Combest |
| 7,003,099 | B1 | 2/2006 | Zhang |
| 7,013,267 | B1 | 3/2006 | Huart |
| 7,031,269 | B2 | 4/2006 | Lee |
| 7,035,398 | B2 | 4/2006 | Matsuo |
| 7,035,415 | B2 | 4/2006 | Belt |
| 7,050,576 | B2 | 5/2006 | Zhang |
| 7,054,451 | B2 | 5/2006 | Janse |
| D526,643 | S | 8/2006 | Ishizaki |
| D527,372 | S | 8/2006 | Allen |
| 7,092,516 | B2 | 8/2006 | Furuta |
| 7,092,882 | B2 | 8/2006 | Arrowood |
| 7,098,865 | B2 | 8/2006 | Christensen |
| 7,106,876 | B2 | 9/2006 | Santiago |
| 7,120,269 | B2 | 10/2006 | Lowell |
| 7,130,309 | B2 | 10/2006 | Pianka |
| D533,177 | S | 12/2006 | Andre |
| 7,149,320 | B2 | 12/2006 | Haykin |
| 7,161,534 | B2 | 1/2007 | Tsai |
| 7,187,765 | B2 | 3/2007 | Popovic |
| 7,203,308 | B2 | 4/2007 | Kubota |
| D542,543 | S | 5/2007 | Bruce |
| 7,212,628 | B2 | 5/2007 | Popovic |
| D546,318 | S | 7/2007 | Yoon |
| D546,814 | S | 7/2007 | Takita |
| D547,748 | S | 7/2007 | Tsuge |
| 7,239,714 | B2 | 7/2007 | De Blok |
| D549,673 | S | 8/2007 | Niitsu |
| 7,269,263 | B2 | 9/2007 | Dedieu |
| D552,570 | S | 10/2007 | Niitsu |
| D559,553 | S | 1/2008 | Mischel |
| 7,333,476 | B2 | 2/2008 | Leblanc |
| D566,685 | S | 4/2008 | Koller |
| 7,359,504 | B1 | 4/2008 | Reuss |
| 7,366,310 | B2 | 4/2008 | Stinson |
| 7,387,151 | B1 | 6/2008 | Payne |
| 7,412,376 | B2 | 8/2008 | Florencio |
| 7,415,117 | B2 | 8/2008 | Tashev |
| D578,509 | S | 10/2008 | Thomas |
| D581,510 | S | 11/2008 | Albano |
| D582,391 | S | 12/2008 | Morimoto |
| D587,709 | S | 3/2009 | Niitsu |
| D589,605 | S | 3/2009 | Reedy |
| 7,503,616 | B2 | 3/2009 | Linhard |
| 7,515,719 | B2 | 4/2009 | Hooley |
| 7,536,769 | B2 | 5/2009 | Pedersen |
| D595,402 | S | 6/2009 | Miyake |
| D595,736 | S | 7/2009 | Son |
| 7,558,381 | B1 | 7/2009 | Ali |
| 7,565,949 | B2 | 7/2009 | Tojo |
| D601,585 | S | 10/2009 | Andre |

(56) References Cited

U.S. PATENT DOCUMENTS

| | | | |
|---|---|---|---|
| 7,651,390 | B1 | 1/2010 | Profeta |
| 7,660,428 | B2 | 2/2010 | Rodman |
| 7,667,728 | B2 | 2/2010 | Kenoyer |
| 7,672,445 | B1 | 3/2010 | Zhang |
| D613,338 | S | 4/2010 | Marukos |
| 7,701,110 | B2 | 4/2010 | Fukuda |
| 7,702,116 | B2 | 4/2010 | Stone |
| D614,871 | S | 5/2010 | Tang |
| 7,724,891 | B2 | 5/2010 | Beaucoup |
| D617,441 | S | 6/2010 | Koury |
| 7,747,001 | B2 | 6/2010 | Kellermann |
| 7,756,278 | B2 | 7/2010 | Moorer |
| 7,783,063 | B2 | 8/2010 | Pocino |
| 7,787,328 | B2 | 8/2010 | Chu |
| 7,830,862 | B2 | 11/2010 | James |
| 7,831,035 | B2 | 11/2010 | Stokes |
| 7,831,036 | B2 | 11/2010 | Beaucoup |
| 7,856,097 | B2 | 12/2010 | Tokuda |
| 7,881,486 | B1 | 2/2011 | Killion |
| 7,894,421 | B2 | 2/2011 | Kwan |
| D636,188 | S | 4/2011 | Kim |
| 7,925,006 | B2 | 4/2011 | Hirai |
| 7,925,007 | B2 | 4/2011 | Stokes |
| 7,936,886 | B2 | 5/2011 | Kim |
| 7,970,123 | B2 | 6/2011 | Beaucoup |
| 7,970,151 | B2 | 6/2011 | Oxford |
| D642,385 | S | 8/2011 | Lee |
| D643,015 | S | 8/2011 | Kim |
| 7,991,167 | B2 | 8/2011 | Oxford |
| 7,995,768 | B2 | 8/2011 | Miki |
| 8,000,481 | B2 | 8/2011 | Nishikawa |
| 8,005,238 | B2 | 8/2011 | Tashev |
| 8,019,091 | B2 | 9/2011 | Burnett |
| 8,041,054 | B2 | 10/2011 | Yeldener |
| 8,059,843 | B2 | 11/2011 | Hung |
| 8,064,629 | B2 | 11/2011 | Jiang |
| 8,085,947 | B2 | 12/2011 | Haulick |
| 8,085,949 | B2 | 12/2011 | Kim |
| 8,095,120 | B1 | 1/2012 | Blair |
| 8,098,842 | B2 | 1/2012 | Florencio |
| 8,098,844 | B2 | 1/2012 | Elko |
| 8,103,030 | B2 | 1/2012 | Barthel |
| 8,109,360 | B2 | 2/2012 | Stewart, Jr. |
| 8,112,272 | B2 | 2/2012 | Nagahama |
| 8,116,500 | B2 | 2/2012 | Oxford |
| 8,121,834 | B2 | 2/2012 | Rosec |
| D655,271 | S | 3/2012 | Park |
| D656,473 | S | 3/2012 | Laube |
| 8,130,969 | B2 | 3/2012 | Buck |
| 8,130,977 | B2 | 3/2012 | Chu |
| 8,135,143 | B2 | 3/2012 | Ishibashi |
| 8,144,886 | B2 | 3/2012 | Ishibashi |
| D658,153 | S | 4/2012 | Woo |
| 8,155,331 | B2 | 4/2012 | Nakadai |
| 8,170,882 | B2 | 5/2012 | Davis |
| 8,175,291 | B2 | 5/2012 | Chan |
| 8,175,871 | B2 | 5/2012 | Wang |
| 8,184,801 | B1 | 5/2012 | Hamalainen |
| 8,189,765 | B2 | 5/2012 | Nishikawa |
| 8,189,810 | B2 | 5/2012 | Wolff |
| 8,194,863 | B2 | 6/2012 | Takumai |
| 8,199,927 | B1 | 6/2012 | Raftery |
| 8,204,198 | B2 | 6/2012 | Adeney |
| 8,204,248 | B2 | 6/2012 | Haulick |
| 8,208,664 | B2 | 6/2012 | Iwasaki |
| 8,213,596 | B2 | 7/2012 | Beaucoup |
| 8,213,634 | B1 | 7/2012 | Daniel |
| 8,219,387 | B2 | 7/2012 | Cutler |
| 8,229,134 | B2 | 7/2012 | Duraiswami |
| 8,233,352 | B2 | 7/2012 | Beaucoup |
| 8,243,951 | B2 | 8/2012 | Ishibashi |
| 8,244,536 | B2 | 8/2012 | Arun |
| 8,249,273 | B2 | 8/2012 | Inoda |
| 8,259,959 | B2 | 9/2012 | Marton |
| 8,275,120 | B2 | 9/2012 | Stokes, III |
| 8,280,728 | B2 | 10/2012 | Chen |
| 8,284,949 | B2 | 10/2012 | Farhang |
| 8,284,952 | B2 | 10/2012 | Reining |
| 8,286,749 | B2 | 10/2012 | Stewart |
| 8,290,142 | B1 | 10/2012 | Lambert |
| 8,291,670 | B2 | 10/2012 | Gard |
| 8,297,402 | B2 | 10/2012 | Stewart |
| 8,315,380 | B2 | 11/2012 | Liu |
| 8,331,582 | B2 | 12/2012 | Steele |
| 8,345,898 | B2 | 1/2013 | Reining |
| 8,355,521 | B2 | 1/2013 | Larson |
| 8,370,140 | B2 | 2/2013 | Vitte |
| 8,379,823 | B2 | 2/2013 | Ratmanski |
| 8,385,557 | B2 | 2/2013 | Tashev |
| D678,329 | S | 3/2013 | Lee |
| 8,395,653 | B2 | 3/2013 | Feng |
| 8,403,107 | B2 | 3/2013 | Stewart |
| 8,406,436 | B2 | 3/2013 | Craven |
| 8,428,661 | B2 | 4/2013 | Chen |
| 8,433,061 | B2 | 4/2013 | Cutler |
| D682,266 | S | 5/2013 | Wu |
| 8,437,490 | B2 | 5/2013 | Marton |
| 8,443,930 | B2 | 5/2013 | Stewart, Jr. |
| 8,447,590 | B2 | 5/2013 | Ishibashi |
| 8,472,639 | B2 | 6/2013 | Reining |
| 8,472,640 | B2 | 6/2013 | Marton |
| D685,346 | S | 7/2013 | Szymanski |
| D686,182 | S | 7/2013 | Ashiwa |
| 8,479,871 | B2 | 7/2013 | Stewart |
| 8,483,398 | B2 | 7/2013 | Fozunbal |
| 8,498,423 | B2 | 7/2013 | Thaden |
| D687,432 | S | 8/2013 | Duan |
| 8,503,653 | B2 | 8/2013 | Ahuja |
| 8,515,089 | B2 | 8/2013 | Nicholson |
| 8,515,109 | B2 | 8/2013 | Dittberner |
| 8,526,633 | B2 | 9/2013 | Ukai |
| 8,553,904 | B2 | 10/2013 | Said |
| 8,559,611 | B2 | 10/2013 | Ratmanski |
| D693,328 | S | 11/2013 | Goetzen |
| 8,583,481 | B2 | 11/2013 | Viveiros |
| 8,599,194 | B2 | 12/2013 | Lewis |
| 8,600,443 | B2 | 12/2013 | Kawaguchi |
| 8,605,890 | B2 | 12/2013 | Zhang |
| 8,620,650 | B2 | 12/2013 | Walters |
| 8,631,897 | B2 | 1/2014 | Stewart |
| 8,634,569 | B2 | 1/2014 | Lu |
| 8,638,951 | B2 | 1/2014 | Zurek |
| D699,712 | S | 2/2014 | Bourne |
| 8,644,477 | B2 | 2/2014 | Gilbert |
| 8,654,955 | B1 | 2/2014 | Lambert |
| 8,654,990 | B2 | 2/2014 | Faller |
| 8,660,274 | B2 | 2/2014 | Wolff |
| 8,660,275 | B2 | 2/2014 | Buck |
| 8,670,581 | B2 | 3/2014 | Harman |
| 8,672,087 | B2 | 3/2014 | Stewart |
| 8,675,890 | B2 | 3/2014 | Schmidt |
| 8,675,899 | B2 | 3/2014 | Jung |
| 8,676,728 | B1 | 3/2014 | Velusamy |
| 8,682,675 | B2 | 3/2014 | Togami |
| 8,724,829 | B2 | 5/2014 | Visser |
| 8,730,156 | B2 | 5/2014 | Weising |
| 8,744,069 | B2 | 6/2014 | Cutler |
| 8,744,101 | B1 | 6/2014 | Burns |
| 8,755,536 | B2 | 6/2014 | Chen |
| 8,787,560 | B2 | 7/2014 | Buck |
| 8,811,601 | B2 | 8/2014 | Mohammad |
| 8,818,002 | B2 | 8/2014 | Tashev |
| 8,824,693 | B2 | 9/2014 | Åhgren |
| 8,842,851 | B2 | 9/2014 | Beaucoup |
| 8,855,326 | B2 | 10/2014 | Derkx |
| 8,855,327 | B2 | 10/2014 | Tanaka |
| 8,861,713 | B2 | 10/2014 | Xu |
| 8,861,756 | B2 | 10/2014 | Zhu |
| 8,873,789 | B2 | 10/2014 | Bigeh |
| D717,272 | S | 11/2014 | Kim |
| 8,886,343 | B2 | 11/2014 | Ishibashi |
| 8,893,849 | B2 | 11/2014 | Hudson |
| 8,898,633 | B2 | 11/2014 | Bryant |
| D718,731 | S | 12/2014 | Lee |

(56) References Cited

U.S. PATENT DOCUMENTS 8,903,106 B2 12/2014 Meyer
8,923,529 B2 12/2014 McCowan
8,929,564 B2 1/2015 Kikkeri
8,942,382 B2 1/2015 Elko
8,965,546 B2 2/2015 Visser
D725,059 S 3/2015 Kim
D725,631 S 3/2015 McNamara
8,976,977 B2 3/2015 De
8,983,089 B1 3/2015 Chu
8,983,834 B2 3/2015 Davis
D726,144 S 4/2015 Kang
D727,968 S 4/2015 Onoue
9,002,028 B2 4/2015 Haulick
D729,767 S 5/2015 Lee
9,038,301 B2 5/2015 Zelbacher
9,088,336 B2 7/2015 Mani
9,094,496 B2 7/2015 Teutsch
D735,717 S 8/2015 Lam
D737,245 S 8/2015 Fan
9,099,094 B2 8/2015 Burnett
9,107,001 B2 8/2015 Diethorn
9,111,543 B2 8/2015 Åhgren
9,113,242 B2 8/2015 Hyun
9,113,247 B2 8/2015 Chatlani
9,126,827 B2 9/2015 Hsieh
9,129,223 B1 9/2015 Velusamy
9,140,054 B2 9/2015 Oberbroeckling
D740,279 S 10/2015 Wu
9,172,345 B2 10/2015 Kok
D743,376 S 11/2015 Kim
D743,939 S 11/2015 Seong
9,196,261 B2 11/2015 Burnett
9,197,974 B1 11/2015 Clark
9,203,494 B2 12/2015 Tarighat Mehrabani
9,215,327 B2 12/2015 Bathurst
9,215,543 B2 12/2015 Sun
9,226,062 B2 12/2015 Sun
9,226,070 B2 12/2015 Hyun
9,226,088 B2 12/2015 Pandey
9,232,185 B2 1/2016 Graham
9,237,391 B2 1/2016 Benesty
9,247,367 B2 1/2016 Nobile
9,253,567 B2 2/2016 Morcelli
9,257,132 B2 2/2016 Gowreesunker
9,264,553 B2 2/2016 Pandey
9,264,805 B2 2/2016 Buck
9,280,985 B2 3/2016 Tawada
9,286,908 B2 3/2016 Zhang
9,294,839 B2 3/2016 Lambert
9,301,049 B2 3/2016 Elko
D754,103 S 4/2016 Fischer
9,307,326 B2 4/2016 Elko
9,319,532 B2 4/2016 Bao
9,319,799 B2 4/2016 Salmon
9,326,060 B2 4/2016 Nicholson
D756,502 S 5/2016 Lee
9,330,673 B2 5/2016 Cho
9,338,301 B2 5/2016 Pocino
9,338,549 B2 5/2016 Haulick
9,354,310 B2 5/2016 Visser
9,357,080 B2 5/2016 Beaucoup
9,403,670 B2 8/2016 Schelling
9,426,598 B2 8/2016 Walsh
D767,748 S 9/2016 Nakai
9,451,078 B2 9/2016 Yang
D769,239 S 10/2016 Li
9,462,378 B2 10/2016 Kuech
9,473,868 B2 10/2016 Huang
9,479,627 B1 10/2016 Rung
9,479,885 B1 10/2016 Ivanov
9,489,948 B1 11/2016 Chu
9,510,090 B2 11/2016 Lissek
9,514,723 B2 12/2016 Silfvast
9,516,412 B2 12/2016 Shigenaga
9,521,057 B2 12/2016 Klingbeil
9,549,245 B2 1/2017 Frater
9,560,446 B1 1/2017 Chang
9,560,451 B2 1/2017 Eichfeld
9,565,493 B2 2/2017 Abraham
9,578,413 B2 2/2017 Sawa
9,578,440 B2 2/2017 Otto
9,589,556 B2 3/2017 Gao
9,591,123 B2 3/2017 Sorensen
9,591,404 B1 3/2017 Chhetri
D784,299 S 4/2017 Cho
9,615,173 B2 4/2017 Sako
9,628,596 B1 4/2017 Bullough
9,635,186 B2 4/2017 Pandey
9,635,474 B2 4/2017 Kuster
D787,481 S 5/2017 Tyss
D788,073 S 5/2017 Silvera
9,640,187 B2 5/2017 Niemisto
9,641,688 B2 5/2017 Pandey
9,641,929 B2 5/2017 Li
9,641,935 B1 5/2017 Ivanov
9,653,091 B2 5/2017 Matsuo
9,653,092 B2 5/2017 Sun
9,655,001 B2 5/2017 Metzger
9,659,576 B1 5/2017 Kotvis
D789,323 S 6/2017 MacKiewicz
9,674,604 B2 6/2017 Deroo
9,692,882 B2 6/2017 Mani
9,706,057 B2 7/2017 Mani
9,716,944 B2 7/2017 Yliaho
9,721,582 B1 8/2017 Huang
9,734,835 B2 8/2017 Fujieda
9,754,572 B2 9/2017 Salazar
9,761,243 B2 9/2017 Taenzer
D801,285 S 10/2017 Timmins
9,788,119 B2 10/2017 Vilermo
9,813,806 B2 11/2017 Graham
9,818,426 B2 11/2017 Kotera
9,826,211 B2 11/2017 Sawa
9,854,101 B2 12/2017 Pandey
9,854,363 B2 12/2017 Sladeczek
9,860,439 B2 1/2018 Sawa
9,866,952 B2 1/2018 Pandey
D811,393 S 2/2018 Ahn
9,894,434 B2 2/2018 Rollow, IV
9,930,448 B1 3/2018 Chen
9,936,290 B2 4/2018 Mohammad
9,966,059 B1 * 5/2018 Ayrapetian ..... H04R 1/08
9,973,848 B2 5/2018 Chhetri
9,980,042 B1 5/2018 Benattar
D819,607 S 6/2018 Chui
D819,631 S 6/2018 Matsumiya
10,015,589 B1 7/2018 Ebenezer
10,021,506 B2 7/2018 Johnson
10,021,515 B1 7/2018 Mallya
10,034,116 B2 7/2018 Kadri
10,054,320 B2 8/2018 Choi
10,061,009 B1 8/2018 Family
10,062,379 B2 8/2018 Katuri
10,153,744 B1 12/2018 Every
10,165,386 B2 12/2018 Lehtiniemi
D841,589 S 2/2019 Böhmer
10,206,030 B2 2/2019 Matsumoto
10,210,882 B1 2/2019 McCowan
10,231,062 B2 3/2019 Pedersen
10,244,121 B2 3/2019 Mani
10,244,219 B2 3/2019 Sawa
10,269,343 B2 4/2019 Wingate
10,366,702 B2 7/2019 Morton
10,367,948 B2 7/2019 Wells-Rutherford
D857,873 S 8/2019 Shimada
10,389,861 B2 8/2019 Mani
10,389,885 B2 8/2019 Sun
D860,319 S 9/2019 Beruto
D860,997 S 9/2019 Jhun
D864,136 S 10/2019 Kim
10,440,469 B2 10/2019 Barnett
D865,723 S 11/2019 Cho
10,566,008 B2 2/2020 Thorpe
10,602,267 B2 3/2020 Grosche

(56) References Cited

U.S. PATENT DOCUMENTS

| | | | |
|---|---|---|---|
| D883,952 | S | 5/2020 | Lucas |
| 10,650,797 | B2 | 5/2020 | Kumar |
| D888,020 | S | 6/2020 | Lyu |
| 10,728,653 | B2 | 7/2020 | Graham |
| D900,070 | S | 10/2020 | Lantz |
| D900,071 | S | 10/2020 | Lantz |
| D900,072 | S | 10/2020 | Lantz |
| D900,073 | S | 10/2020 | Lantz |
| D900,074 | S | 10/2020 | Lantz |
| 10,827,263 | B2 | 11/2020 | Christoph |
| 10,863,270 | B1 | 12/2020 | O'Neill |
| 10,930,297 | B2 | 2/2021 | Christoph |
| 10,959,018 | B1 | 3/2021 | Shi |
| 10,979,805 | B2 | 4/2021 | Chowdhary |
| D924,189 | S | 7/2021 | Park |
| 11,109,133 | B2 | 8/2021 | Lantz |
| D940,116 | S | 1/2022 | Cho |
| 11,218,802 | B1 | 1/2022 | Kandadai |
| 2001/0031058 | A1 | 10/2001 | Anderson |
| 2002/0015500 | A1 | 2/2002 | Belt |
| 2002/0041679 | A1 | 4/2002 | Beaucoup |
| 2002/0048377 | A1 | 4/2002 | Vaudrey |
| 2002/0064158 | A1 | 5/2002 | Yokoyama |
| 2002/0064287 | A1 | 5/2002 | Kawamura |
| 2002/0069054 | A1 | 6/2002 | Arrowood |
| 2002/0110255 | A1 | 8/2002 | Killion |
| 2002/0126861 | A1 | 9/2002 | Colby |
| 2002/0131580 | A1 | 9/2002 | Smith |
| 2002/0140633 | A1 | 10/2002 | Rafii |
| 2002/0146282 | A1 | 10/2002 | Wilkes |
| 2002/0149070 | A1 | 10/2002 | Sheplak |
| 2002/0159603 | A1 | 10/2002 | Hirai |
| 2003/0026437 | A1 | 2/2003 | Janse |
| 2003/0053639 | A1 | 3/2003 | Beaucoup |
| 2003/0059061 | A1 | 3/2003 | Tsuji |
| 2003/0063762 | A1 | 4/2003 | Tajima |
| 2003/0063768 | A1 | 4/2003 | Cornelius |
| 2003/0072461 | A1 | 4/2003 | Moorer |
| 2003/0107478 | A1 | 6/2003 | Hendricks |
| 2003/0118200 | A1 | 6/2003 | Beaucoup |
| 2003/0122777 | A1 | 7/2003 | Grover |
| 2003/0138119 | A1 | 7/2003 | Pocino |
| 2003/0156725 | A1 | 8/2003 | Boone |
| 2003/0161485 | A1 | 8/2003 | Smith |
| 2003/0163326 | A1 | 8/2003 | Maase |
| 2003/0169888 | A1 | 9/2003 | Subotic |
| 2003/0185404 | A1 | 10/2003 | Milsap |
| 2003/0198339 | A1 | 10/2003 | Roy |
| 2003/0198359 | A1 | 10/2003 | Killion |
| 2003/0202107 | A1 | 10/2003 | Slattery |
| 2004/0013038 | A1 | 1/2004 | Kajala |
| 2004/0013252 | A1 | 1/2004 | Craner |
| 2004/0076305 | A1 | 4/2004 | Santiago |
| 2004/0105557 | A1 | 6/2004 | Matsuo |
| 2004/0125942 | A1 | 7/2004 | Beaucoup |
| 2004/0175006 | A1 | 9/2004 | Kim |
| 2004/0202345 | A1 | 10/2004 | Stenberg |
| 2004/0240664 | A1 | 12/2004 | Freed |
| 2005/0005494 | A1 | 1/2005 | Way |
| 2005/0041530 | A1 | 2/2005 | Goudie |
| 2005/0069156 | A1 | 3/2005 | Haapapuro |
| 2005/0094580 | A1 | 5/2005 | Kumar |
| 2005/0094795 | A1 | 5/2005 | Rambo |
| 2005/0149320 | A1 | 7/2005 | Kajala |
| 2005/0157897 | A1 | 7/2005 | Saltykov |
| 2005/0175189 | A1 | 8/2005 | Lee |
| 2005/0175190 | A1 | 8/2005 | Tashev |
| 2005/0213747 | A1 | 9/2005 | Popovich |
| 2005/0221867 | A1 | 10/2005 | Zurek |
| 2005/0238196 | A1 | 10/2005 | Furuno |
| 2005/0270906 | A1 | 12/2005 | Ramenzoni |
| 2005/0271221 | A1 | 12/2005 | Cerwin |
| 2005/0286698 | A1 | 12/2005 | Bathurst |
| 2005/0286729 | A1 | 12/2005 | Harwood |
| 2006/0083390 | A1 | 4/2006 | Kaderavek |
| 2006/0088173 | A1 | 4/2006 | Rodman |
| 2006/0093128 | A1 | 5/2006 | Oxford |
| 2006/0098403 | A1 | 5/2006 | Smith |
| 2006/0104458 | A1 | 5/2006 | Kenoyer |
| 2006/0109983 | A1 | 5/2006 | Young |
| 2006/0151256 | A1 | 7/2006 | Lee |
| 2006/0159293 | A1 | 7/2006 | Azima |
| 2006/0161430 | A1 | 7/2006 | Schweng |
| 2006/0165242 | A1 | 7/2006 | Miki |
| 2006/0192976 | A1 | 8/2006 | Hall |
| 2006/0198541 | A1 | 9/2006 | Henry |
| 2006/0204022 | A1 | 9/2006 | Hooley |
| 2006/0215866 | A1 | 9/2006 | Francisco |
| 2006/0222187 | A1 | 10/2006 | Jarrett |
| 2006/0233353 | A1 | 10/2006 | Beaucoup |
| 2006/0239471 | A1 | 10/2006 | Mao |
| 2006/0262942 | A1 | 11/2006 | Oxford |
| 2006/0269080 | A1 | 11/2006 | Oxford |
| 2006/0269086 | A1 | 11/2006 | Page |
| 2007/0006474 | A1 | 1/2007 | Taniguchi |
| 2007/0009116 | A1 | 1/2007 | Reining |
| 2007/0019828 | A1 | 1/2007 | Hughes |
| 2007/0053524 | A1 | 3/2007 | Haulick |
| 2007/0093714 | A1 | 4/2007 | Beaucoup |
| 2007/0116255 | A1 | 5/2007 | Derkx |
| 2007/0120029 | A1 | 5/2007 | Keung |
| 2007/0165871 | A1 | 7/2007 | Roovers |
| 2007/0230712 | A1 | 10/2007 | Belt |
| 2007/0253561 | A1 | 11/2007 | Williams |
| 2007/0269066 | A1 | 11/2007 | Derleth |
| 2008/0008339 | A1 | 1/2008 | Ryan |
| 2008/0033723 | A1 | 2/2008 | Jang |
| 2008/0046235 | A1 | 2/2008 | Chen |
| 2008/0056517 | A1 | 3/2008 | Algazi |
| 2008/0101622 | A1 | 5/2008 | Sugiyama |
| 2008/0130907 | A1 | 6/2008 | Sudo |
| 2008/0144848 | A1 | 6/2008 | Buck |
| 2008/0168283 | A1 | 7/2008 | Penning |
| 2008/0188965 | A1 | 8/2008 | Bruey |
| 2008/0212805 | A1 | 9/2008 | Fincham |
| 2008/0232607 | A1 | 9/2008 | Tashev |
| 2008/0247567 | A1 | 10/2008 | Kjolerbakken |
| 2008/0253553 | A1 | 10/2008 | Li |
| 2008/0253589 | A1 | 10/2008 | Trahms |
| 2008/0259731 | A1 | 10/2008 | Happonen |
| 2008/0260175 | A1 | 10/2008 | Elko |
| 2008/0279400 | A1 | 11/2008 | Knoll |
| 2008/0285772 | A1 | 11/2008 | Haulick |
| 2009/0003586 | A1 | 1/2009 | Lai |
| 2009/0030536 | A1 | 1/2009 | Gur |
| 2009/0052684 | A1 | 2/2009 | Ishibashi |
| 2009/0086998 | A1 | 4/2009 | Jeong |
| 2009/0087000 | A1 | 4/2009 | Ko |
| 2009/0087001 | A1 | 4/2009 | Jiang |
| 2009/0094817 | A1 | 4/2009 | Killion |
| 2009/0129609 | A1 | 5/2009 | Oh |
| 2009/0147967 | A1 | 6/2009 | Ishibashi |
| 2009/0150149 | A1 | 6/2009 | Cutter |
| 2009/0161880 | A1 | 6/2009 | Hooley |
| 2009/0169027 | A1 | 7/2009 | Ura |
| 2009/0173030 | A1 | 7/2009 | Gulbrandsen |
| 2009/0173570 | A1 | 7/2009 | Levit |
| 2009/0226004 | A1 | 9/2009 | Soerensen |
| 2009/0233545 | A1 | 9/2009 | Sutskover |
| 2009/0237561 | A1 | 9/2009 | Kobayashi |
| 2009/0254340 | A1 | 10/2009 | Sun |
| 2009/0274318 | A1 | 11/2009 | Ishibashi |
| 2009/0310794 | A1 | 12/2009 | Ishibashi |
| 2010/0011644 | A1 | 1/2010 | Kramer |
| 2010/0034397 | A1 | 2/2010 | Nakadai |
| 2010/0074433 | A1 | 3/2010 | Zhang |
| 2010/0111323 | A1 | 5/2010 | Marton |
| 2010/0111324 | A1 | 5/2010 | Yeldener |
| 2010/0119097 | A1 | 5/2010 | Ohtsuka |
| 2010/0123785 | A1 | 5/2010 | Chen |
| 2010/0128892 | A1 | 5/2010 | Chen |
| 2010/0128901 | A1 | 5/2010 | Herman |
| 2010/0131749 | A1 | 5/2010 | Kim |
| 2010/0142721 | A1 | 6/2010 | Wada |

(56) References Cited

U.S. PATENT DOCUMENTS

2010/0150364 A1 6/2010 Buck
2010/0158268 A1 6/2010 Marton
2010/0165071 A1 7/2010 Ishibashi
2010/0166219 A1 7/2010 Marton
2010/0189275 A1 7/2010 Christoph
2010/0189299 A1 7/2010 Grant
2010/0202628 A1 8/2010 Meyer
2010/0208605 A1 8/2010 Wang
2010/0215184 A1 8/2010 Buck
2010/0215189 A1 8/2010 Marton
2010/0217590 A1 8/2010 Nemer
2010/0245624 A1 9/2010 Beaucoup
2010/0246873 A1 9/2010 Chen
2010/0284185 A1 11/2010 Ngai
2010/0305728 A1 12/2010 Aiso
2010/0314513 A1 12/2010 Evans
2011/0002469 A1 1/2011 Ojala
2011/0007921 A1 1/2011 Stewart
2011/0033063 A1 2/2011 McGrath
2011/0038229 A1 2/2011 Beaucoup
2011/0096136 A1 4/2011 Liu
2011/0096631 A1 4/2011 Kondo
2011/0096915 A1 4/2011 Nemer
2011/0164761 A1 7/2011 McCowan
2011/0194719 A1 8/2011 Frater
2011/0211706 A1 9/2011 Tanaka
2011/0235821 A1 9/2011 Okita
2011/0268287 A1 11/2011 Ishibashi
2011/0311064 A1 12/2011 Teutsch
2011/0311085 A1 12/2011 Stewart
2011/0317862 A1 12/2011 Hosoe
2012/0002835 A1 1/2012 Stewart
2012/0014049 A1 1/2012 Ogle
2012/0027227 A1 2/2012 Kok
2012/0070015 A1 3/2012 Oh
2012/0076316 A1 3/2012 Zhu
2012/0080260 A1 4/2012 Stewart
2012/0093344 A1 4/2012 Sun
2012/0117474 A1 5/2012 Miki
2012/0128160 A1 5/2012 Kim
2012/0128175 A1 5/2012 Visser
2012/0155688 A1 6/2012 Wilson
2012/0155703 A1 6/2012 Hernandez-Abrego
2012/0163625 A1 6/2012 Siotis
2012/0169826 A1 7/2012 Jeong
2012/0177219 A1 7/2012 Mullen
2012/0182429 A1 7/2012 Forutanpour
2012/0207335 A1 8/2012 Spaanderman
2012/0224709 A1 9/2012 Keddem
2012/0243698 A1 9/2012 Elko
2012/0262536 A1 10/2012 Chen
2012/0288079 A1 11/2012 Burnett
2012/0288114 A1 11/2012 Duraiswami
2012/0294472 A1 11/2012 Hudson
2012/0327115 A1 12/2012 Chhetri
2012/0328142 A1 12/2012 Horibe
2013/0002797 A1 1/2013 Thapa
2013/0004013 A1 1/2013 Stewart
2013/0015014 A1 1/2013 Stewart
2013/0016847 A1 1/2013 Steiner
2013/0028451 A1 1/2013 De Roo
2013/0029684 A1 1/2013 Kawaguchi
2013/0034241 A1 2/2013 Pandey
2013/0039504 A1 2/2013 Pandey
2013/0083911 A1 4/2013 Bathurst
2013/0094689 A1 4/2013 Tanaka
2013/0101141 A1 4/2013 McElveen
2013/0136274 A1 5/2013 Aehgren
2013/0142343 A1 6/2013 Matsui
2013/0147835 A1 6/2013 Lee
2013/0156198 A1 6/2013 Kim
2013/0182190 A1 7/2013 McCartney
2013/0206501 A1 8/2013 Yu
2013/0216066 A1 8/2013 Yerrace
2013/0226593 A1 8/2013 Magnusson
2013/0251181 A1 9/2013 Stewart
2013/0264144 A1 10/2013 Hudson
2013/0271559 A1 10/2013 Feng
2013/0294616 A1 11/2013 Mulder
2013/0297302 A1 11/2013 Pan
2013/0304476 A1 11/2013 Kim
2013/0304479 A1 11/2013 Teller
2013/0329908 A1 12/2013 Lindahl
2013/0332156 A1 12/2013 Tackin
2013/0336516 A1 12/2013 Stewart
2013/0343549 A1 12/2013 Vemireddy
2014/0003635 A1 1/2014 Mohammad
2014/0010383 A1 1/2014 Mackey
2014/0016794 A1 1/2014 Lu
2014/0029761 A1 1/2014 Maenpaa
2014/0037097 A1 2/2014 Mark
2014/0050332 A1 2/2014 Nielsen
2014/0072151 A1 3/2014 Ochs
2014/0098233 A1 4/2014 Martin
2014/0098964 A1 4/2014 Rosca
2014/0122060 A1 5/2014 Kaszczuk
2014/0177857 A1 6/2014 Kuster
2014/0233777 A1 8/2014 Tseng
2014/0233778 A1 8/2014 Hardiman
2014/0264654 A1 9/2014 Salmon
2014/0265774 A1 9/2014 Stewart
2014/0270271 A1 9/2014 Dehe
2014/0286518 A1 9/2014 Stewart
2014/0295768 A1 10/2014 Wu
2014/0301586 A1 10/2014 Stewart
2014/0307882 A1 10/2014 Leblanc
2014/0314251 A1 10/2014 Rosca
2014/0341392 A1 11/2014 Lambert
2014/0357177 A1 12/2014 Stewart
2014/0363008 A1 12/2014 Chen
2015/0003638 A1 1/2015 Kasai
2015/0025878 A1 1/2015 Gowreesunker
2015/0030172 A1 1/2015 Gaensler
2015/0033042 A1 1/2015 Iwamoto
2015/0050967 A1 2/2015 Bao
2015/0055796 A1 2/2015 Nugent
2015/0055797 A1 2/2015 Nguyen
2015/0063579 A1 3/2015 Bao
2015/0070188 A1 3/2015 Aramburu
2015/0078581 A1 3/2015 Etter
2015/0078582 A1 3/2015 Graham
2015/0097719 A1 4/2015 Balachandreswaran
2015/0104023 A1 4/2015 Bilobrov
2015/0117672 A1 4/2015 Christoph
2015/0118960 A1 4/2015 Petit
2015/0126255 A1 5/2015 Yang
2015/0156578 A1 6/2015 Alexandridis
2015/0163577 A1 6/2015 Benesty
2015/0185825 A1 7/2015 Mullins
2015/0189423 A1 7/2015 Giannuzzi
2015/0208171 A1 7/2015 Funakoshi
2015/0237424 A1 8/2015 Wilker
2015/0281832 A1 10/2015 Kishimoto
2015/0281833 A1* 10/2015 Shigenaga ..... H04R 3/005 381/92
2015/0281834 A1 10/2015 Takano
2015/0312662 A1 10/2015 Kishimoto
2015/0312691 A1 10/2015 Virolainen
2015/0326968 A1 11/2015 Shigenaga
2015/0341734 A1 11/2015 Sherman
2015/0350621 A1 12/2015 Sawa
2015/0358734 A1 12/2015 Butler
2016/0011851 A1 1/2016 Zhang
2016/0021478 A1 1/2016 Katagiri
2016/0029120 A1 1/2016 Nesta
2016/0031700 A1 2/2016 Sparks
2016/0037277 A1 2/2016 Matsumoto
2016/0055859 A1 2/2016 Finlow-Bates
2016/0080867 A1 3/2016 Nugent
2016/0088392 A1 3/2016 Huttunen
2016/0100092 A1 4/2016 Bohac
2016/0105473 A1 4/2016 Klingbeil
2016/0111109 A1 4/2016 Tsujikawa
2016/0127527 A1 5/2016 Mani

(56) References Cited

U.S. PATENT DOCUMENTS

| | | | |
|---|---|---|---|
| 2016/0134928 | A1 | 5/2016 | Ogle |
| 2016/0142548 | A1 | 5/2016 | Pandey |
| 2016/0142814 | A1 | 5/2016 | Deroo |
| 2016/0142815 | A1 | 5/2016 | Norris |
| 2016/0148057 | A1 | 5/2016 | Oh |
| 2016/0150315 | A1 | 5/2016 | Tzirkel-Hancock |
| 2016/0150316 | A1 | 5/2016 | Kubota |
| 2016/0155455 | A1 | 6/2016 | Ojanperä |
| 2016/0165340 | A1 | 6/2016 | Benattar |
| 2016/0173976 | A1 | 6/2016 | Podhradsky |
| 2016/0173978 | A1 | 6/2016 | Li |
| 2016/0189727 | A1 | 6/2016 | Wu |
| 2016/0192068 | A1 | 6/2016 | Ng |
| 2016/0196836 | A1 | 7/2016 | Yu |
| 2016/0234593 | A1 | 8/2016 | Matsumoto |
| 2016/0249132 | A1 | 8/2016 | Oliaei |
| 2016/0275961 | A1 | 9/2016 | Yu |
| 2016/0295279 | A1 | 10/2016 | Srinivasan |
| 2016/0300584 | A1 | 10/2016 | Pandey |
| 2016/0302002 | A1 | 10/2016 | Lambert |
| 2016/0302006 | A1 | 10/2016 | Pandey |
| 2016/0323667 | A1 | 11/2016 | Shumard |
| 2016/0323668 | A1* | 11/2016 | Abraham ..... H04R 1/406 |
| 2016/0330545 | A1 | 11/2016 | McElveen |
| 2016/0337523 | A1 | 11/2016 | Pandey |
| 2016/0353200 | A1 | 12/2016 | Bigeh |
| 2016/0357508 | A1 | 12/2016 | Moore |
| 2017/0019744 | A1 | 1/2017 | Matsumoto |
| 2017/0064451 | A1 | 3/2017 | Park |
| 2017/0105066 | A1 | 4/2017 | McLaughlin |
| 2017/0134849 | A1 | 5/2017 | Pandey |
| 2017/0134850 | A1 | 5/2017 | Graham |
| 2017/0164101 | A1 | 6/2017 | Rollow, IV |
| 2017/0180861 | A1 | 6/2017 | Chen |
| 2017/0206064 | A1 | 7/2017 | Breazeal |
| 2017/0230748 | A1 | 8/2017 | Shumard |
| 2017/0264999 | A1 | 9/2017 | Fukuda |
| 2017/0303887 | A1 | 10/2017 | Richmond |
| 2017/0308352 | A1 | 10/2017 | Kessler |
| 2017/0374454 | A1 | 12/2017 | Bernardini |
| 2018/0083848 | A1 | 3/2018 | Siddiqi |
| 2018/0102136 | A1 | 4/2018 | Ebenezer |
| 2018/0109873 | A1 | 4/2018 | Xiang |
| 2018/0115799 | A1 | 4/2018 | Thiele |
| 2018/0160224 | A1 | 6/2018 | Graham |
| 2018/0196585 | A1 | 7/2018 | Densham |
| 2018/0219922 | A1 | 8/2018 | Bryans |
| 2018/0227666 | A1 | 8/2018 | Barnett |
| 2018/0292079 | A1 | 10/2018 | Branham |
| 2018/0310096 | A1 | 10/2018 | Shumard |
| 2018/0313558 | A1 | 11/2018 | Byers |
| 2018/0338205 | A1 | 11/2018 | Abraham |
| 2018/0359565 | A1 | 12/2018 | Kim |
| 2019/0042187 | A1 | 2/2019 | Truong |
| 2019/0166424 | A1 | 5/2019 | Harney |
| 2019/0182607 | A1 | 6/2019 | Pedersen |
| 2019/0215540 | A1 | 7/2019 | Nicol |
| 2019/0230436 | A1 | 7/2019 | Tsingos |
| 2019/0259408 | A1* | 8/2019 | Freeman ..... G10L 21/0232 |
| 2019/0268683 | A1 | 8/2019 | Miyahara |
| 2019/0295540 | A1 | 9/2019 | Grima |
| 2019/0295569 | A1 | 9/2019 | Wang |
| 2019/0319677 | A1 | 10/2019 | Hansen |
| 2019/0371354 | A1 | 12/2019 | Lester |
| 2019/0373362 | A1 | 12/2019 | Ansai |
| 2019/0385629 | A1 | 12/2019 | Moravy |
| 2019/0387311 | A1 | 12/2019 | Schultz |
| 2020/0015021 | A1 | 1/2020 | Leppanen |
| 2020/0021910 | A1 | 1/2020 | Rollow, IV |
| 2020/0037068 | A1 | 1/2020 | Barnett |
| 2020/0068297 | A1 | 2/2020 | Rollow, IV |
| 2020/0100009 | A1 | 3/2020 | Lantz |
| 2020/0100025 | A1 | 3/2020 | Shumard |
| 2020/0107137 | A1 | 4/2020 | Koutrouli |
| 2020/0137485 | A1 | 4/2020 | Yamakawa |
| 2020/0145753 | A1 | 5/2020 | Rollow, IV |
| 2020/0152218 | A1 | 5/2020 | Kikuhara |
| 2020/0162618 | A1 | 5/2020 | Enteshari |
| 2020/0228663 | A1 | 7/2020 | Wells-Rutherford |
| 2020/0251119 | A1 | 8/2020 | Yang |
| 2020/0275204 | A1 | 8/2020 | Labosco |
| 2020/0278043 | A1 | 9/2020 | Cao et al. |
| 2020/0288237 | A1 | 9/2020 | Abraham |
| 2021/0012789 | A1 | 1/2021 | Husain et al. |
| 2021/0021940 | A1 | 1/2021 | Petersen |
| 2021/0044881 | A1 | 2/2021 | Lantz |
| 2021/0051397 | A1 | 2/2021 | Veselinovic |
| 2021/0098014 | A1 | 4/2021 | Tanaka |
| 2021/0098015 | A1 | 4/2021 | Pandey |
| 2021/0120335 | A1 | 4/2021 | Veselinovic |
| 2021/0200504 | A1 | 7/2021 | Park |
| 2021/0375298 | A1 | 12/2021 | Zhang |

FOREIGN PATENT DOCUMENTS

| | | |
|---|---|---|
| CA | 2505496 | 10/2006 |
| CA | 2838856 | 12/2012 |
| CA | 2846323 | 9/2014 |
| CN | 1780495 | 5/2006 |
| CN | 101217830 | 7/2008 |
| CN | 101833954 | 9/2010 |
| CN | 101860776 | 10/2010 |
| CN | 101894558 | 11/2010 |
| CN | 102646418 | 8/2012 |
| CN | 102821336 | 12/2012 |
| CN | 102833664 | 12/2012 |
| CN | 102860039 | 1/2013 |
| CN | 104036784 | 9/2014 |
| CN | 104053088 | 9/2014 |
| CN | 104080289 | 10/2014 |
| CN | 104347076 | 2/2015 |
| CN | 104581463 | 4/2015 |
| CN | 105355210 | 2/2016 |
| CN | 105548998 | 5/2016 |
| CN | 106162427 | 11/2016 |
| CN | 106251857 | 12/2016 |
| CN | 106851036 | 6/2017 |
| CN | 107221336 | 9/2017 |
| CN | 107534725 | 1/2018 |
| CN | 108172235 | 6/2018 |
| CN | 109087664 | 12/2018 |
| CN | 208190895 | 12/2018 |
| CN | 109727604 | 5/2019 |
| CN | 110010147 | 7/2019 |
| CN | 306391029 | 3/2021 |
| DE | 2941485 | 4/1981 |
| EM | 0077546430001 | 3/2020 |
| EP | 0381498 | 8/1990 |
| EP | 0594098 | 4/1994 |
| EP | 0869697 | 10/1998 |
| EP | 1180914 | 2/2002 |
| EP | 1184676 | 3/2002 |
| EP | 0944228 | 6/2003 |
| EP | 1439526 | 7/2004 |
| EP | 1651001 | 4/2006 |
| EP | 1727344 | 11/2006 |
| EP | 1906707 | 4/2008 |
| EP | 1952393 | 8/2008 |
| EP | 1962547 | 8/2008 |
| EP | 2133867 | 12/2009 |
| EP | 2159789 | 3/2010 |
| EP | 2197219 | 6/2010 |
| EP | 2360940 | 8/2011 |
| EP | 2710788 | 3/2014 |
| EP | 2721837 | 4/2014 |
| EP | 2772910 | 9/2014 |
| EP | 2778310 | 9/2014 |
| EP | 2942975 | 11/2015 |
| EP | 2988527 | 2/2016 |
| EP | 3131311 | 2/2017 |
| GB | 2393601 | 3/2004 |
| GB | 2446620 | 8/2008 |
| JP | S63144699 | 6/1988 |
| JP | H01260967 | 10/1989 |

(56) References Cited

FOREIGN PATENT DOCUMENTS

| | | |
|---|---|---|
| JP | H0241099 | 2/1990 |
| JP | H05260589 | 10/1993 |
| JP | H07336790 | 12/1995 |
| JP | 3175622 | 6/2001 |
| JP | 2003060530 | 2/2003 |
| JP | 2003087890 | 3/2003 |
| JP | 2004349806 | 12/2004 |
| JP | 2004537232 | 12/2004 |
| JP | 2005323084 | 11/2005 |
| JP | 2006094389 | 4/2006 |
| JP | 2006101499 | 4/2006 |
| JP | 4120646 | 8/2006 |
| JP | 4258472 | 8/2006 |
| JP | 4196956 | 9/2006 |
| JP | 2006340151 | 12/2006 |
| JP | 4760160 | 1/2007 |
| JP | 4752403 | 3/2007 |
| JP | 2007089058 | 4/2007 |
| JP | 4867579 | 6/2007 |
| JP | 2007208503 | 8/2007 |
| JP | 2007228069 | 9/2007 |
| JP | 2007228070 | 9/2007 |
| JP | 2007274131 | 10/2007 |
| JP | 2007274463 | 10/2007 |
| JP | 2007288679 | 11/2007 |
| JP | 2008005347 | 1/2008 |
| JP | 2008042754 | 2/2008 |
| JP | 2008154056 | 7/2008 |
| JP | 2008259022 | 10/2008 |
| JP | 2008263336 | 10/2008 |
| JP | 2008312002 | 12/2008 |
| JP | 2009206671 | 9/2009 |
| JP | 2010028653 | 2/2010 |
| JP | 2010114554 | 5/2010 |
| JP | 2010268129 | 11/2010 |
| JP | 2011015018 | 1/2011 |
| JP | 4779748 | 9/2011 |
| JP | 2012165189 | 8/2012 |
| JP | 5028944 | 9/2012 |
| JP | 5139111 | 2/2013 |
| JP | 5306565 | 10/2013 |
| JP | 5685173 | 3/2015 |
| JP | 2016051038 | 4/2016 |
| KR | 100298300 | 5/2001 |
| KR | 100901464 | 6/2009 |
| KR | 100960781 | 6/2010 |
| KR | 1020130033723 | 4/2013 |
| KR | 300856915 | 5/2016 |
| TW | 201331932 | 8/2013 |
| TW | I484478 | 5/2015 |
| WO | 1997008896 | 3/1997 |
| WO | 1998047291 | 10/1998 |
| WO | 2000030402 | 5/2000 |
| WO | 2003073786 | 9/2003 |
| WO | 2003088429 | 10/2003 |
| WO | 2004027754 | 4/2004 |
| WO | 2004090865 | 10/2004 |
| WO | 2006049260 | 5/2006 |
| WO | 2006071119 | 7/2006 |
| WO | 2006114015 | 11/2006 |
| WO | 2006121896 | 11/2006 |
| WO | 2007045971 | 4/2007 |
| WO | 2008074249 | 6/2008 |
| WO | 2008125523 | 10/2008 |
| WO | 2009039783 | 4/2009 |
| WO | 2009109069 | 9/2009 |
| WO | 2010001508 | 1/2010 |
| WO | 2010091999 | 8/2010 |
| WO | 2010140084 | 12/2010 |
| WO | 2010144148 | 12/2010 |
| WO | 2011104501 | 9/2011 |
| WO | 2012122132 | 9/2012 |
| WO | 2012140435 | 10/2012 |
| WO | 2012160459 | 11/2012 |
| WO | 2012174159 | 12/2012 |
| WO | 2013016986 | 2/2013 |
| WO | 2013182118 | 12/2013 |
| WO | 2014156292 | 10/2014 |
| WO | 2016176429 | 11/2016 |
| WO | 2016179211 | 11/2016 |
| WO | 2017208022 | 12/2017 |
| WO | 2018140444 | 8/2018 |
| WO | 2018140618 | 8/2018 |
| WO | 2018211806 | 11/2018 |
| WO | 2019231630 | 12/2019 |
| WO | 2020168873 | 8/2020 |
| WO | 2020191354 | 9/2020 |
| WO | 211843001 | 11/2020 |

OTHER PUBLICATIONS

"Vsa 2050 II Digitally Steerable Column Speaker," Web page https://www.rcf.it/en_US/products/product-detail/vsa-2050-ii/972389, 15 pages, Dec. 24, 2018.

Advanced Network Devices, IPSCM Ceiling Tile IP Speaker, Feb. 2011, 2 pgs.

Advanced Network Devices, IPSCM Standard 2' by 2' Ceiling Tile Speaker, 2 pgs.

Affes, et al., "A Signal Subspace Tracking Algorithm for Microphone Array Processing of Speech," IEEE Trans. on Speech and Audio Processing, vol. 5, No. 5, Sep. 1997, pp. 425-437.

Affes, et al., "A Source Subspace Tracking Array of Microphones for Double Talk Situations," 1996 IEEE International Conference on Acoustics, Speech, and Signal Processing Conference Proceedings, May 1996, pp. 909-912.

Affes, et al., "An Algorithm for Multisource Beamforming and Multitarget Tracking," IEEE Trans. on Signal Processing, vol. 44, No. 6, Jun. 1996, pp. 1512-1522.

Affes, et al., "Robust Adaptive Beamforming via LMS-Like Target Tracking," Proceedings of IEEE International Conference on Acoustics, Speech and Signal Processing, Apr. 1994, pp. IV-269-IV-272.

Ahonen, et al, "Directional Analysis of Sound Field with Linear Microphone Array and Applications in Sound Reproduction," Audio Engineering Socity, Convention Paper 7329, May 2008, 11 pp.

Alarifi, et al., "Ultra Wideband Indoor Positioning Technologies: Analysis and Recent Advances," Sensors 2016, vol. 16, No. 707, 36 pp.

Amazon webpage for Metalfab MFLCRFG (last visited Apr. 22, 2020) available at <https://www.amazon.com/RETURN-FILTERGRILLE-Drop-Ceiling/dp/B0064Q9A7I/ref=sr 12?dchild=1&keywords=drop+ceiling+return+air+grille&qid=1585862723&s=hi&sr=1-2>, 11 pp.

Armstrong "Walls" Catalog available at <https://www.armstrongceilings.com/content/dam/armstrongceilings/commercial/north-america/catalogs/armstrong-ceilings-wallsspecifiers-reference.pdf>, 2019, 30 pp.

Armstrong Tectum Ceiling & Wall Panels Catalog available at <https://www.armstrongceilings.com/content/dam/armstrongceilings/commercial/north-america/brochures/tectum-brochure.pdf>, 2019, 16 pp.

Armstrong Woodworks Concealed Catalog available at <https://sweets.construction.com/swts_content_files/3824/442581.pdf>, 2014, 6 pp.

Armstrong Woodworks Walls Catalog available at <https://www.armstrongceilings.com/pdbupimagesclg/220600.pdf/download/datasheet-woodworks-walls.pdf>, 2019, 2 pp.

Armstrong World Industries, Inc., I-Ceilings Sound Systems Speaker Panels, 2002, 4 pgs.

Armstrong, Acoustical Design: Exposed Structure, available at <https://www.armstrongceilings.com/pdbupimagesclg/217142.pdf/download/acoustical-design-exposed-structurespaces-brochure.pdf>, 2018, 19 pp.

Armstrong, Ceiling Systems, Brochure page for Armstrong Softlook, 1995, 2 pp.

Armstrong, Excerpts from Armstrong 2011-2012 Ceiling Wall Systems Catalog, available at <https://web.archive.org/web/20121116034120/http://www.armstrong.com/commceilingsna/en_us/pdf/ceilings_catalog_screen-2011.pdf>, as early as 2012, 162 pp.

(56) References Cited

OTHER PUBLICATIONS

Armstrong, i-Ceilings, Brochure, 2009, 12 pp.
Arnold, et al., "A Directional Acoustic Array Using Silicon Micromachined Piezoresistive Microphones," Journal of the Acoustical Society of America, 113(1), Jan. 2003, 10 pp.
Atlas Sound, I128SYSM IP Compliant Loudspeaker System with Microphone Data Sheet, 2009, 2 pgs.
Atlas Sound, 1 'X2' IP Speaker with Micophone for Suspended Ceiling Systems, https://www.atlasied.com/i128sysm, retrieved Oct. 25, 2017, 5 pgs.
Audio Technica, ES945 Omnidirectional Condenser Boundary Microphones, https://eu.audio-technica.com/resources/ES945%20Specifications.pdf, 2007, 1 pg.
Audix Microphones, Audix Introduces Innovative Ceiling Mies, http://audixusa.com/docs_12/latest_news/EFplFkAAklOtSdolke.shtml, Jun. 2011, 6 pgs.
Audix Microphones, M70 Flush Mount Ceiling Mic, May 2016, 2 pgs.
Automixer Gated, Information Sheet, MIT, Nov. 2019, 9 pp.
AVNetwork, "Top Five Conference Room Mic Myths," Feb. 25, 2015, 14 pp.
Beh, et al., "Combining Acoustic Echo Cancellation and Adaptive Beamforming for Achieving Robust Speech Interface in Mobile Robot," 2008 IEEE/RSJ International Conference on Intelligent Robots and Systems, Sep. 2008, pp. 1693-1698.
Benesty, et al., "A New Class of Doubletalk Detectors Based on Cross-Correlation," IEEE Transactions on Speech and Audio Processing, vol. 8, No. 2, Mar. 2000, pp. 168-172.
Benesty, et al., "Adaptive Algorithms for Mimo Acoustic Echo Cancellation," AI2 Allen Institute for Artifical Intelligence, 2003.
Benesty, et al., "Differential Beamforming," Fundamentals of Signal Enhancement and Array Signal Processing, First Edition, 2017, 39 pp.
Benesty, et al., "Frequency-Domain Adaptive Filtering Revisited, Generalization to the Multi-Channel Case, and Application to Acoustic Echo Cancellation," 2000 IEEE International Conference on Acoustics, Speech, and Signal Processing Proceedings, Jun. 2000, pp. 789-792.
Benesty, et. Al., "Microphone Array Signal Processing," Springer, 2010, 20 pp.
Berkun, et al., "Combined Beamformers for Robust Broadband Regularized Superdirective Beamforming," IEEE/ACM Transactions on Audio, Speech, and Language Processing, vol. 23, No. 5, May 2015, 10 pp.
Beyer Dynamic, Classis BM 32-33-34 DE-EN-FR 2016, 1 pg.
Beyer Dynamic, Classis—BM-33-PZ A1, 2013, 1 pg.
BNO055, Intelligent 9-axis absolute orientation sensor, Data sheet, Bosch, Nov. 2020, 118 pp.
Boyd, et al., Convex Optimization, Mar. 15, 1999, 216 pgs.
Brandstein, et al., "Microphone Arrays: Signal Processing Techniques and Applications," Digital Signal Processing, Springer-Verlag Berlin Heidelberg, 2001, 401 pgs.
Brooks, et al., "A Quantitative Assessment of Group Delay Methods for Identifying Glottal Closures in Voiced Speech," IEEE Transaction on Audio, Speech, and Language Processing, vol. 14, No. 2, Mar. 2006, 11 pp.
Bruel & Kjaer, by J.J. Christensen and J. Hald, Technical Review: Beamforming, No. 1, 2004, 54 pgs.
BSS Audio, Soundweb London Application Guides, 2010, 120 pgs.
Buchner, et al., "An Acoustic Human-Machine Interface with Multi-Channel Sound Reproduction," IEEE Fourth Workshop on Multimedia Signal Processing, Oct. 2001, pp. 359-364.
Buchner, et al., "An Efficient Combination of Multi-Channel Acoustic Echo Cancellation with a Beamforming Microphone Array," International Workshop on Hands-Free Speech Communication (HSC2001), Apr. 2001, pp. 55-58.
Buchner, et al., "Full-Duplex Communication Systems Using Loudspeaker Arrays and Microphone Arrays," IEEE International Conference on Multimedia and Expo, Aug. 2002, pp. 509-512.
Buchner, et al., "Generalized Multichannel Frequency-Domain Adaptive Filtering: Efficient Realization and Application to Hands-Free Speech Communication," Signal Processing 85, 2005, pp. 549-570.
Buchner, et al., "Multichannel Frequency-Domain Adaptive Filtering with Application to Multichannel Acoustic Echo Cancellation," Adaptive Signal Processing, 2003, pp. 95-128.
Buck, "Aspects of First-Order Differential Microphone Arrays in the Presence of Sensor Imperfections," Transactions on Emerging Telecommunications Technologies, 13.2, 2002, 8 pp.
Buck, et al., "First Order Differential Microphone Arrays for Automotive Applications," 7th International Workshop on Acoustic Echo and Noise Control, Darmstadt University of Technology, Sep. 10-13, 2001, 4 pp.
Buck, et al., "Self-Calibrating Microphone Arrays for Speech Signal Acquisition: A Systematic Approach," Signal Processing, vol. 86, 2006, pp. 1230-1238.
Burton, et al., "A New Structure for Combining Echo Cancellation and Beamforming in Changing Acoustical Environments," IEEE International Conference on Acoustics, Speech and Signal Processing, 2007, pp. 1-77-1-80.
BZ-3a Installation Instructions, XEDIT Corporation, Available at <chrome-extension://efaidnbmnnnibpcajpcglclefindmkaj/viewer.html?pdfurl=https%3A%2F%2Fwww.servoreelers.com%2Fmt-content%2Fuploads%2F2017%2F05%2Fbz-a-3universal-2017c.pdf&clen=189067&chunk=true>, 1 p.
Cabral, et al., Glottal Spectral Separation for Speech Synthesis, IEEE Journal of Selected Topics in Signal Processing, 2013, 15 pp.
Campbell, "Adaptive Beamforming Using a Microphone Array for Hands-Free Telephony," Virginia Polytechnic Institute and State University, Feb. 1999, 154 pgs.
Canetto, et al., "Speech Enhancement Systems Based on Microphone Arrays," VI Conference of the Italian Society for Applied and Industrial Mathematics, May 27, 2002, 9 pp.
Cao, "Survey on Acoustic Vector Sensor and its Applications in Signal Processing" Proceedings of the 33rd Chinese Control Conference, Jul. 2014, 17 pp.
Cech, et al., "Active-Speaker Detection and Localization with Microphones and Cameras Embedded into a Robotic Head," IEEE-RAS International Conference on Humanoid Robots, Oct. 2013, pp. 203-210.
Chan, et al., "Uniform Concentric Circular Arrays with Frequency-Invariant Characteristics—Theory, Design, Adaptive Beamforming and DOA Estimation," IEEE Transactions on Signal Processing, vol. 55, No. 1, Jan. 2007, pp. 165-177.
Chau, et al., "A Subband Beamformer on an Ultra Low-Power Miniature DSP Platform," 2002 IEEE International Conference on Acoustics, Speech, and Signal Processing, 4 pp.
Chen, et al., "A General Approach to the Design and Implementation of Linear Differential Microphone Arrays," Signal and Information Processing Association Annual Summit and Conference, 2013 Asia-Pacific, IEEE, 7 pp.
Chen, et al., "Design and Implementation of Small Microphone Arrays," PowerPoint Presentation, Northwestern Polytechnical University and Institut national de la recherche scientifique, Jan. 1, 2014, 56 pp.
Chen, et al., "Design of Robust Broadband Beamformers with Passband Shaping Characteristics using Tikhonov Regularization," IEEE Transactions on Audio, Speech, and Language Processing, vol. 17, No. 4, May 2009, pp. 565-681.
Chou, "Frequency-Independent Beamformer with Low Response Error," 1995 International Conference on Acoustics, Speech, and Signal Processing, pp. 2995-2998, May 9, 1995, 4 pp.
Chu, "Desktop Mic Array for Teleconferencing," 1995 International Conference on Acoustics, Speech, and Signal Processing, May 1995, pp. 2999-3002.
Circuit Specialists webpage for an aluminum enclosure, available at <https://www.circuitspecialists.com/metal-instrument-enclosure-la7.html?otaid=gpl&gclid=EAIaIQobChMI2JTw-Ynm6AIVgbblCh3F4QKuEAkYBiABEgJZMPD_BwE>, 3 pp, 2019.
ClearOne Introduces Ceiling Microphone Array With Built-In Dante Interface, Press Release; GlobeNewswire, Jan. 8, 2019, 2 pp.

(56) References Cited

OTHER PUBLICATIONS

ClearOne Launches Second Generation of its Groundbreaking Beamforming Microphone Array, Press Release, Acquire Media, Jun. 1, 2016, 2 pp.
ClearOne to Unveil Beamforming Microphone Array with Adaptive Steering and Next Generation Acoustic Echo Cancellation Technology, Press Release, InfoComm, Jun. 4, 2012, 1 p.
ClearOne, Clearly Speaking Blog, "Advanced Beamforming Microphone Array Technology for Corporate Conferencing Systems," Nov. 11, 2013, 5 pp., http://www.clearone.com/blog/advanced-beamforming-microphone-array-technology-for-corporate-conferencing-systems/.
ClearOne, Beamforming Microphone Array, Mar. 2012, 6 pgs.
ClearOne, Ceiling Microphone Array Installation Manual, Jan. 9, 2012, 20 pgs.
ClearOne, Converge/Converge Pro, Manual, 2008, 51 pp.
ClearOne, Professional Conferencing Microphones, Brochure, Mar. 2015, 3 pp.
Coleman, "Loudspeaker Array Processing for Personal Sound Zone Reproduction," Centre for Vision, Speech and Signal Processing, 2014, 239 pp.
Cook, et al., An Alternative Approach to Interpolated Array Processing for Uniform Circular Arrays, Asia-Pacific Conference on Circuits and Systems, 2002, pp. 411-414.
Cox, et al., "Robust Adaptive Beamforming," IEEE Trans. Acoust., Speech, and Signal Processing, vol. ASSP-35, No. 10, Oct. 1987, pp. 1365-1376.
CTG Audio, Ceiling Microphone CTG CM-01, Jun. 5, 2008, 2 pgs.
CTG Audio, CM-01 & CM-02 Ceiling Microphones Specifications, 2 pgs.
CTG Audio, CM-01 & CM-02 Ceiling Microphones, 2017, 4 pgs.
CTG Audio, CTG FS-400 and RS-800 with "Beamforming" Technology, Datasheet, As early as 2009, 2 pp.
CTG Audio, CTG User Manual for the FS-400/800 Beamforming Mixers, Nov. 2008, 26 pp.
CTG Audio, Expand Your IP Teleconferencing to Full Room Audio, Obtained from website htt.)://www ct audio com/ex and-, our-i - teleconforencino-to-ful-room-audio-while-conquennc.1-echo-cancelation-issues Mull, 2014.
CTG Audio, Frequently Asked Questions, As early as 2009, 2 pp.
CTG Audio, Installation Manual and User Guidelines for the Soundman SM 02 System, May 2001, 29 pp.
CTG Audio, Installation Manual, Nov. 21, 2008, 25 pgs.
CTG Audio, Introducing the CTG FS-400 and FS-800 with Beamforming Technology, As early as 2008, 2 pp.
CTG Audio, Meeting the Demand for Ceiling Mies in the Enterprise 5 Best Practices, Brochure, 2012, 9 pp.
CTG Audio, White on White—Introducing the CM-02 Ceiling Microphone, https://ctgaudio.com/white-on-white-introducing-the-cm-02-ceiling-microphone/, Feb. 20, 2014, 3 pgs.
Dahl et al., Acoustic Echo Cancelling with Microphone Arrays, Research Report Mar. 1995, Univ. of Karlskrona/Ronneby, Apr. 1995, 64 pgs.
Decawave, Application Note: APR001, UWB Regulations, A Summary of Worldwide Telecommunications Regulations governing the use of Ultra-Wideband radio, Version 1.2, 2015, 63 pp.
Desiraju, et al., "Efficient Multi-Channel Acoustic Echo Cancellation Using Constrained Sparse Filter Updates in the Subband Domain," Acoustic Speech Enhancement Research, Sep. 2014, 4 pp.
DiBiase. et al., Robust Localization in Reverberent Rooms, in Brandstein, ed., Microphone Arrays: Techniques and Applications, 2001, Springer-Verlag Berlin Heidelberg, pp. 157-180.
Diethorn, "Audio Signal Processing for Next-Generation Multimedia Communication Systems," Chapter 4, 2004, 9 pp.
Digikey webpage for Converta box (last visited Apr. 22, 2020) <https://www.digikey.com/product-detail/en/bud-industries/CU-452-A/377-1969-ND/439257?utm_adgroup=Boxes&utm_source=google&utm_medium=cpc&utm_campaign=Shopping_Boxes%2C%20Enclosures%2C%20Racks_NEW&utm_term=&utm_content=Boxes&gclid=EAIaIQobChMI2JTw-Ynm6AIVgbblCh3F4QKuEAkYCSABEgKybPD_BwE>, 3 pp.
Digikey webpage for Pomona Box (last visited Apr. 22, 2020) available at <https://www.digikey.com/product-detail/en/pomonaelectronics/3306/501-2054-ND/736489>, 2 pp.
Digital Wireless Conference System, MCW-D 50, Beyerdynamic Inc., 2009, 18 pp.
Do et al., A Real-Time SRP-PHAT Source Location Implementation using Stochastic Region Contraction (SRC) on a Large-Aperture Microphone Array, 2007 IEEE International Conference on Acoustics, Speech and Signal Processing—ICASSP '07, , Apr. 2007, pp. I-121-I-124.
Dominguez, et al., "Towards an Environmental Measurement Cloud: Delivering Pollution Awareness to the Public," International Journal of Distributed Sensor Networks, vol. 10, Issue 3, Mar. 31, 2014, 17 pp.
Dormehl, "HoloLens concept lets you control your smart home via augmented reality," digitaltrends, Jul. 26, 2016, 12 pp.
Double Condenser Microphone SM 69, Datasheet, Georg Neumann GmbH, available at <https://ende.neumann.com/product_files/7453/download>, 8 pp.
Eargle, "The Microphone Handbook," Elar Publ. Co., 1st ed., 1981, 4 pp.
Enright, Notes From Logan, June edition of Scanlines, Jun. 2009, 9 pp.
Fan, et al., "Localization Estimation of Sound Source by Microphones Array," Procedia Engineering 7, 2010, pp. 312-317.
Firoozabadi, et al., "Combination of Nested Microphone Array and Subband Processing for Multiple Simultaneous Speaker Localization," 6th International Symposium on Telecommunications, Nov. 2012, pp. 907-912.
Flanagan et al., Autodirective Microphone Systems, Acustica, vol. 73, 1991, pp. 58-71.
Flanagan, et al., "Computer-Steered Microphone Arrays for Sound Transduction in Large Rooms," J. Acoust. Soc. Am. 78 (5), Nov. 1985, pp. 1508-1518.
Fohhn Audio New Generation of Beam Steering Systems Available Now, audioXpress Staff, May 10, 2017, 8 pp.
Fox, et al., "A Subband Hybrid Beamforming for In-Car Speech Enhancement," 20th European Signal rocessing Conference, Aug. 2012, 5 pp.
Frost, III, An Algorithm for Linearly Constrained Adaptive Array Processing, Proc. IEEE, vol. 60, No. 8, Aug. 1972, pp. 926-935.
Gannot et al., Signal Enhancement using Beamforming and Nonstationarity with Applications to Speech, IEEE Trans. on Signal Processing, vol. 49, No. 8, Aug. 2001, pp. 1614-1626.
Gansler et al., A Double-Talk Detector Based on Coherence, IEEE Transactions on Communications, vol. 44, No. 11, Nov. 1996, pp. 1421-1427.
Gazor et al., Robust Adaptive Beamforming via Target Tracking, IEEE Transactions on Signal Processing, vol. 44, No. 6, Jun. 1996, pp. 1589-1593.
Gazor et al., Wideband Multi-Source Beamforming with Adaptive Array Location Calibration and Direction Finding, 1995 International Conference on Acoustics, Speech, and Signal Processing, May 1995, pp. 1904-1907.
Gentner Communications Corp., AP400 Audio Perfect 400 Audioconferencing System Installation & Operation Manual, Nov. 1998, 80 pgs.
Gentner Communications Corp., XAP 800 Audio Conferencing System Installation & Operation Manual, Oct. 2001, 152 pgs.
Gil-Cacho et al., Multi-Microphone Acoustic Echo Cancellation Using Multi-Channel Warped Linear Prediction of Common Acoustical Poles, 18th European Signal Processing Conference, Aug. 2010, pp. 2121-2125.
Giuliani, et al., "Use of Different Microphone Array Configurations for Hands-Free Speech Recognition in Noisy and Reverberant Environment," IRST—Istituto per la Ricerca Scientifica e Tecnologica, Sep. 22, 1997, 4 pp.
Gritton et al., Echo Cancellation Algorithms, IEEE ASSP Magazine, vol. 1, issue 2, Apr. 1984, pp. 30-38.

(56) References Cited

OTHER PUBLICATIONS

Hald, et al., "A class of optimal broadband phased array geometries designed for easy construction," 2002 Int'l Congress & Expo. on Noise Control Engineering, Aug. 2002, 6 pp.
Hamalainen, et al., "Acoustic Echo Cancellation for Dynamically Steered Microphone Array Systems," 2007 IEEE Workshop on Applications of Signal Processing to Audio and Acoustics, Oct. 2007, pp. 58-61.
Hayo, Virtual Controls for Real Life, Web page downloaded from https://hayo.io/ on Sep. 18, 2019, 19 pp.
Herbordt et al., A Real-time Acoustic Human-Machine Front-End for Multimedia Applications Integrating Robust Adaptive Beamforrning and Stereophonic Acoustic Echo Cancellation, 7th International Conference on Spoken Language Processing, Sep. 2002, 4 pgs.
Herbordt et al., GSAEC—Acoustic Echo Cancellation embedded into the Generalized Sidelobe Canceller, 10th European Signal Processing Conference, Sep. 2000, 5 pgs.
Herbordt et al., Multichannel Bin-Wise Robust Frequency-Domain Adaptive Filtering and Its Application to Adaptive Beamforming, IEEE Transactions on Audio, Speech, and Language Processing, vol. 15, No. 4, May 2007, pp. 1340-1351.
Herbordt, "Combination of Robust Adaptive Beamforming with Acoustic Echo Cancellation for Acoustic Human/Machine Interfaces," Friedrich-Alexander University, 2003, 293 pgs.
Herbordt, et al., Joint Optimization of LCMV Beamforming and Acoustic Echo Cancellation for Automatic Speech Recognition, IEEE International Conference on Acoustics, Speech, and Signal Processing, Mar. 2005, pp. III-77-III-80.
Holm, "Optimizing Microphone Arrays for use in Conference Halls," Norwegian University of Science and Technology, Jun. 2009, 101 pp.
Huang et al., Immersive Audio Schemes: The Evolution of Multiparty Teleconferencing, IEEE Signal Processing Magazine, Jan. 2011, pp. 20-32.
ICONYX Gen5, Product Overview; Renkus-Heinz, Dec. 24, 2018, 2 pp.
International Search Report and Written Opinion for PCT/US2016/022773 dated Jun. 10, 2016.
International Search Report and Written Opinion for PCT/US2016/029751 dated Nov. 28, 2016, 21 pp.
International Search Report and Written Opinion for PCT/US2018/013155 dated Jun. 8, 2018.
International Search Report and Written Opinion for PCT/US2019/031833 dated Jul. 24, 2019, 16 pp.
International Search Report and Written Opinion for PCT/US2019/033470 dated Jul. 31, 2019, 12 pp.
International Search Report and Written Opinion for PCT/US2019/051989 dated Jan. 10, 2020, 15 pp.
International Search Report and Written Opinion for PCT/US2020/024063 dated Aug. 31, 2020, 18 pp.
International Search Report and Written Opinion for PCT/US2020/035185 dated Sep. 15, 2020, 11 pp.
International Search Report and Written Opinion for PCT/US2020/058385 dated Mar. 31, 2021, 20 pp.
International Search Report and Written Opinion for PCT/US2021/070625 dated Sep. 17, 2021, 17 pp.
International Search Report for PCT/US2020/024005 dated Jun. 12, 2020, 12 pp.
InvenSense, "Microphone Array Beamforming," Application Note AN-1140, Dec. 31, 2013, 12 pp.
Invensense, Recommendations for Mounting and Connecting InvenSense MEMS Microphones, Application Note AN-1003, 2013, 11 pp.
Ishii et al., Investigation on Sound Localization using Multiple Microphone Arrays, Reflection and Spatial Information, Japanese Society for Artificial Intelligence, JSAI Technical Report, SIG—Challenge—B202-11, 2012, pp. 64-69.
Ito et al., Aerodynamic/Aeroacoustic Testing in Anechoic Closed Test Sections of Low-speed Wind Tunnels, 16th AIAA/CEAS Aeroacoustics Conference, 2010, 11 pgs.
Johansson et al., Robust Acoustic Direction of Arrival Estimation using Root-SRP-PHAT, a Realtime Implementation, IEEE International Conference on Acoustics, Speech, and Signal Processing, Mar. 2005, 4 pgs.
Johansson, et al., Speaker Localisation using the Far-Field SRP-PHAT in Conference Telephony, 2002 International Symposium on Intelligent Signal Processing and Communication Systems, 5 pgs.
Johnson, et al., "Array Signal Processing: Concepts and Techniques," p. 59, Prentice Hall, 1993, 3 pp.
Julstrom et al., Direction-Sensitive Gating: A New Approach to Automatic Mixing, J. Audio Eng. Soc., vol. 32, No. 7/8, Jul./Aug. 1984, pp. 490-506.
Kahrs, Ed., The Past, Present, and Future of Audio Signal Processing, IEEE Signal Processing Magazine, Sep. 1997, pp. 30-57.
Kallinger et al., Multi-Microphone Residual Echo Estimation, 2003 IEEE International Conference on Acoustics, Speech, and Signal Processing, Apr. 2003, 4 pgs.
Kammeyer, et al., New Aspects of Combining Echo Cancellers with Beamformers, IEEE International Conference on Acoustics, Speech, and Signal Processing, Mar. 2005, pp. III-137-III-140.
Kellermann, A Self-Steering Digital Microphone Array, 1991 International Conference on Acoustics, Speech, and Signal Processing, Apr. 1991, pp. 3581-3584.
Kellermann, Acoustic Echo Cancellation for Beamforming Microphone Arrays, in Brandstein, ed., Microphone Arrays: Techniques and Applications, 2001, Springer-Verlag Berlin Heidelberg, pp. 281-306.
Kellermann, Integrating Acoustic Echo Cancellation with Adaptive Beamforming Microphone Arrays, Forum Acusticum, Berlin, Mar. 1999, pp. 1-4.
Kellermann, Strategies for Combining Acoustic Echo Cancellation and Adaptive Beamforming Microphone Arrays, 1997 IEEE International Conference on Acoustics, Speech, and Signal Processing, Apr. 1997, 4 pgs.
Klegon, "Achieve Invisible Audio with the MXA910 Ceiling Array Microphone," Jun. 27, 2016, 10 pp.
Knapp, et al., The Generalized Correlation Method for Estimation of Time Delay, IEEE Transactions on Acoustics, Speech, and Signal Processing, vol. ASSP-24, No. 4, Aug. 1976, pp. 320-327.
Kobayashi et al., A Hands-Free Unit with Noise Reduction by Using Adaptive Beamformer, IEEE Transactions on Consumer Electronics, vol. 54, No. 1, Feb. 2008, pp. 116-122.
Kobayashi et al., A Microphone Array System with Echo Canceller, Electronics and Communications in Japan, Part 3, vol. 89, No. 10, Feb. 2, 2006, pp. 23-32.
Kolundžija, et al., "Baffled circular loudspeaker array with broadband high directivity," 2010 IEEE International Conference on Acoustics, Speech and Signal Processing, Dallas, TX, 2010, pp. 73-76.
Lai, et al., "Design of Robust Steerable Broadband Beamformers with Spiral Arrays and the Farrow Filter Structure," Proc. Intl. Workshop Acoustic Echo Noise Control, 2010, 4 pp.
Lebret, et al., Antenna Array Pattern Synthesis via Convex Cptimization, IEEE Trans. on Signal Processing, vol. 45, No. 3, Mar. 1997, pp. 526-532.
LecNet2 Sound System Design Guide, Lectrosonics, Jun. 2, 2006.
Lectrosonics, LecNet2 Sound System Design Guide, Jun. 2006, 28 pgs.
Lee et al., Multichannel Teleconferencing System with Multispatial Region Acoustic Echo Cancellation, International Workshop on Acoustic Echo and Noise Control (IWAENC2003), Sep. 2003, pp. 51-54.
Li, "Broadband Beamforming and Direction Finding Using Concentric Ring Array," Ph.D. Dissertation, University of Missouri-Columbia, Jul. 2005, 163 pp.
Lindstrom et al., An Improvement of the Two-Path Algorithm Transfer Logic for Acoustic Echo Cancellation, IEEE Transactions on Audio, Speech, and Language Processing, vol. 15, No. 4, May 2007, pp. 1320-1326.
Liu et al., Adaptive Beamforming with Sidelobe Control: A Second-Order Cone Programming Approach, IEEE Signal Proc. Letters, vol. 10, No. 11, Nov. 2003, pp. 331-334.

(56) References Cited

OTHER PUBLICATIONS

Liu, et al., "Frequency Invariant Beamforming in Subbands," IEEE Conference on Signals, Systems and Computers, 2004, 5 pp.
Liu, et al., "Wideband Beamforming," Wiley Series on Wireless Communications and Mobile Computing, pp. 143-198, 2010, 297 pp.
Lobo, et al., Applications of Second-Order Cone Programming, Linear Algebra and its Applications 284, 1998, pp. 193-228.
Luo et al., Wideband Beamforming with Broad Nulls of Nested Array, Third Int'l Conf. on Info. Science and Tech., Mar. 23-25, 2013, pp. 1645-1648.
Marquardt et al., A Natural Acoustic Front-End for Interactive TV in the EU-Project DICIT, IEEE Pacific Rim Conference on Communications, Computers and Signal Processing, Aug. 2009, pp. 894-899.
Martin, Small Microphone Arrays with Postfilters for Noise and Acoustic Echo Reduction, in Brandstein, ed., Microphone Arrays: Techniques and Applications, 2001, Springer-Verlag Berlin Heidelberg, pp. 255-279.
Maruo et al., On the Optimal Solutions of Beamformer Assisted Acoustic Echo Cancellers, IEEE Statistical Signal Processing Workshop, 2011, pp. 641-644.
McCowan, Microphone Arrays: A Tutorial, Apr. 2001, 36 pgs.
MFLCRFG Datasheet, Metal_Fab Inc., Sep. 7, 2007, 1 p.
Microphone Array Primer, Shure Question and Answer Page, <https://service.shure.eom/s/article/microphone-array-primer?language=en_US>, Jan. 2019, 5 pp.
Milanovic, et al., "Design and Realization of FPGA Platform for Real Time Acoustic Signal Acquisition and Data Processing" 22nd Telecommunications Forum TELFOR, 2014, 6 pp.
Mohammed, A New Adaptive Beamformer for Optimal Acoustic Echo and Noise Cancellation with Less Computational Load, Canadian Conference on Electrical and Computer Engineering, May 2008, pp. 000123-000128.
Mohammed, A New Robust Adaptive Beamformer for Enhancing Speech Corrupted with Colored Noise, AICCSA, Apr. 2008, pp. 508-515.
Mohammed, Real-time Implementation of an efficient RLS Algorithm based on IIR Filter for Acoustic Echo Cancellation, AICCSA, Apr. 2008, pp. 489-494.
Mohan, et al., "Localization of multiple acoustic sources with small arrays using a coherence test," Journal Acoustic Soc Am., 123(4), Apr. 2008, 12 pp.
Moulines, et al., "Pitch-Synchronous Waveform Processing Techniques for Text-to-Speech Synthesis Using Diphones," Speech Communication 9, 1990, 15 pp.
Multichannel Acoustic Echo Cancellation, Obtained from website http://www.buchner-net.com/mcaec.html, Jun. 2011.
Myllyla et al., Adaptive Beamforming Methods for Dynamically Steered Microphone Array Systems, 2008 IEEE International Conference on Acoustics, Speech and Signal Processing, Mar.-Apr. 2008, pp. 305-308.
New Shure Microflex Advance MXA910 Microphone With Intellimix Audio Processing Provides Greater Simplicity, Flexibility, Clarity, Press Release, Jun. 12, 2019, 4 pp.
Nguyen-Ky, et al., "An Improved Error Estimation Algorithm for Stereophonic Acoustic Echo Cancellation Systems," 1st International Conference on Signal Processing and Communication Systems, Dec. 17-19, 2007, 5 pp.
Office Action for Taiwan Patent Application No. 105109900 dated May 5, 2017.
Office Action issued for Japanese Patent Application No. 2015-023781 dated Jun. 20, 2016, 4 pp.
Oh, et al., "Hands-Free Voice Communication in an Automobile With a Microphone Array," 1992 IEEE International Conference on Acoustics, Speech, and Signal Processing, Mar. 1992, pp. I-281-I-284.
Olszewski, et al., "Steerable Highly Directional Audio Beam Loudspeaker," Interspeech 2005, 4 pp.
Omologo, Multi-Microphone Signal Processing for Distant-Speech Interaction, Human Activity and Vision Summer School (HAVSS), INRIA Sophia Antipolis, Oct. 3, 2012, 79 pgs.
Order, Conduct of the Proceeding, *Clearone, Inc.* v. *Shure Acquisition Holdings, Inc.*, Nov. 2, 2020, 10 pp.
Pados et al., An Iterative Algorithm for the Computation of the MVDR Filter, IEEE Trans. on Signal Processing, vol. 49, No. 2, Feb. 2001, pp. 290-300.
Palladino, "This App Lets You Control Your Smarthome Lights via Augmented Reality," Next Reality Mobile AR News, Jul. 2, 2018, 5 pp.
Parikh, et al., "Methods for Mitigating IP Network Packet Loss in Real Time Audio Streaming Applications," GatesAir, 2014, 6 pp.
Pasha, et al., "Clustered Multi-channel Dereverberation for Ad-hoc Microphone Arrays," Proceedings of APSIPA Annual Summit and Conference, Dec. 2015, pp. 274-278.
Petitioner's Motion for Sanctions, *Clearone, Inc.* v. *Shure Acquisition Holdings, Inc.*, Aug. 24, 2020, 20 pp.
Pettersen, "Broadcast Applications for Voice-Activated Microphones," db, Jul./Aug. 1985, 6 pgs.
Pfeifenberger, et al., "Nonlinear Residual Echo Suppression using a Recurrent Neural Network," Interspeech 2020, 5 pp.
Phoenix Audio Technologies, "Beamforming and Microphone Arrays—Common Myths", Apr. 2016, http://info.phnxaudio.com/blog/microphone-arrays-beamforming-myths-1, 19 pp.
Plascore, PCGA-XR1 3003 Aluminum Honeycomb Data Sheet, 2008, 2 pgs.
Polycom Inc., Vortex EF2211/EF2210 Reference Manual, 2003, 66 pgs.
Polycom, Inc., Polycom Soundstructure C16, C12, C8, and SR12 Design Guide, Nov. 2013, 743 pgs.
Polycom, Inc., Setting Up the Polycom HDX Ceiling Microphone Array Series, https://support.polycom.com/content/dam/polycom-support/products/Telepresence-and-Video/HDX%20Series/setup-maintenance/en/hdx_ceiling_microphone_array_setting_up.pdf, 2010, 16 pgs.
Polycom, Inc., Vortex EF2241 Reference Manual, 2002, 68 pgs.
Polycom, Inc., Vortex EF2280 Reference Manual, 2001, 60 pp.
Pomona, Model 3306, Datasheet, Jun. 9, 1999, 1 p.
Powers, et al., "Proving Adaptive Directional Technology Works: A Review of Studies," The Hearing Review, Apr. 6, 2004, 5 pp.
Prime, et al., "Beamforming Array Optimisation Averaged Sound Source Mapping on a Model Wind Turbine," ResearchGate, Nov. 2014, 10 pp.
Rabinkin et al., Estimation of Wavefront Arrival Delay Using the Cross-Power Spectrum Phase Technique, 132nd Meeting of the Acoustical Society of America, Dec. 1996, pp. 1-10.
Rane Corp., Halogen Acoustic Echo Cancellation Guide, AEC Guide Version 2, Nov. 2013, 16 pgs.
Rao, et al., "Fast LMS/Newton Algorithms for Stereophonic Acoustic Echo Cancelation," IEEE Transactions on Signal Processing, vol. 57, No. 8, Aug. 2009.
Reuven et al., Joint Acoustic Echo Cancellation and Transfer Function GSC in the Frequency Domain, 23rd IEEE Convention of Electrical and Electronics Engineers in Israel, Sep. 2004, pp. 412-415.
Reuven et al., Joint Noise Reduction and Acoustic Echo Cancellation Using the Transfer-Function Generalized Sidelobe Canceller, Speech Communication, vol. 49, 2007, pp. 623-635.
Reuven, et al., "Multichannel Acoustic Echo Cancellation and Noise Reduction in Reverberant Environments Using the Transfer-Function GSC," 2007 IEEE International Conference on Acoustics, Speech and Signal Processing, Apr. 2007, 4 pp.
Ristimaki, Distributed Microphone Array System for Two-Way Audio Communication, Helsinki Univ. of Technology, Master's Thesis, Jun. 15, 2009, 73 pgs.
Rombouts et al., An Integrated Approach to Acoustic Noise and Echo Cancellation, Signal Processing 85, 2005, pp. 849-871.
Sällberg, "Faster Subband Signal Processing," IEEE Signal Processing Magazine, vol. 30, No. 5, Sep. 2013, 6 pp.

(56) References Cited

OTHER PUBLICATIONS

Sasaki et al., A Predefined Command Recognition System Using a Ceiling Microphone Array in Noisy Housing Environments, 2008 IEEE/RSJ International Conference on Intelligent Robots and Systems, Sep. 2008, pp. 2178-2184.
Sennheiser, New microphone solutions for ceiling and desk installation, https://en-us.sennheiser.com/news-new-microphone-solutions-for-ceiling-and-desk-installation, Feb. 2011, 2 pgs.
Sennheiser, TeamConnect Ceiling, https://en-us.sennheiser.com/conference-meeting-rooms-teamconnect-ceiling, 2017, 7 pgs.
SerDes, Wikipedia article, last edited on Jun. 25, 2018; retrieved on Jun. 27, 2018, 3 pp., https://en.wikipedia.org/wiki/SerDes.
Sessler, et al., "Directional Transducers," IEEE Transactions on Audio and Electroacoustics, vol. AU-19, No. 1, Mar. 1971, pp. 19-23.
Sessler, et al., "Toroidal Microphones," Journal of Acoustical Society of America, vol. 46, No. 1, 1969, 10 pp.
Shure AMS Update, vol. 1, No. 1, 1983, 2 pgs.
Shure AMS Update, vol. 1, No. 2, 1983, 2 pgs.
Shure AMS Update, vol. 4, No. 4, 1997, 8 pgs.
Shure Debuts Microflex Advance Ceiling and Table Array Microphones, Press Release, Feb. 9, 2016, 4 pp.
Shure Inc., A910-HCM Hard Ceiling Mount, retrieved from website <http://www.shure.com/en-US/products/accessories/a910hcm> on Jan. 16, 2020, 3 pp.
Shure Inc., Microflex Advance, http://www.shure.com/americas/microflex-advance, 12 pgs.
Shure Inc., MX395 Low Profile Boundary Microphones, 2007, 2 pgs.
Shure Inc., MXA910 Ceiling Array Microphone, http://www.shure.com/americas/products/microphones/microflex-advance/mxa910-ceiling-array-microphone, 7 pgs. 2009-2017.
Shure, MXA910 With IntelliMix, Ceiling Array Microphone, available at <https://www.shure.com/en-US/products/microphones/mxa910>, as early as 2020, 12 pp.
Shure, New MXA910 Variant Now Available, Press Release, Dec. 13, 2019, 5 pp.
Shure, Q&A in Response to Recent US Court Ruling on Shure MXA910, Available at <https://www.shure.com/en-US/meta/legal/q-and-a-inresponse-to-recent-us-court-ruling-on-shure-mxa910-response>, As early as 2020, 5 pp.
Shure, RK244G Replacement Screen and Grille, Datasheet, 2013, 1 p.
Shure, The Microflex Advance MXA310 Table Array Microphone, Available at <https://www.shure.com/en-US/products/microphones/mxa310>, As early as 2020, 12 pp.
Signal Processor MRX7-D Product Specifications, Yamaha Corporation, 2016.
Silverman et al., Performance of Real-Time Source-Location Estimators for a Large-Aperture Microphone Array, IEEE Transactions on Speech and Audio Processing, vol. 13, No. 4, Jul. 2005, pp. 593-606.
Sinha, Ch. 9: Noise and Echo Cancellation, in Speech Processing in Embedded Systems, Springer, 2010, pp. 127-142.
SM 69 Stereo Microphone, Datasheet, Georg Neumann GmbH, Available at <https://ende.neumann.com/product_files/6552/download>, 1 p.
Soda et al., Introducing Multiple Microphone Arrays for Enhancing Smart Home Voice Control, The Institute of Electronics, Information and Communication Engineers, Technical Report of IEICE, Jan. 2013, 6 pgs.
Soundweb London Application Guides, BSS Audio, 2010.
Symetrix, Inc., SymNet Network Audio Solutions Brochure, 2008, 32 pgs.
SymNet Network Audio Solutions Brochure, Symetrix, Inc., 2008.
Tan, et al., "Pitch Detection Algorithm: Autocorrelation Method and AMDF," Department of Computer Engineering, Prince of Songkhla University, Jan. 2003, 6 pp.
Tandon, et al., "An Efficient, Low-Complexity, Normalized LMS Algorithm for Echo Cancellation," 2nd Annual IEEE Northeast Workshop on Circuits and Systems, Jun. 2004, pp. 161-164.
Tetelbaum et al., Design and Implementation of a Conference Phone Based on Microphone Array Technology, Proc. Global Signal Processing Conference and Expo (GSPx), Sep. 2004, 6 pgs.
Tiete et al., SoundCompass: A Distributed MEMS Microphone Array-Based Sensor for Sound Source Localization, Sensors, Jan. 23, 2014, pp. 1918-1949.
TOA Corp., Ceiling Mount Microphone AN-9001 Operating Instructions, http://www.toaelectronics.com/media/an9001_mt1e.pdf, 1 pg.
Togami, et al., "Subband Beamformer Combined with Time-Frequency ICA for Extraction of Target Source Under Reverberant Environments," 17th European Signal Processing Conference, Aug. 2009, 5 pp.
U.S. Appl. No. 16/598,918, filed Oct. 10, 2019, 50 pp.
Van Compernolle, Switching Adaptive Filters for Enhancing Noisy and Reverberant Speech from Microphone Array Recordings, Proc. IEEE Int. Conf. on Acoustics, Speech, and Signal Processing, Apr. 1990, pp. 833-836.
Van Trees, Optimum Array Processing: Part IV of Detection, Estimation, and Modulation Theory, 2002, 54 pgs., pp. i-xxv, 90-95, 201-230.
Van Veen et al., Beamforming: A Versatile Approach to Spatial Filtering, IEEE ASSP Magazine, vol. 5, issue 2, Apr. 1988, pp. 4-24.
Vicente, "Adaptive Array Signal Processing Using the Concentric Ring Array and the Spherical Array," Ph.D. Dissertation, University of Missouri, May 2009, 226 pp.
Wang et al., Combining Superdirective Beamforming and Frequency-Domain Blind Source Separation for Highly Reverberant Signals, EURASIP Journal on Audio, Speech, and Music Processing, vol. 2010, pp. 1-13.
Warsitz, et al., "Blind Acoustic Beamforming Based on Generalized Eigenvalue Decomposition," IEEE Transactions on Audio, Speech and Language Processing, vol. 15, No. 5, 2007, 11 pp.
Weinstein, et al., "Loud: A 1020-Node Microphone Array and Acoustic Beamformer," 14th International Congress on Sound & Vibration, Jul. 2007, 8 pgs.
Weinstein, et al., "Loud: A1020-Node Modular Microphone Array and Beamformer for Intelligent Computing Spaces," MIT Computer Science and Artifical Intelligence Laboratory, 2004, 18 pp.
Wung, "A System Approach to Multi-Channel Acoustic Echo Cancellation and Residual Echo Suppression for Robust Hands-Free Teleconferencing," Georgia Institute of Technology, May 2015, 167 pp.
XAP Audio Conferencing Brochure, ClearOne Communications, Inc., 2002.
Yamaha Corp., MRX7-D Signal Processor Product Specifications, 2016, 12 pgs.
Yamaha Corp., PJP-100H IP Audio Conference System Owner's Manual, Sep. 2006, 59 pgs.
Yamaha Corp., PJP-EC200 Conference Echo Canceller Brochure, Oct. 2009, 2 pgs.
Yan et al., Convex Optimization Based Time-Domain Broadband Beamforming with Sidelobe Control, Journal of the Acoustical Society of America, vol. 121, No. 1, Jan. 2007, pp. 46-49.
Yensen et al., Synthetic Stereo Acoustic Echo Cancellation Structure with Microphone Array Beamforming for VOIP Conferences, 2000 IEEE International Conference on Acoustics, Speech, and Signal Processing, Jun. 2000, pp. 817-820.
Yermeche, et al., "Real-Time DSP Implementation of a Subband Beamforming Algorithm for Dual Microphone Speech Enhancement," 2007 IEEE International Symposium on Circuits and Systems, 4 pp.
Zavarehei, et al., "Interpolation of Lost Speech Segments Using LP-HNM Model with Codebook Post-Processing," IEEE Transactions on Multimedia, vol. 10, No. 3, Apr. 2008, 10 pp.
Zhang, et al., "F-T-LSTM based Complex Network for Joint Acoustic Echo Cancellation and Speech Enhancement," Audio, Speech and Language Processing Group, Jun. 2021, 5 pp.

(56) References Cited

OTHER PUBLICATIONS

Zhang, et al., "Multichannel Acoustic Echo Cancelation in Multiparty Spatial Audio Conferencing with Constrained Kalman Filtering," 11th International Workshop on Acoustic Echo and Noise Control, Sep. 14, 2008, 4 pp.
Zhang, et al., "Selective Frequency Invariant Uniform Circular Broadband Beamformer," EURASIP Journal on Advances in Signal Processing, vol. 2010, pp. 1-11.
Zheng, et al., "Experimental Evaluation of a Nested Microphone Array Wth Adaptive Noise Cancellers," IEEE Transactions on Instrumentation and Measurement, vol. 53, No. 3, Jun. 2004, 10 pp.

* cited by examiner

ONE-DIMENSIONAL ARRAY MICROPHONE WITH IMPROVED DIRECTIVITY

CROSS-REFERENCE

This application is a continuation of U.S. patent application Ser. No. 17/000,295, filed on Aug. 22, 2020, which claims priority to U.S. Provisional Application No. 62/891,088, filed on Aug. 23, 2019, the contents of both which are incorporated herein in their entirety.

TECHNICAL FIELD

This application generally relates to an array microphone. In particular, this application relates to a linear array microphone configured to provide improved frequency-dependent directivity.

BACKGROUND

Conferencing environments, such as conference rooms, boardrooms, video conferencing applications, and the like, can involve the use of one or more microphones to capture sound from various audio sources active in the environment. Such audio sources may include in-room human speakers, for example. The captured sound may be disseminated to a local audience in the environment through loudspeakers, and/or to others remote from the environment (such as, e.g., via a telecast and/or webcast, telephony, etc.).

The types of microphones used and their placement in a particular conferencing environment may depend on the locations of the audio sources, physical space requirements, aesthetics, room layout, and/or other considerations. For example, in some environments, the microphones may be placed on a table or lectern near the audio sources. In other environments, the microphones may be mounted overhead to capture the sound from the entire room, for example. In still other environments, the microphones may be mounted to a wall facing towards the audio sources, for example, near a conference table.

Thus, microphones are available in a variety of sizes, form factors, mounting options, and wiring options to suit the needs of a given application. Moreover, the different microphones can be designed to produce different polar response patterns, including, for example, omnidirectional, cardioid, subcardioid, supercardioid, hypercardioid, and bidirectional. The polar pattern chosen for a particular microphone (or microphone cartridge included therein) may depend on, for example, where the audio source is located, the desire to exclude unwanted noises, and/or other considerations.

Traditional microphones (such as, e.g., dynamic, crystal, condenser/capacitor (externally biased and electret), boundary, button, etc.) typically have fixed polar patterns and few manually selectable settings. To capture sound in a conferencing environment, several traditional microphones, or microphone cartridges, are used at once to capture multiple audio sources within the environment (e.g., human speakers seated at different sides of a table). However, traditional microphones tend to capture unwanted audio as well, such as room noise, echoes, and other undesirable audio elements. The capturing of these unwanted noises is exacerbated by the use of many microphones. Moreover, while the use of multiple cartridges also allows various independent polar patterns to be formed, the audio signal processing and circuitry required to achieve the different polar patterns can be complex and time-consuming. In addition, traditional microphones may not uniformly form the desired polar patterns and may not ideally capture sound due to frequency response irregularities, as well as interference and reflections within and between the cartridges.

Array microphones can provide several benefits over traditional microphones. Array microphones are comprised of multiple microphone elements aligned in a specific pattern or geometry (e.g., linear, circular, etc.) to operate as a single microphone device. Array microphones can have different configurations and frequency responses depending on the placement of the microphones relative to each other and the direction of arrival for sound waves. For example, a linear array microphone is comprised of microphone elements situated relatively close together along a single axis. One benefit of array microphones is the ability to provide steerable coverage or pick up patterns, which allows the microphones in the array to focus on desired audio sources and reject unwanted sounds, such as room noise. The ability to steer audio pick up patterns also allows for less precise microphone placement, which enables array microphones to be more forgiving. Moreover, array microphones provide the ability to pick up multiple audio sources with a single array or unit, again due to the ability to steer the pickup patterns. Nonetheless, existing arrays comprised of traditional microphones have certain shortcomings, including a relatively large form factor when compared to traditional microphones, and a fixed overall size that often limits placement options in an environment.

Micro-Electrical-Mechanical-System ("MEMS") microphones, or microphones that have a MEMS element as the core transducer, have become increasingly popular due to their small package size (e.g., allowing for an overall lower profile device) and high performance characteristics (e.g., high signal-to-noise ratio ("SNR"), low power consumption, good sensitivity, etc.). In addition, MEMS microphones are generally easier to assemble and are available at a lower cost than, for example, electret or condenser microphone cartridges found in many existing boundary microphones. However, due to the physical constraints of the MEMS microphone packaging, the polar pattern of a conventional MEMS microphone is inherently omnidirectional, which means the microphone is equally sensitive to sounds coming from any and all directions, regardless of the microphone's orientation. This can be less than ideal for conferencing environments, in particular.

One existing solution for obtaining directionality using MEMS microphones includes placing multiple microphones in an array configuration and applying appropriate beamforming techniques (e.g., signal processing) to produce a desired directional response, or a beam pattern that is more sensitive to sound coming from one or more specific directions than sound coming from other directions. For example, a broadside linear array includes a line of MEMS microphones arranged perpendicular to the preferred direction of sound arrival. A delay and sum beamformer may be used to combine the signals from the various microphone elements so as to achieve a desired pickup pattern. In some broadside arrays, the microphone elements are placed in nested pairs about a central point and may be spaced apart from each by certain predetermined distances in order to cover a variety of frequencies.

Linear or one-dimensional array microphones comprised of MEMS microphones can provide higher performance in a smaller, thinner form factor and with less complexity and cost, for example, as compared to traditional array microphones. Moreover, due to the omni-directionality of the MEMS microphones, such linear arrays typically have arbitrary directivity along the axis of the array. However, such linear arrays also have lobes, or sound pick-up patterns, that are symmetric about the axis of the array with equal sensitivity in all other dimensions, thus resulting in unwanted noise pickup.

Accordingly, there is an opportunity for an array microphone that addresses these concerns. More particularly, there is a need for a thin, low profile, high performing array microphone with improved frequency-dependent directivity, particularly in the audio frequencies that are important for intelligibility, and the ability to reject unwanted sounds and reflections within a given environment, so as to provide full, natural-sounding speech pickup suitable for conferencing applications.

SUMMARY

The invention is intended to solve the above-noted and other problems by providing an array microphone and microphone system that is designed to, among other things, (1) provide a one-dimensional form factor that has added directivity, for most, if not all, frequencies, in dimensions that, conventionally, have equal sensitivity in all directions; (2) achieve the added directivity by placing a row of first microphones along a first axis, and for each first microphone, placing one or more additional microphones along a second axis orthogonal to the first microphone so as to form a plurality of microphone sets, and by configuring each microphone set to cover one or more of the desired octaves for the one-dimensional array microphone; (3) provide an audio output that utilizes a beamforming pattern selected based on a direction of arrival of the sound waves captured by the microphones in the array, the selected beamforming pattern providing increased rear rejection and steering control; and (4) have high performance characteristics suitable for conferencing environments, including consistent directionality at different frequency ranges, high signal-to-noise ratio (SNR), and wideband audio coverage.

For example, one embodiment includes an array microphone comprising a plurality of microphone sets arranged in a linear pattern relative to a first axis and configured to cover a plurality of frequency bands. Each microphone set comprises a first microphone arranged along the first axis and a second microphone arranged along a second axis orthogonal to the first microphone, wherein a distance between adjacent microphones along the first axis is selected from a first group consisting of whole number multiples of a first value, and within each set, a distance between the first and second microphones along the second axis is selected from a second group consisting of whole number multiples of a second value.

Another example embodiment provides a method performed by one or more processors to generate an output signal for an array microphone comprising a plurality of microphones and configured to cover a plurality of frequency bands. The method comprises receiving audio signals from the plurality of microphones, the microphones being arranged in microphone sets configured to form a linear pattern along a first axis and extend orthogonally from the first axis; determining a direction of arrival for the received audio signals; selecting one of a plurality of beamforming patterns based on the direction of arrival; combining the received audio signals in accordance with the selected beamforming pattern to generate a directional output for each microphone set; and aggregating the outputs to generate an overall array output.

Another example embodiment provides a microphone system comprising: an array microphone configured to cover a plurality of frequency bands, the array microphone comprising a plurality of microphones arranged in microphone sets configured to form a linear pattern along a first axis and extend orthogonally from the first axis; a memory configured to store program code for processing audio signals captured by the plurality of microphones and generating an output signal based thereon; and at least one processor in communication with the memory and the array microphone, the at least one processor configured to execute the program code in response to receiving audio signals from the array microphone. The program code is configured to receive audio signals from the plurality of microphones; determine a direction of arrival for the received audio signals; select one of a plurality of beamforming patterns based on the direction of arrival; combine the received audio signals in accordance with the selected beamforming pattern to generate a directional output for each microphone set; and aggregate the outputs to generate an overall array output.

Yet another example embodiment provides a microphone system comprising an array microphone configured to cover a plurality of frequency bands and comprising a plurality of microphones arranged in a linear pattern along a first axis of the array microphone and extending orthogonally from the first axis; and at least one beamformer configured to receive audio signals captured by the plurality of microphones and based thereon, generate an array output with a directional polar pattern that is selected based on a direction of arrival of the audio signals, the directional polar pattern being further configured to reject audio sources from one or more other directions.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
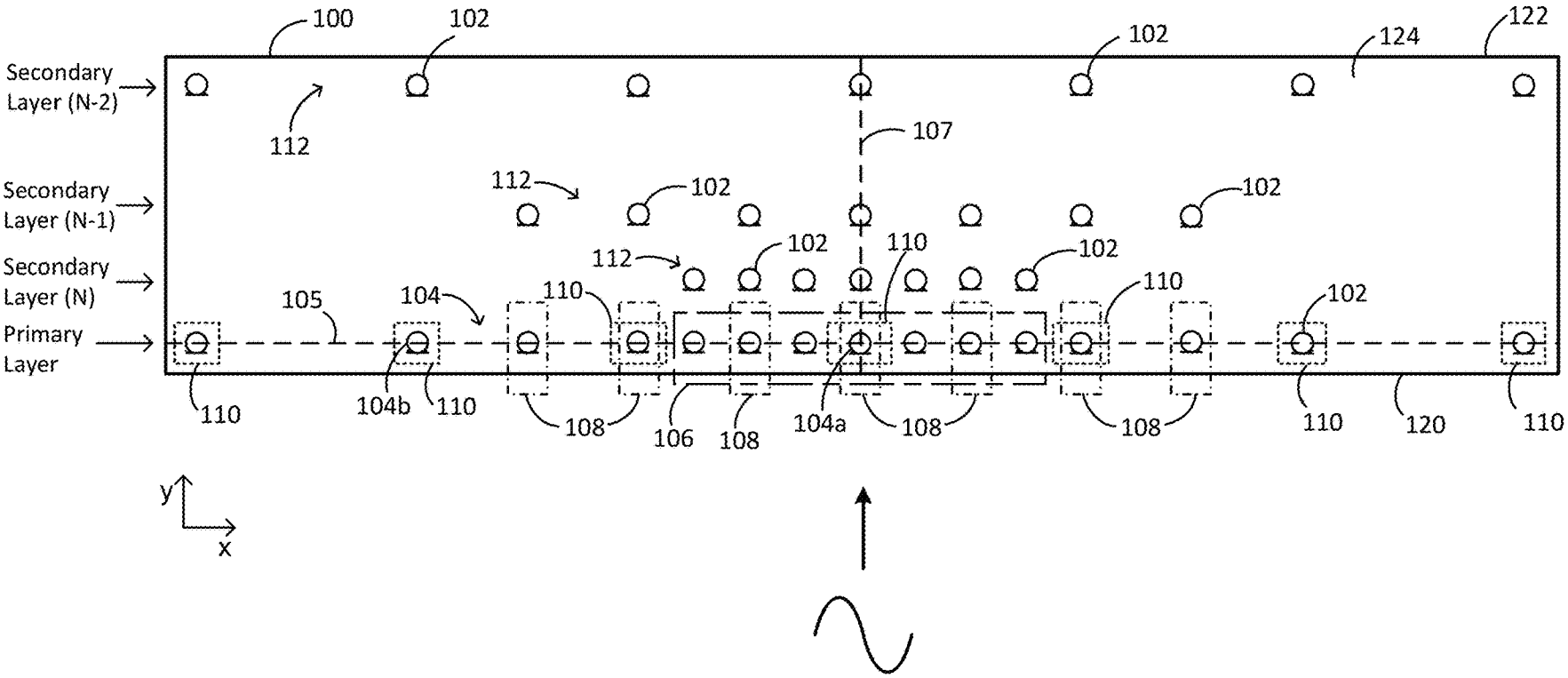
FIG. 1 is a top view of an exemplary one-dimensional array microphone, in accordance with one or more embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

Systems and methods are provided herein for a high performing array microphone with a one-dimensional form factor configured to provide good directivity at various frequencies, including higher frequencies within the audible range, and a high signal-to-noise ratio (SNR). In particular, the array microphone comprises a first plurality of microphones arranged along a first axis to achieve coverage of desired frequency bands or octaves, and a second plurality of microphones arranged orthogonal to the first axis, and the microphones arranged thereon, to achieve directional polar patterns for the covered octaves. Exemplary embodiments include arranging the microphones in multiple sets, each set including a first microphone positioned on the first axis and one or more additional microphones positioned on a second axis that is perpendicular to the first axis and aligned orthogonal to the first microphone. In embodiments, the microphones of each set can be combined to create a narrowed beam pattern normal to the array microphone, or narrowed cardioid polar patterns directed within the dimension of the microphone set, depending on the particular application or environment. In both cases, the array microphone lobes can be directed towards a desired sound source and thus, are better able to reject unwanted sound sources and reflections in the environment. In preferred embodiments, the microphones are MEMS transducers or other omnidirectional microphones.

FIG. 1 illustrates an exemplary array microphone 100 for detecting sounds from one or more audio sources at various frequencies, in accordance with embodiments. The array microphone 100 may be utilized in a conferencing environment, such as, for example, a conference room, a boardroom, or other meeting room where the audio sources may include one or more human speakers. Other sounds may be present in the environment which may be undesirable, such as noise from ventilation systems, other persons, audio/visual equipment, electronic devices, etc. In a typical situation, the audio sources may be seated in chairs at a table, although other configurations and placements of the audio sources are contemplated and possible, including, for example, audio sources that move about the room. The array microphone 100 may be placed on a table, lectern, desktop, ceiling, or other horizontal surface in the conferencing environment, as well as on a wall or other vertical surface, in order to detect and capture sound from the audio sources, such as speech spoken by human speakers.

The array microphone 100 includes a plurality of microphones 102 (also referred to herein as "transducers" and "cartridges") capable of forming multiple pickup patterns in order to optimally or consistently detect and capture sound from the audio sources. The polar patterns that can be formed by the array microphone 100 may depend on the placement of the microphones 102 within the array 100, as well as the type of beamformer(s) used to process the audio signals generated by the microphones 102. For example, a sum and differential beamformer may be used to form a cardioid, subcardioid, supercardioid, hypercardioid, bidirectional, and/or toroidal polar pattern directed to a desired sound source. Additional polar patterns may be created by combining the original polar patterns and steering the combined pattern to any angle along the plane of, for example, the table on which the array microphone 100 rests. Other beamforming techniques may be utilized to combine the outputs of the microphones, so that the overall array microphone 100 achieves a desired frequency response, including, for example, lower noise characteristics, higher microphone sensitivity, and coverage of discrete frequency bands, as described in more detail herein. Although FIG. 1 shows a specific number of microphones, other amounts of microphones 102 (e.g., more or fewer) are possible and contemplated.

In preferred embodiments, each of the microphones 102 may be a MEMS (micro-electrical mechanical system) transducer with an inherent omnidirectional polar pattern. In other embodiments, the microphones 102 may have other polar patterns, may be any other type of omnidirectional microphone, and/or may be condenser microphones, dynamic microphones, piezoelectric microphones, etc. In still other embodiments, the arrangement and/or processing techniques described herein can be applied to other types of arrays comprised of omnidirectional transducers or sensors where directionality is desired (such as, e.g., sonar arrays, radio frequency applications, seismic devices, etc.).

Each of the microphones 102 can detect sound and convert the sound into an audio signal. In some cases, the audio signal can be a digital audio output (e.g., MEMS transducers). For other types of microphones, the audio signal may be an analog audio output, and components of the array microphone 100, such as analog to digital converters, processors, and/or other components, may process the analog audio signals to ultimately generate one or more digital audio output signals. The digital audio output signals may conform to the Dante standard for transmitting audio over Ethernet, in some embodiments, or may conform to another standard. In certain embodiments, one or more pickup patterns may be formed by a processor of the array microphone 100 from the audio signals of the microphones 102, and the processor may generate a digital audio output signal corresponding to each of the pickup patterns. In other embodiments, the microphones 102 may output analog audio signals and other components and devices (e.g., processors, mixers, recorders, amplifiers, etc.) external to the array microphone 100 may process the analog audio signals.

As shown in FIG. 1, the microphones 102 include a first plurality of microphones 104 linearly arranged along a length of the array microphone 100 and perpendicular to a preferred or expected direction of arrival for incoming sound waves. The first plurality of microphones 104 (also referred to herein as "first microphones") are disposed along a common axis of the array microphone 100, such as first axis 105. The first microphones 104 may be arranged in a linear array pattern configured to cover a plurality of frequency bands using one or more beamformers or other audio processing techniques. In particular, the linear pattern can be configured to operate in different octaves (e.g., 600-1200 Hertz (Hz), 1200-2400 Hz, 2400-4800 Hz, etc.) within the covered plurality of frequency bands, so that the overall beam pattern for the array microphone 100 remains essentially constant from octave to octave. For example, the linear pattern may be implemented using a sub-band-based scaled aperture (SSA) approach that uses a different array aperture for each octave, so that progressively lower frequency octaves are processed by progressively wider linear arrays. In order to enhance spatial resolution, the linear array aperture may be doubled when moving from a higher octave to the next lower one.

Figure 2:
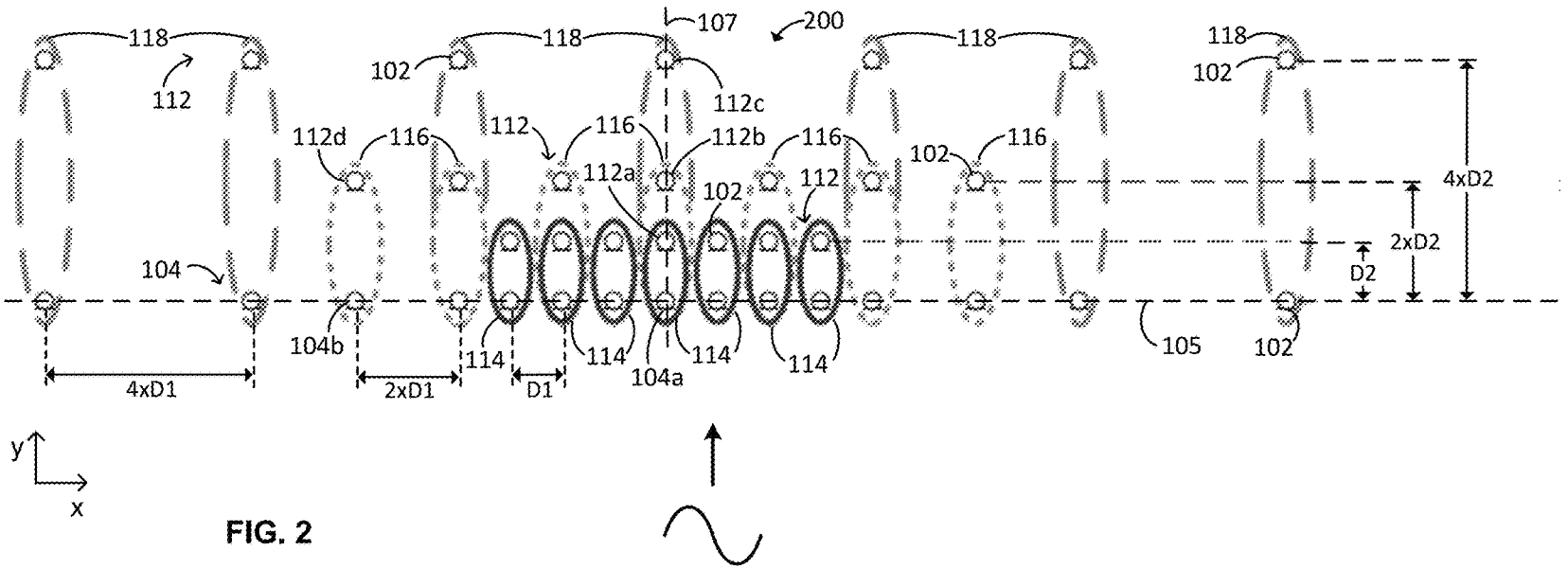
FIG. 2 is a schematic diagram of the microphone array of FIG. 1 showing exemplary microphone pair selections in accordance with a first beamforming pattern, in accordance with embodiments.

For example, referring additionally to FIG. 2, the first microphones 104 may include a first group of microphones 106 that are spaced apart from each other by a first distance, D1, to form a first sub-array configured to cover a first, or Nth, frequency octave. The first microphones 104 also include a second group of microphones 108 that are configured to form a second sub-array for covering a second, or next lower, frequency octave (e.g., (N−1)th octave) by spacing the microphones 108 apart by a second distance that is twice the first distance, D1. Similarly, a third group 110 of the first microphones 104 may be configured to form a third sub-array for covering a third, still lower, octave (e.g., (N−2)th octave) by spacing the microphones 110 apart by a third distance that is twice the second distance, or four times the first distance, D1. In other words, the distance or spacing between the first microphones 104 may be halved for each octave's worth of frequencies, or increased by a factor of 2 for each decreasing octave. As a result, the microphones 106 for covering the highest, or Nth, octave are closest together, or form the smallest aperture size, and the microphones 110 for covering the lowest octave (e.g., (N−2)th octave), and below, are furthest apart, or form the largest aperture size.

In embodiments, the smallest distance value, D1, may be selected based on a desired linear array aperture size for the array microphone 100 and a total number of first microphones 104 being used to form the linear array pattern, as well as the frequency bands that are to be spatially sampled in the array microphone 100. Other design considerations may also determine the D1 value, including, for example, desired locations for the frequency nulls, a desired amount of electrical delay, and criteria for avoiding spatial aliasing. In one example embodiment, the D1 distance is approximately eight millimeters (mm).

In a preferred embodiment, harmonic nesting techniques are used to select the distances between adjacent first microphones 104, such that the linear pattern formed by the sub-arrays 106, 108, and 110 is harmonically nested. As will be understood, arranging the first microphones 104 in harmonically nested sub-arrays (or nests) can be more efficient and economical because one or more of the microphones 104 can be reused as part of multiple sub-arrays, thus reducing the total number of microphones 104 required to cover the octaves of interest for the array microphone 100. For example, because the second and third sub-arrays 108 and 110 are placed at different double multiples (e.g., 2 and 4, respectively) of the distance D1 between the microphones 104 in the first sub-array 106, the first sub-array 106 can be nested within the second and third sub-arrays 108 and 110, and the second sub-array 108 can be nested within the third sub-array 110. As a result, some of the first microphones 104 can be reused for multiple nests. In particular, as shown in FIG. 2, at least three of the microphones 104 in the first nest 106 also form part of the second nest 108, and at least three of the microphones 104 from the second nest 108 also form part of the third nest 110.

As depicted in FIG. 1, the plurality of microphones 102 further includes a second plurality of microphones 112 (also referred to herein as "second microphones" or "additional microphones") arranged orthogonal to the first microphones 104 for added directivity at the various frequencies or octaves of interest. In particular, each second microphone 112 is added to the array 100 to duplicate one of the first microphones 104 in terms of placement relative to the first axis 105, but is disposed on a different axis that is orthogonal to the corresponding first microphone 104 and perpendicular to the first axis 105, such as, e.g., second axis 107 or another axis parallel thereto (also referred to herein as an "orthogonal axis"). As shown in FIG. 1, the first axis 105 passes through, or intersects with, the second axis 107 at a central point (or midpoint) of the first axis 105.

Figure 13:
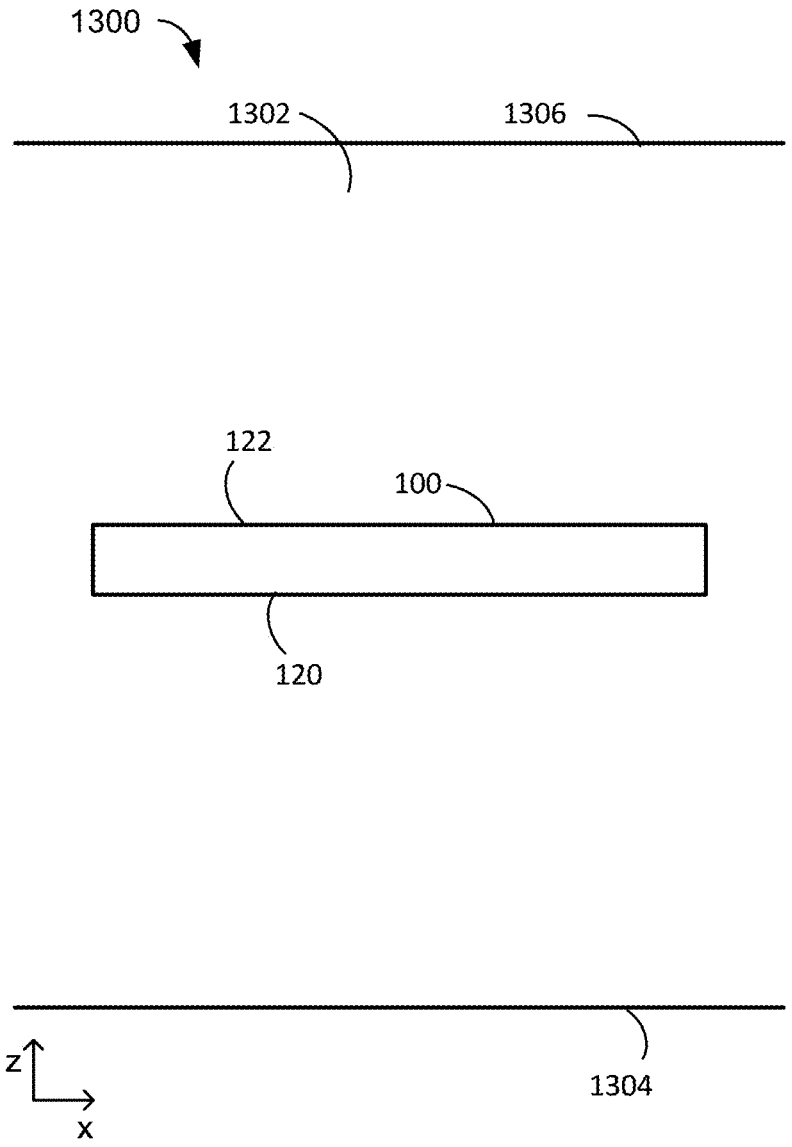
FIG. 13 is a front view of the array microphone of FIG. 1 mounted to a vertical wall within a conferencing environment, in accordance with embodiments.

In some embodiments, the first axis 105 coincides with an x-axis of the array microphone 100, and the second axis 107 coincides with a y-axis of the array microphone 100, such that the array microphone 100 lies in the x-y plane, as shown in FIG. 1. For example, when the array microphone 100 is placed on a table or other horizontal surface, the microphones 102 may be planarly arranged relative to the table, or in a first plane that is parallel to a top plane of the table. In other embodiments, the second axis 107 may be another one of the orthogonal axes of the array microphone 100, such as, e.g., the z-axis, depending on the orientation of the microphone 100. For example, when the array microphone 100 is placed on a wall or other vertical surface, the microphones 102 may be planarly arranged relative to the wall, or in a second plane that is parallel to a front plane of the wall, as shown in FIG. 13. In still other embodiments, the array microphone can be suspended in free space. In such cases, the orientation can take on either of the previous orientations, depending on the desired acoustic effect and room configuration.

In embodiments, each second microphone 112 and the first microphone 104 being duplicated thereby jointly form a microphone set, or pair, that is configured to operate in a frequency octave covered by the duplicated microphone 104. For example, in each microphone set, a spacing or distance between the first microphone 104 and the corresponding second microphone 112 along the orthogonal axis can be selected based on the frequency octave covered by that set. Moreover, the first and second microphones 104 and 112 of each microphone set may be treated or handled as a single microphone "element" or unit of the array microphone 100 by acoustically combining the microphones 104 and 112 to create a new pickup pattern for that microphone set (e.g., using appropriate beamforming techniques). In some embodiments, various microphone sets can be further grouped together as sub-arrays to produce one or more combined outputs for the array microphone 100. As an example, all of the microphone sets configured to cover the first octave (e.g., N) can be combined or aggregated to create a sub-array for operating in that octave (e.g., using appropriate beamforming techniques). Each of the various sub-arrays may be further aggregated to create an overall output for the array microphone 100 that has an essentially constant beamwidth, for example.

As an example, FIG. 2 illustrates a plurality of microphone sets 114, 116, and 118 formed from the first and second microphones 104 and 112 of the array microphone 100, in accordance with embodiments. A first group of microphone sets 114 includes the first microphones 104 from the first nest 106 for covering the first, or Nth, octave and the second microphones 112 added to duplicate the first nest 106. In the microphone sets 114, each second microphone 112 is disposed a first distance, D2, from the corresponding first microphone 104. A second group of microphone sets 116 includes the first microphones 104 from the second nest 108 for covering the second, or (N−1)th, octave and the second microphones 112 added to duplicate the second nest 108. In the microphone sets 116, each second microphone 112 is disposed a second distance that is twice the first distance, D2, from the corresponding first microphone 104. The array microphone 100 may further include a third group of microphone sets 118 comprising the first microphones 104 from the third nest 110 for covering the third, or (N−2)th, octave and the second microphones 112 added to duplicate the third nest 110. In the microphone sets 118, each second microphone 112 is disposed a third distance that is four times the first distance, D2, from the corresponding first microphone 104.

Thus, like the distances between adjacent first microphones 104 along the first axis 105, the distance between the microphones 104 and 112 of a given microphone set are halved with each octave's worth of frequencies, or increased by double multiples (i.e. a factor of 2) with each decreasing octave. In embodiments, the distance D2 between the microphones 104 and 112 in the first plurality of microphone sets 114 may be equal to a half wavelength of a desired frequency from the octave covered by the sets 114 (i.e. the Nth octave), for example, to create nulls at the desired frequency. The distance D2 may also be selected to optimize cardioid formation when combining the microphones 104 and 112 of a given microphone set to produce a combined output, as described below. In one example embodiment, the D2 distance is approximately 16 mm.

As shown in FIG. 2, a number of the microphone sets may include the same first microphone 104 and therefore, may be located on the same orthogonal axis. This arrangement is due, at least in part, to the harmonic nesting of the first microphones 104 along the first axis 105 and the coverage of multiple octaves by several of the first microphones 104. More specifically, each first microphone 104 that is configured to cover a number of frequency octaves may be duplicated by an equal number of second microphones 112 disposed at appropriate (e.g., (frequency-dependent) distances along the same orthogonal axis, thus creating co-located microphone sets. In other words, the total number of second microphones 112 that may be located on the same orthogonal axis depends on the number of octaves covered by the first microphone 104 of that set. As an example, in FIG. 1, a first microphone 104*a* is included in all three of the nests 106, 108, and 110 and therefore, is used to cover all three octaves (e.g., N, N−1, and N−2). Accordingly, in FIG. 2, the first microphone 104*a* is paired with three different second microphones 112*a*, 112*b*, and 112*c* in order to provide coverage for each of the three octaves. Conversely, in FIG. 1, a first microphone 104*b* is included in just one nest 110 and therefore, is used to cover one octave (e.g., N−1). As a result, in FIG. 2, the first microphone 104*b* is paired with only one second microphone 112*d*.

In embodiments, the plurality of microphone sets formed by the microphones 102 are arranged orthogonal relative to the first axis 105 in order to maintain the linear array pattern created by the first microphones 104 along the first axis 105. More specifically, the first microphones 104 may constitute a primary, or top, layer of the array microphone 100, and the additional or second microphones 112 may be disposed in the array 100 so as to form multiple secondary, or lower, layers that are arranged orthogonal to, or spatially behind, the primary layer. This layered arrangement of the microphones 102 allows the array microphone 100 to have a thin, narrow form factor similar to that of a one-dimensional or linear array microphone. For example, an overall length and width of a front face 120 of the array microphone 100 may be largely determined by the dimensions of the primary layer, or more specifically, the aperture size and other physical characteristics of each first microphone 104, as well as the amount of space (e.g., D1 or a whole number multiple thereof) between adjacent microphones 104 within the primary layer. In some cases, the front face 120 may coincide with, or constitute, an overall aperture of the array microphone 100.

An overall depth of the array microphone 100, or the distance between the front face 120 and a rear face 122 of the array 100 (e.g., along the y-axis), may be determined by the number of secondary layers included in the array microphone 100 and the spacing between each layer. The exact number of secondary layers included in the array 100 may depend on the total number of octaves to be covered by the array microphone 100, which in turn may determine the distances between each layer, as described herein. In some cases, the number of secondary layers, or covered octaves, may be determined by physical limitations on a device housing for the array microphone 100 (e.g., a maximum depth of the housing). In the illustrated embodiment, the overall depth of the array microphone 100 may be determined by the distance between the primary layer and the last secondary layer (e.g., four times distance D2) because the other secondary layers are nested within the space between the first and last layers. In some embodiments, harmonic nesting techniques are used to select the distances between the primary layer and each of the secondary layers. While the illustrated embodiment shows three secondary layers configured to provide added directivity for three different octaves (e.g., N, N−1, and N−2), other embodiments may include more layers to cover more octaves, thus increasing the depth of the array 100, or fewer layers to cover fewer octaves, thus decreasing the array depth.

The array microphone 100 may further include one or more supports 124 (such as, e.g., a substrate, printed circuit board (PCB), frame, etc.) for supporting the microphones 102 within the housing of the array microphone 100. In embodiments, each of the microphones 102 may be mechanically and/or electrically coupled to at least one of the support(s) 124. In some cases, each layer of the microphones 102 may be disposed on an individual support 124, and the various supports 124 may be stacked side by side within the microphone housing (e.g., in the y-axis direction). In the case of a PCB support 124, the microphones 102 may be MEMS transducers that are electrically coupled to one or more PCBs, and each PCB may be electrically coupled to one or more processors or other electronic device for receiving and processing audio signals captured by the microphones 102. The support(s) 124 may have any appropriate size or shape. In some cases, the support(s) 124 may be sized and shaped to meet the constraints of a pre-existing device housing and/or to achieve desired performance characteristics (e.g., select operating bands, high SNR, etc.). For example, a maximum width and/or length of the support 124 may be determined by the overall height and/or length of a device housing for the array 100.

In general, the array microphone 100 shown in FIGS. 1 and 2 may be configured for broadside usage, or to preferably pick-up sounds arriving generally perpendicular to the front microphones 104 and ignore or isolate sounds from the other directions. According to embodiments, the array microphone 100 can be configured to generate sound beams (or main lobe) directed towards either of the broadside directions, so as to capture sounds arriving broadside at zero degrees relative to the front microphones 104, or broadside at 180 degrees relative to the front microphones 104. That is, the array microphone 100 may be agnostic to the direction of arrival within the x-y plane. When the sound source is located at 180 degrees broadside, the roles of the microphones 102 may be flipped. For example, the primary layer, or first microphones 104, may serve as a secondary layer and one of the secondary layers of additional microphones 112 (e.g., layer N in FIG. 1) may serve as the primary layer. In this manner, the array microphone 100 can be configured to generate a directional polar pattern towards either broadside direction of arrival and isolate sounds coming from all other directions.

In addition, appropriate beamforming techniques may be used to steer the sound beams formed by the individual microphone pairs (e.g., microphone sets 114, 116, and 118) towards a desired audio source that is not located broadside. For example, a linear delay and sum beamforming approach may be used to add a certain amount of delay to the audio signals for each microphone set, the delay determining a beam-steering angle for that set. The amount of delay may depend on frequency, as well as distance between the microphone set and the audio source, for example. Through such frequency-dependent steering, a constant beamwidth may be achieved for the array microphone 100 over a wide range of frequencies.

In embodiments, the array microphone 100 may be agnostic to the direction of arrival within the x-y plane for non-broadside or oblique angle conditions as well. For example, the array microphone 100 can capture sounds arriving at a first oblique angle relative to the front face 120, as well as sounds arriving at an equal but opposite angle relative to the rear face 122, or 180 degrees greater than the first oblique angle relative to the front face 120 of the array microphone. In such cases, the primary and secondary layers of microphones may be flipped or interchanged in the same manner as described herein for the broadside conditions.

In embodiments, due to the unique geometry or layout of the microphones 102 in the array 100, the first microphones 104 and the second microphones 112 can be paired in more than one way to create microphone sets for covering the same desired octaves. A specific pattern or arrangement of the microphone pairs may be selected for the array microphone 100 depending on a preferred direction of arrival for the sound waves. In particular, the plurality of microphone sets may be formed according to one or more beamforming patterns for broadside usage of the array microphone 100 when the direction of arrival for sound waves is perpendicular to the first microphones 104 or the front face 120 of the array microphone 100. Alternatively, the plurality of microphone sets may be formed according to one or more beamforming patterns for oblique angle usage of the array microphone 100 when the direction of arrival for sound waves is at an angle relative to the front face 120 of the array microphone 100.

For example, FIG. 2 shows a first broadside beamforming pattern 200 configured for a direction of arrival that is perpendicular to the front microphones 104 and at zero degrees relative to the front face 120 of the array microphone 100. In embodiments, a second broadside beamforming pattern (not shown) may be used when the direction of arrival for the sound waves is perpendicular to the front microphones 104 but approaching at 180 degrees relative to the front face 120 of the array microphone 100. The second broadside beamforming pattern may be the same as the beamforming pattern 200 shown in FIG. 2, except that the primary layer of microphones 104 switches roles with one of the secondary layers of microphones 112, since the sound waves will reach the second microphones 112 before reaching the first microphones 104.

Figure 3:
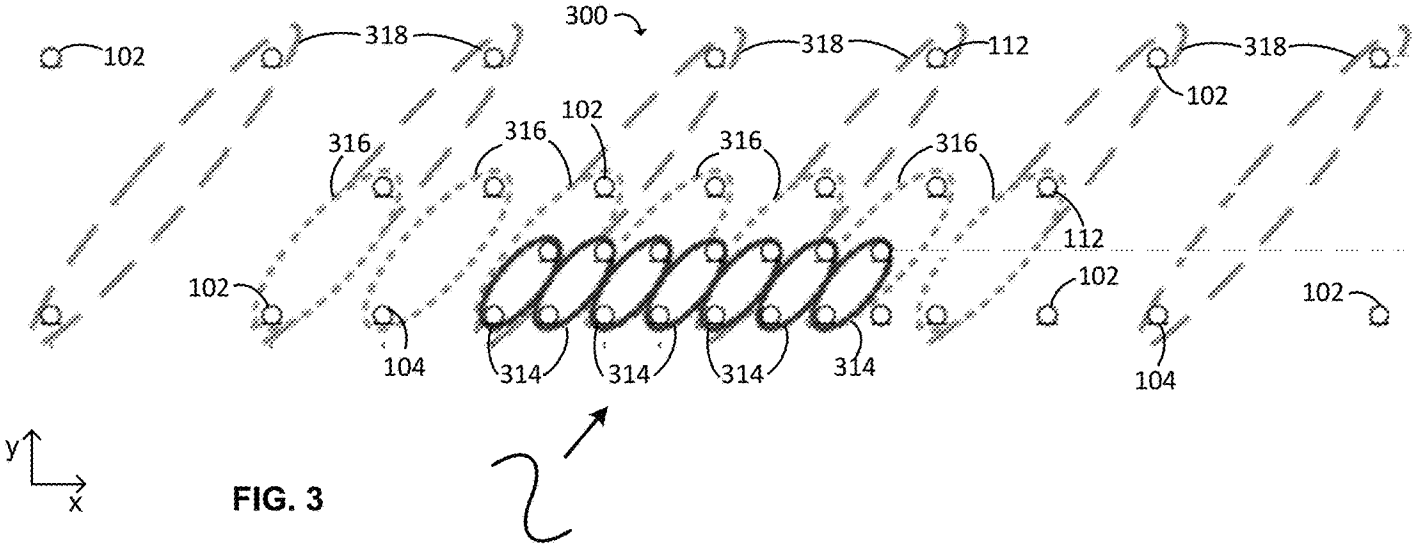
FIG. 3 is a schematic diagram of the microphone array of FIG. 1 showing exemplary microphone pair selections in accordance with a second beamforming pattern, in accordance with embodiments.

FIG. 3 depicts a first oblique angle beamforming pattern 300 configured for a direction of arrival that is greater than 30 degrees relative to the first axis 105 (such as, e.g., 45 degrees). The beamforming pattern 300 includes a first plurality of microphone sets 314 configured for coverage of the first, or Nth, octave, similar to the first plurality of sets 114 in FIG. 2, a second plurality of microphone sets 316 configured for coverage of the second, or (N−1)th, octave, similar to the second plurality of sets 116 in FIG. 2, and a third plurality of microphone sets 318 configured for coverage of the third, or (N−2)th octave, similar to the third plurality of sets 118 in FIG. 2. Each of the microphone sets in the pattern 300 comprises the same first microphone 104 as the corresponding microphone set in the first beamforming pattern 200, but a different second microphone 112. In particular, for each set, the first microphone 104 is now paired with the second microphone 112 that is positioned approximately 45 degrees from the first microphone 104 (or diagonally to the right as shown in FIG. 3), rather than the second microphone 112 that is directly orthogonal to the corresponding first microphone 104 (as in FIG. 2). In embodiments, the same microphone sets are formed when the direction of arrival is opposite that shown in FIG. 4 (i.e. incident on or directed towards the rear face 122), but the second microphone 112 and the first microphone 104 are interchanged in terms of functionality.

Figure 4:
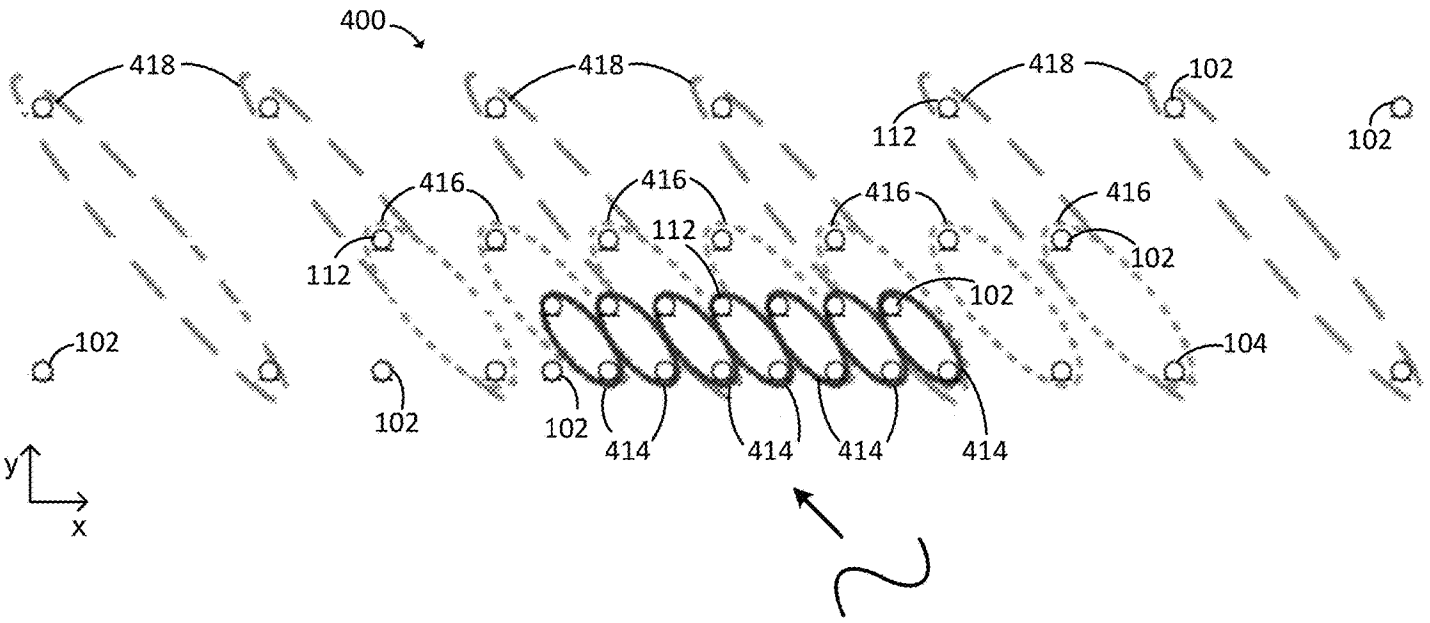
FIG. 4 is a schematic diagram of the microphone array of FIG. 1 showing exemplary microphone pair selections in accordance with a third beamforming pattern, in accordance with embodiments.

FIG. 4 depicts a second oblique beamforming pattern 400 configured for a direction of arrival that is about 90 degrees offset from the direction of arrival shown in FIG. 3, or greater than 120 degrees (such as, e.g., 135 degrees or −45 degrees), relative to the first axis 105. The beamforming pattern 400 includes a first plurality of microphone sets 414 configured for coverage of the first, or Nth, octave, similar to the first plurality of sets 114 in FIG. 2, a second plurality of microphone sets 416 configured for coverage of the second, or (N−1)th, octave, similar to the second plurality of sets 116 in FIG. 2, and a third plurality of microphone sets 418 configured for coverage of the third, or (N−2)th octave, similar to the third plurality of sets 118 in FIG. 2. Like the pattern 300, each of the microphone sets in the pattern 400 comprises the same first microphone 104 as the corresponding microphone set from the first beamforming pattern 200, but a different second microphone 112. In particular, for each set, the first microphone 104 is now paired with the second microphone 112 that is positioned approximately −45 degrees from the first microphone 104 (or diagonally to the left as shown in FIG. 4), rather than the second microphone 112 that is directly orthogonal to the corresponding first microphone 104 (as in FIG. 2). In embodiments, the same microphone sets can be formed when the direction of arrival is opposite that shown in FIG. 3 (i.e. incident on or directed towards the rear face 122), but the second microphone 112 and the first microphone 104 are interchanged in terms of functionality.

According to embodiments, the alternative or angled beamforming patterns 300 and 400 enable the array microphone 100 to cover oblique or slanted direction of arrival angles with minimal, or less, steering, for example, as would be required if using the broadside pattern 200. The oblique patterns 300 and 400 also mitigate lobe deformation as the steering angle tends toward that of an endfire array (e.g., 0 or 180 degrees relative to the first axis 105). Moreover, the ability to select a suitable beamforming pattern based on direction of arrival improves the steered directionality of the array microphone 100 without relying on computationally-heavy signal processing, as is required by conventional array microphones. The diagonal or 45-degrees beamforming patterns 300 and 400 shown in FIGS. 3 and 4, respectively, take advantage of the specific geometry of the array microphone 100, which has a symmetrical, grid-like pattern created by the layered or orthogonal arrangement of the microphones 102 and by the harmonically-nested configurations of the additional layers relative to the primary layer and of the first microphones 104 relative to each other within the primary layer. Other embodiments may include oblique beamforming patterns configured for different direction of arrival angles, for example, depending on the specific values selected for the first distance D1 between the first microphones 104 and/or the second distance D2 between the primary layer and the first secondary layer.

In the illustrated embodiment, the first broadside pattern 200 places each of the microphones 102 into a microphone set or pair, while each of the oblique patterns 300, 400 excludes one or more of the microphones 102 from the microphone pairings. Moreover, in each pattern 300, 400, the third group of microphone sets 318, 418 includes only six microphone pairs, while the third group of microphone sets 118 in the pattern 200 includes seven microphone pairs. These differences between the patterns 200, 300 and 400 may be due to the specific arrangement and number of microphones 102 in the array microphone 100. In some embodiments, the array microphone 100 may include additional microphones 102 disposed at locations that are designed to increase the number of microphone sets in each of the third groups 318 and 418 from six to seven. For example, in such cases, the array microphone 100 may include an extra second microphone 112 in the third secondary layer and/or an extra first microphone 104 in the primary layer in order to create seventh pairings for one or both of the oblique patterns 300 and 400.

Figure 5:
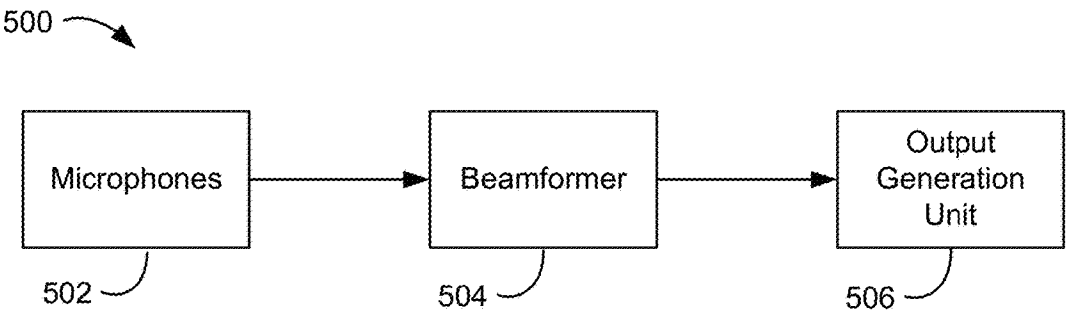
FIG. 5 is a block diagram of a microphone system comprising the one-dimensional array microphone of FIG. 1, in accordance with embodiments.

FIG. 5 illustrates an exemplary microphone system 500, in accordance with embodiments. The microphone system 500 comprises a plurality of microphones 502 similar to the microphones 102, a beamformer 504, and an output generation unit 506. Various components of the microphone system 500 may be implemented using software executable by one or more computers, such as a computing device with a processor and memory, and/or by hardware (e.g., discrete logic circuits, application specific integrated circuits (ASIC), programmable gate arrays (PGA), field programmable gate arrays (FPGA), etc.). For example, some or all components of the beamformer 504 may be implemented using discrete circuitry devices and/or using one or more processors (e.g., audio processor and/or digital signal processor) (not shown) executing program code stored in a memory (not shown), the program code being configured to carry out one or more processes or operations described herein, such as, for example, method 900 shown in FIG. 9. Thus, in embodiments, the system 500 may include one or more processors, memory devices, computing devices, and/or other hardware components not shown in FIG. 5. In a preferred embodiment, the system 500 includes at least two separate processors, one for consolidating and formatting all of the microphone elements and another for implementing DSP functionality.

The microphones 502 may include the microphones 102 of the array microphone 100 shown in FIG. 1, or other microphone designed in accordance with the techniques described herein. The beamformer 504 may be in communication with the microphones 502 and may be used to apply appropriate beamforming techniques to the audio signals captured by the microphone elements 502 to create a desired pickup pattern, such as, e.g., a first order polar-pattern (e.g., cardioid, super-cardioid, hypercardioid, etc.), and/or steer the pattern to a desired angle to obtain directionality. For example, in some embodiments, the beamformer 504 may be configured to combine the microphones 502 to form a plurality of microphone pairs, combine the pairs to form a plurality of sub-arrays, and combine the sub-arrays to create a linear or one-dimensional array output with a directional polar pattern, such as, e.g., a cardioid pickup pattern. The output generation unit 506 may be in communication with the beamformer 504 and may be used to process the output signals received from the beamformer 504 for output generation via, for example, loudspeaker, telecast, etc.

Figure 6:
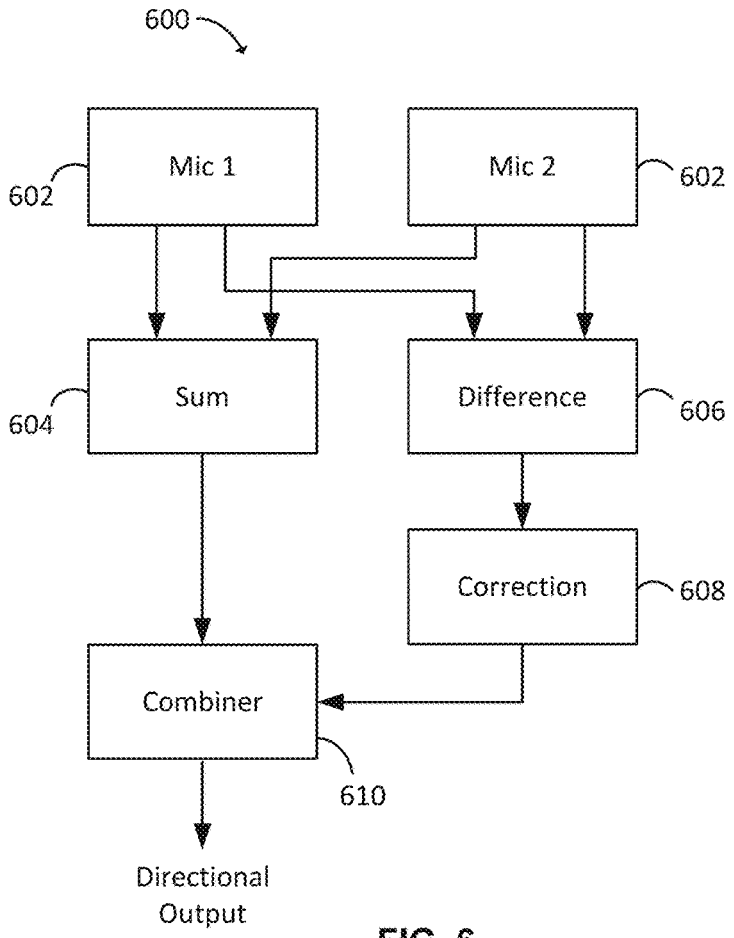
FIG. 6 is a block diagram of a sum and difference beamformer included in the microphone system of FIG. 5, in accordance with embodiments.
Figure 8:
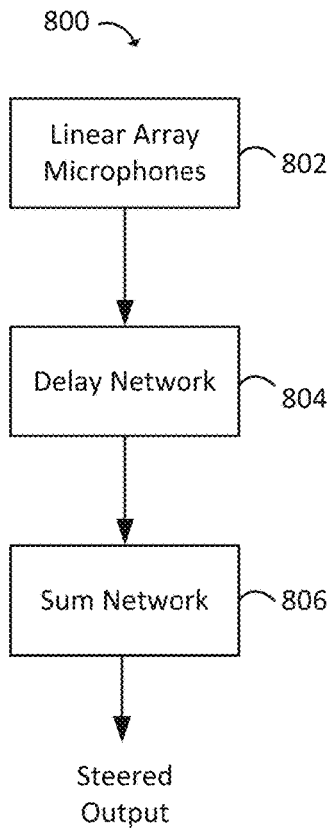
FIG. 8 is a block diagram of a linear delay and sum beamformer included in the microphone system of FIG. 5, in accordance with embodiments.
Figure 7:
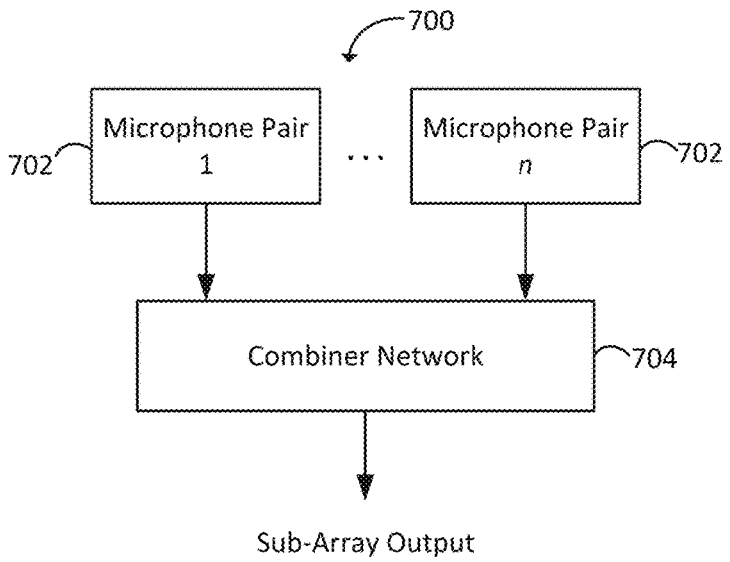
FIG. 7 is a block diagram of an aggregation beamformer included in the microphone system of FIG. 5, in accordance with embodiments.

In embodiments, the beamformer 504 may include one or more components to facilitate processing of the audio signals received from the microphones 502, such as, e.g., sum and difference cardioid formation beamformer 600 of FIG. 6, sub-array combining beamformer 700 of FIG. 7, and/or linear delay and sum steering beamformer 800 of FIG. 8. In some cases, the various beamformers 600, 700, and/or 800 may be in communication with each other in order to generate an output for the overall array microphone. In some cases, the beamformer 504 includes multiple instances of a given beamformer 600, 700, or 800. Other beamforming techniques or combinations thereof may also be performed by the beamformer 504 to provide a desired output.

Referring now to FIG. 6, sum and difference beamformer 600 may be configured to combine audio signals captured by a given set or pair of microphones 602 and generate a combined output signal for said microphone pair that has a directional polar pattern, in accordance with embodiments. More specifically, beamformer 600 may be configured to use appropriate sum and difference techniques on each set of first and second microphones 602 arranged orthogonally to a first axis, or front face, of an array microphone, such as, e.g., array microphone 100 in FIG. 1, to form cardioid elements with narrowed lobes (or sound pick-up patterns), for example, as compared to the full omni-directional polar pattern of the individual microphones 602. As an example, the first microphone 602 (or Mic 1) may include one of the first microphones 104 disposed along the first axis 105 of the array microphone 100, and the second microphone 602 (or Mic 2) may include the second microphone 112 that is disposed on an orthogonal axis of the array microphone 100 to duplicate said first microphone 104. A spacing or distance between the first and second microphones 602 along said orthogonal axis may be selected based on the frequency octave covered by the first microphone 602.

As shown in FIG. 6, a first audio signal received from the first microphone 602 (e.g., Mic 1) and a second audio signal received from the second microphone 602 (e.g., Mic 2) are provided to a summation component 604 of the beamformer 600, as well as a difference component 606 of the same. The summation component 604 may be configured to calculate a sum of the first and second audio signals (e.g., Mic 1+Mic 2) to generate a combined or summed output for the pair of microphones 602. The difference component 606 may be configured to subtract the second audio signal from the first audio signal (e.g., Mic 1−Mic 2) to generate a differential signal or output for the first and second microphones 602. As an example, the summation component 604 may include one or more adders or other summation elements, and the difference component 606 may include one or more invert-and-sum elements.

As also shown, beamformer 600 further includes a correction component 608 for correcting the differential output generated by the difference component 606. The correction component 608 may be configured to correct the differential output for a gradient response caused by the difference calculation. For example, the gradient response may give a 6 dB per octave slope to the frequency response of the microphone pair. In order to generate a first-order polar pattern (e.g., cardioid) for the microphone pair over a broad frequency range, the differential output must be corrected so that it has the same magnitude as the summation output. In a preferred embodiment, the correction component 608 applies a correction value of $(c*d)/(j*\omega)$ to the difference output to obtain a corrected difference output for the microphone pair 602 (e.g., $(\text{Mic } 1-\text{Mic } 2)*((c*d)/(j*\omega))$), where c equals the speed of sound in air at 20 degrees Celsius, d equals the distance between the first and second microphones (e.g., D2 or a whole number multiple thereof), and $\omega$ equals the angular frequency. In some cases, a second magnitude correction may be performed to match the sensitivity of the difference component to that of the summation component.

The beamformer 600 also includes a combiner 610 configured to combine or sum the summed output generated by the summation component 604 and the corrected difference output generated by the correction component 608. The combiner 610 thus generates a combined output signal with directional polar pattern (e.g., cardioid) for the pair of microphones 602, as shown in FIG. 6.

In some embodiments, the beamformer 600 can be configured to receive audio signals from first and second sub-arrays, instead of the individual microphones 602, and combine the first and second sub-array signals using the same sum and difference techniques shown in FIG. 6. For example, the first and second sub-array signals may be summed by the summation component 604 and also provided to the difference component 606 and the correction component 608 to calculate a corrected difference for the same. The resulting summed output and corrected difference output may be summed or combined together to generate a directional output for the pair of sub-arrays.

In one embodiment, the first sub-array may be a sub-array formed by combining the first microphones 104 within the primary layer of the array microphone 100 that are configured to cover a given frequency octave. Likewise, the second sub-array may be formed by combining the second microphones 112 that are disposed in one of the additional layers of the array 100 to duplicate the microphones 104 of the first sub-array and cover the same frequency octave. In such cases, the combined, directional output generated by the beamformer 600 may be specific to the frequency octave covered by the first and second sub-arrays. Other combinations of the microphones 102 to generate the first and second sub-arrays are also contemplated.

The first and second sub-array signals may be obtained by combining the audio signals captured by the microphones within each sub-array. The exact beamforming technique used to combine these microphone signals may vary depending on how the corresponding sub-array is formed, or how the microphones are arranged within that sub-array (e.g., linear array, orthogonal array, broadside array, endfire array, etc.). For example, audio signals received from microphones arranged in a linear or broadside array may be summed together to generate the sub-array signal. In some cases, the beamformer 600 may be in communication with one or more other beamformers in order to receive the first and second sub-array signals. For example, a separate beamformer may be coupled to the microphones of a given sub-array in order to combine the audio signals received from said microphones and generate a combined output signal for that sub-array.

Referring now to FIG. 7, sub-array beamformer 700 may be configured to combine the outputs for a given number, n, of microphone pairs 702 (e.g., Mic Pair 1 to Mic Pair n) and generate a combined output signal for the sub-array formed by said microphone pairs 702, in accordance with embodiments. For example, referring to FIG. 2, the microphone pairs 702 may be the plurality of microphone sets that form the first group or sub-array 114 for covering the first octave (e.g., Nth octave), the plurality of microphone sets that form the second group or sub-array 116 for covering the second octave (e.g., (N−1)th octave), or the plurality of microphone sets that form the third group or sub-array 118 for covering the third octave (e.g., (N−2)th octave). Other combinations of microphone pairs 702 are also contemplated.

As shown, the beamformer 700 may receive a combined audio signal for each microphone pair 702 and may provide said signals to a combiner network 704 of the beamformer 700. The combiner network 704 may be configured to combine or sum the received signals to generate a combined sub-array output for the microphone pairs 702. In embodiments, the combiner network 704 may include a plurality of adders or other summation elements capable of summing the various audio signals together.

In some embodiments, the beamformer 700 may be in communication with a plurality of other beamformers, such as, e.g., beamformers 600 shown in FIG. 6, in order to receive a combined audio signal for each microphone pair 702. For example, the beamformer 600 may be used to combine the audio signals produced by the first and second microphones 602 (e.g., Mic 1 and Mic 2) and generate a combined output with cardioid formation for said pair of microphones 602. The combined, cardioid output of the beamformer 600 may be provided to the beamformer 700 as the combined audio signal for the first microphone pair 702 (e.g., Mic Pair 1). Similar techniques may be used to provide combined, cardioid outputs to the beamformer 700 for each of the other microphone pairs 702 in the corresponding sub-array. The combiner network 704 can then combine all of the cardioid outputs together to generate a cardioid output for the overall sub-array.

Referring now to FIG. 8, delay and sum beamformer 800 may be configured to steer an overall output of a linear array of microphones 802 towards a desired direction or audio source using appropriate delay and sum techniques, in accordance with embodiments. As shown, the beamformer 800 receives audio signals for the microphones 802 and provides the same to a delay network 804. The delay network 804 may be configured to introduce or add an appropriate delay amount to each of the received audio signals. The delayed signal outputs are then provided to the sum or summation network 806. The summation network 806 combines or aggregates the signals received from the delay network 804 to create a combined output for the overall array that is steered to the desired angle. In embodiments, the delay network 804 may include a plurality of delay elements for applying appropriate delay amounts to respective microphone signals, and the summation network includes a plurality of adders or other summation elements capable of summing the outputs received from the plurality of delay elements.

In embodiments, the microphones 802 may be arranged as a linear or one-dimensional array using techniques described herein, for example, similar to the array microphone 100 shown in FIG. 1. More specifically, the microphones 802 may include a first plurality of microphones (e.g., first microphones 104) that are linearly arranged along a first axis, or front face, of the array microphone, as well as a second plurality of microphones (e.g., second microphones 112) that are arranged orthogonal to the first microphones along one or more different axes perpendicular to the first axis, for example, as shown in FIG. 1. The first and second microphones may form a plurality of microphone sets or pairs that are configured to create a linear pattern relative to the first axis, for example, as shown in FIG. 2. In some cases, the outputs of the microphones 802 in each pair may be combined using appropriate beamforming techniques, such as, e.g., beamformer 600. In such cases, the beamformer 800 may be in communication with one or more beamformers 600 in order to receive a combined audio signal for each of the linearly-arranged microphone pairs. In other embodiments, the beamformer 800 may be in communication with one or more beamformers 700 in order to receive a combined sub-array signal for each of the sub-arrays formed by grouping together the linearly-arranged microphone pairs based on frequency octave coverage (e.g., sub-arrays 114, 116, and 118 in FIG. 2).

The amount of delay introduced by the delay network 804 may be based on a desired steering angle for the overall array, the location of the respective microphone 802 in the linear array and/or relative to an audio source, how the microphones 802 are paired, grouped, or otherwise arranged in the array, and the speed of sound. As an example, if an audio source is located at a first end of the linear array microphone, sound from the audio source would arrive at different times at a first set of microphones 802 disposed at the first end as compared to a second set of microphones 802 disposed at the opposing, second end. In order to time align the audio signals from the first end microphones with the audio signals from the second end microphones for appropriate beamforming, a delay may be added by the delay network 804 to the audio signals from the second end microphones. The amount of delay may be equal to the amount of time it takes sound from the audio source to travel between the first end microphones 802 and the second end microphones 802. In addition to determining the amount of delay, the beamformer 800 may determine which of the microphones 802, or microphone sets, to delay based on the desired steering angle, the locations of the microphones 802 within the array, and the location of the audio source, for example.

Figure 9:
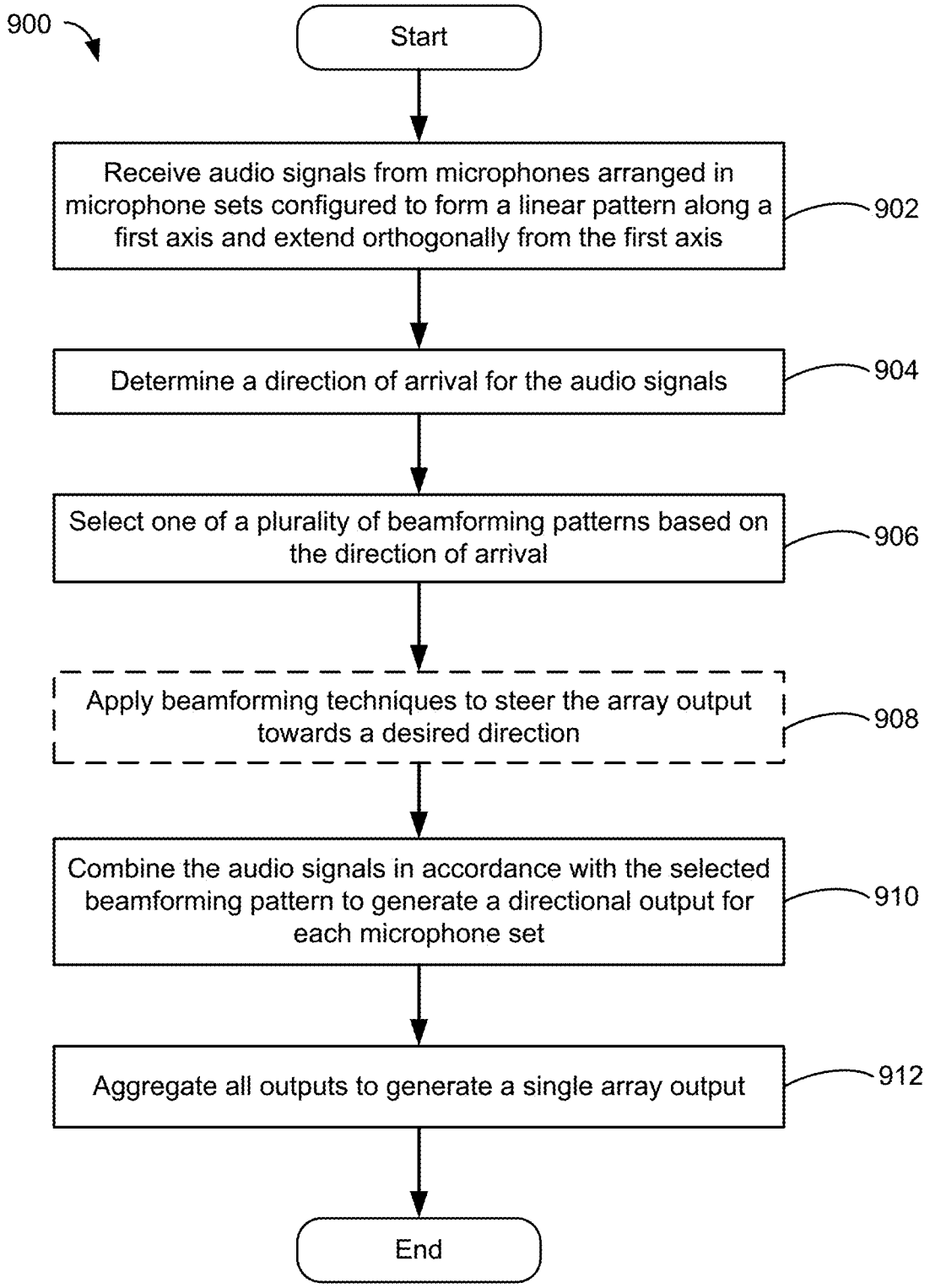
FIG. 9 is a flowchart illustrating an exemplary method for generating a beamformed output signal for a one-dimensional array microphone, in accordance with one or more embodiments.

FIG. 9 illustrates an exemplary method 900 of generating an output signal for an array microphone comprising a plurality of microphones and configured to cover a plurality of frequency bands, in accordance with embodiments. All or portions of the method 900 may be performed by one or more processors (such as, e.g., an audio processor included in the microphone system 500 of FIG. 5) and/or other processing devices (e.g., analog to digital converters, encryption chips, etc.) within or external to the array microphone. In addition, one or more other types of components (e.g., memory, input and/or output devices, transmitters, receivers, buffers, drivers, discrete components, logic circuits, etc.) may also be utilized in conjunction with the processors and/or other processing components to perform any, some, or all of the steps of the method 900. For example, program code stored in a memory of the system 500 may be executed by the audio processor in order to carry out one or more operations of the method 900.

In some embodiments, certain operations of the method 900 may be performed by one or more of the sum-difference cardioid formation beamformer 600 of FIG. 6, the sub-array combining beamformer 700 of FIG. 7, and the linear delay and sum steering beamformer 800 of FIG. 8. The array microphone may be the array microphone 100 described herein and shown in, for example, FIG. 1. The microphones included in the array microphone may be, for example, MEMS transducers which are inherently omnidirectional, other types of omnidirectional microphones, electret or condenser microphones, or other types of omnidirectional transducers or sensors.

Referring back to FIG. 9, the method 900 begins, at block 902, with a beamformer or processor receiving audio signals from a plurality of microphones (e.g., microphones 102 of FIG. 1) arranged in microphone sets configured to form a linear pattern along a first axis (e.g., first axis 105 in FIG. 1) and extend orthogonally from the first axis. More specifically, each microphone set may comprise a first microphone (e.g., one of the first microphones 104 shown in FIG. 1) arranged along the first axis to cover one or more octaves within the plurality of frequency bands covered by the array microphone. Each microphone set may further comprise a second microphone (e.g., one of the second microphones 112 shown in FIG. 1) arranged on a second axis that is orthogonal to the first microphone and perpendicular to the first axis (e.g., second axis 107 in FIG. 1).

In embodiments, each second microphone may be arranged within the array microphone to duplicate one of the first microphones in terms of placement relative to the first axis and frequency coverage. Specifically, each second microphone may be placed at a predetermined distance from the duplicated first microphone (along the orthogonal axis)

that is based on the octave covered by the first microphone. As a result, each microphone set may be configured to cover a particular frequency octave. Harmonic nesting techniques may be used to select the arrangement of the first microphones along the first axis and/or the arrangement of the second microphones relative to the first microphones.

The plurality of microphone sets may be further arranged to form a plurality of sub-arrays. For example, the microphone sets may be grouped together based on frequency octave so that each sub-array covers a different octave (e.g., groups 114, 116, and 118 shown in FIG. 2). In some cases, a number of the microphone sets may be located (or co-located) on the same orthogonal axis because they include a common first microphone but different second microphones. In such cases, the first microphone may be configured to cover multiple octaves, and each of the second microphones may be configured to duplicate only one of those octaves, for example, through selection of an appropriate distance from the first microphone. As a result, the co-located second microphones may belong to different sub-arrays even though they are positioned on the same orthogonal axis.

At block 904, the processor or beamformer determines a direction of arrival for the audio signals received from the plurality of microphones at block 902. The direction of arrival may be measured in degrees, or as an angle relative to the first axis 105 of the array microphone 100. The direction of arrival may be determined using one or more beamforming techniques, such as, for example, cross correlation techniques, inter-element delay calculation, and other suitable techniques.

At block 906, the processor or beamformer selects one of a plurality of beamforming patterns for processing the received audio signals based on the direction of arrival identified at block 904. For example, the plurality of beamforming patterns may include a broadside pattern, such as, e.g., beamforming pattern 200 shown in FIG. 2, and at least one oblique angle pattern, such as, e.g., beamforming pattern 300 shown in FIG. 3 and/or beamforming pattern 400 shown in FIG. 4. The broadside pattern may be selected if the direction of arrival is normal to the first axis of the array microphone, or the audio source is positioned perpendicular to the array microphone. If, on the other hand, the direction of arrival is at an angle relative to the first axis, or the audio source is positioned to one side of the array, an appropriate oblique angle pattern may be selected.

In embodiments, the processor or beamformer may access a database (e.g., look-up table) stored in a memory of the microphone system 500 to determine which pattern to use. The database may store direction of arrival values, or ranges of values, that are associated with each pattern. For example, the first oblique angle pattern 300 may be selected if the direction of arrival is around 45 degrees relative to the first axis, or falls within a preset range around 45 degrees (e.g., 0 degrees to 60 degrees). The second oblique angle pattern 400 may be selected if the direction of arrival is around 135 degrees relative to the first axis, or falls within a preset range around 135 degrees (e.g., 120 degrees to 180 degrees). And the broadside pattern 200 may be selected if the direction of arrival falls within a preset range around 90 degrees (e.g., 61 degrees to 121 degrees). Other suitable techniques for selecting an appropriate beamforming pattern based on a detected direction of arrival may also be used.

In some embodiments, the method 900 continues from block 906 to block 908, where the beamformer or processor applies appropriate beamforming techniques to steer the array output towards a desired direction or audio source. For example, all or portions of the steering process in block 908 may be performed by the linear delay and sum steering beamformer 800 of FIG. 8, or by otherwise using delay and sum techniques to steer the output of the linear array microphone to a desired angle. As shown in FIG. 9, the steering techniques may be performed before combining the received audio signals to achieve a desired directional output using the beamforming pattern selected at block 906.

At block 910, the beamformer or processor combines the received audio signals in accordance with the selected beamforming pattern to generate a directional output for each microphone set. In embodiments, combining the received audio signals includes, for each microphone set, combining the audio signal received from the first microphone with the audio signal received from the second microphone, and using a sum-difference beamforming technique to create the directional output. Accordingly, all or portions of block 910 may be performed by sum-difference beamformer 600 of FIG. 6, or by otherwise applying sum and difference cardioid formation techniques to the audio signals received for each microphone set.

In some embodiments, the microphones in each layer of the array microphone may be first combined according to the covered octave to form one or more in-axis sub-arrays for that layer (e.g., nests 106, 108, and 110 in the primary layer shown in FIG. 1). In such cases, the sum-difference techniques, such as the beamformer 600, may be applied to a pair of sub-arrays, instead of a pair of microphones. For example, the sum-difference beamformer 600 may be used to combine the first sub-array 106 from the primary layer of the array microphone 100 shown in FIG. 1 with the first secondary layer that was added orthogonal to the first axis 105 to duplicate the microphones 104 of the first nest 106. This process may be repeated for each of the remaining secondary layers in the array microphone.

At block 912, the beamformer or processor aggregates all of the beamformed outputs generated at block 910 to provide an overall or single array output for the array microphone. As described herein, the microphones of the array microphone may be arranged into sub-arrays using one or more different techniques. At block 912, the outputs of such sub-arrays, regardless of how they are generated, may be aggregated or combined to generate the overall array output. The method 900 may end once the single array output is provided.

As an example, in embodiments where the microphones are combined into microphone sets at block 910 to improve directionality, at block 912 said microphone sets may be further combined into various sub-arrays based on the frequency octave covered by each set. In such embodiments, all or portions of block 912 may be performed by sub-array combining beamformer 700 of FIG. 7 in order to aggregate the directional outputs for each of the microphone pairs within a given sub-array and generate an overall sub-array output for that sub-array. This process may be repeated for each sub-array, or each octave, of the array microphone. The aggregating process in block 912 may further include aggregating or combining the various sub-array outputs to generate the single array output.

Though blocks 902-912 are depicted in FIG. 9, and described herein, as having a particular chronological order, in other embodiments one or more of the blocks may be performed out of order or according to a different sequence. For example, the steering process of block 908 may be performed after block 910 and/or block 912, in some embodiments. More specifically, in such cases, steering techniques may be applied to the array output after the received audio signals are combined to form microphone sets, after the microphone sets are combined to form sub-arrays, or after the sub-arrays are combined to form a single array output.

According to embodiments, the array microphone 100 shown in FIG. 1 and described herein can produce a substantially consistent frequency response across a variety of settings or orientations, including, for example, whether placed on a table or other horizontal surface, mounted to a ceiling, or horizontally attached to a wall. In particular, regardless of the array orientation, the lobes of the array microphone 100 can be directed towards a desired sound source with increased rear rejection and steering control, or isolated forward acceptance, thus improving the array's ability to reject unwanted sound sources and reflections in the room and provide a high signal to noise ratio (SNR). At the same time, there may be slight or small differences in behavior between certain orientations due to the arrangement of the microphones 102 relative to the audio sources.

Figure 10A:
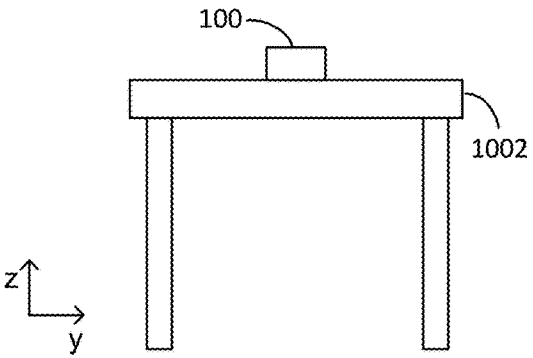
FIGS. 10A and 10B are side and top views, respectively, of the array microphone of FIG. 1 positioned on top of a table within a conferencing environment, in accordance with one or more embodiments.
Figure 10B:
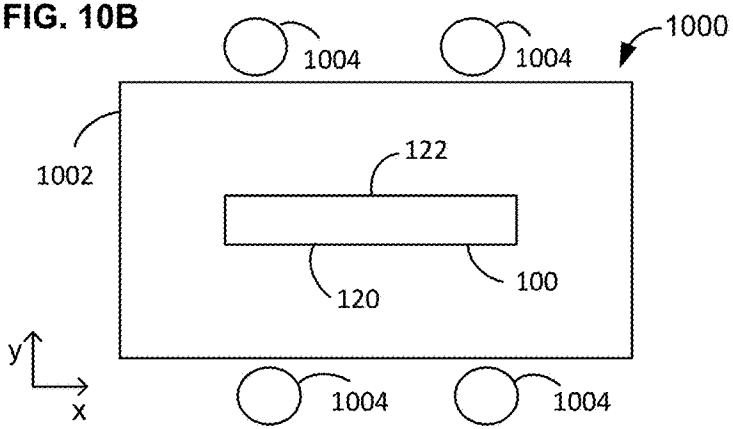

FIGS. 10A and 10B illustrate an exemplary environment 1000 wherein the array microphone 100 is placed on a table 1002, or other horizontal or substantially flat surface, in accordance with embodiments. The table 1002 may be a conference room table, for example, with a plurality of audio sources 1004 (e.g., human speakers) situated or seated around the table 1002. In such environment 1000, the array microphone 100 may be situated so that the front face 120 faces one side of the table 1002 and the rear face 122 faces an opposite side of the table 1002, as shown in FIG. 10B. Because the array microphone 100 is agnostic to direction of arrival within the x-y plane, the array microphone 100 can direct a broadside polar pattern towards either of the two sides of the table and isolate sound sources (e.g., other talkers or unwanted noise sources) coming from the opposite side of the table. In addition, the array microphone 100 can steer a main lobe or sound beam to any angle around the table 1002 using the beamforming techniques described herein. As a result, the array microphone 100 can be used to simultaneously generate a plurality of individual audio channels, each tailored to capture a particular talker or audio source 1004 while removing room noise, other talker noise, and other unwanted sounds. In this manner, the array microphone 100 can provide not only improved directivity but also improved signal to noise ratio (SNR) and acoustic echo cancellation (AEC) properties.

Figure 11A:
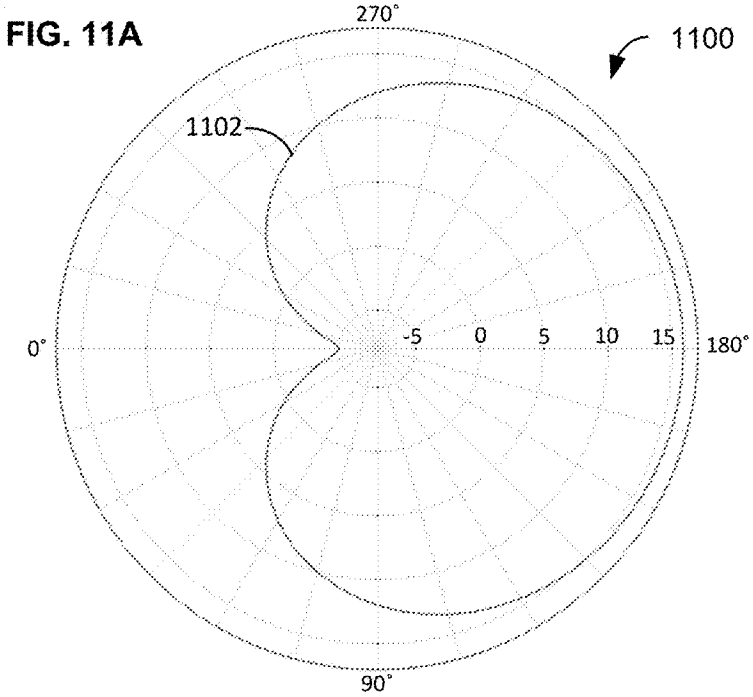
FIG. 11A is a polar plot showing a select polar response of the array microphone shown in FIG. 10A, perpendicular to the table, in accordance with one or more embodiments.

FIG. 11A is a polar plot 1100 of the vertical directivity of the array microphone 100 in FIG. 10A, in accordance with embodiments. More specifically, the polar plot 1100 depicts the frequency response of the array microphone 100 for 1900 Hz perpendicular to the table 1002 and with respect to the zero-degree azimuth of the array microphone 100, or in an unsteered (or broadside) condition. As shown, the vertical directional response of the array microphone 100 forms a cardioid polar pattern with a main lobe 1102 that is narrower than the full 360 degrees pick up patterns of the individual omni-directional microphones 102. As a result, the array microphone 100 is better able to reject unwanted sound sources at the rear of the array, for example.

Figure 11B:
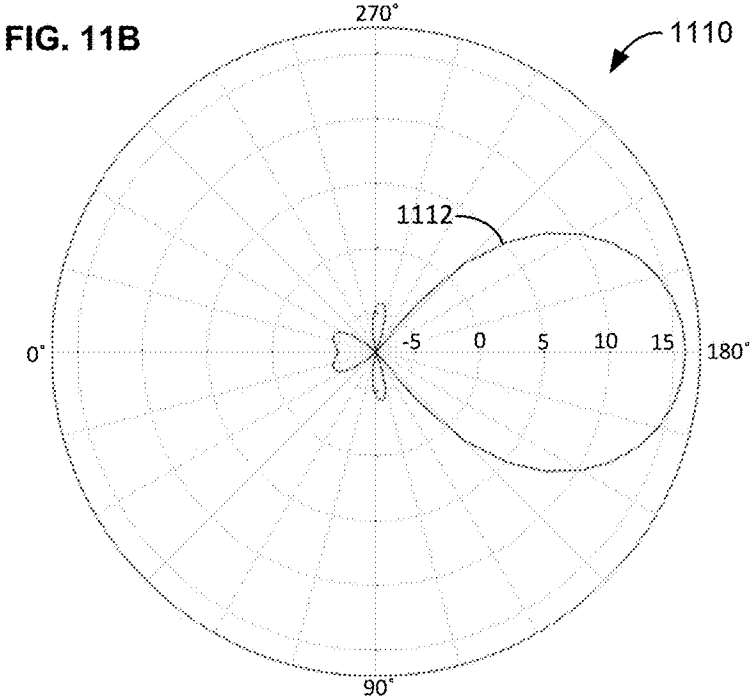
FIG. 11B is a polar plot showing a select polar response of the array microphone shown in FIG. 10B, within the plane of the table, in accordance with one or more embodiments.

FIG. 11B is a polar plot 1110 of the horizontal directivity of the array microphone 100 in FIG. 10B, in accordance with embodiments. More specifically, the polar plot 1110 depicts the frequency response of the array microphone 100 for 1900 Hz in the plane of the table 1002 and with respect to the zero-degree azimuth of the array microphone 100, or in an unsteered (or broadside) condition. As shown, the horizontal directional response of the array microphone 100 forms a uni-directional or cardioid polar pattern with a main lobe 1112 that is narrower than 180 degrees. This narrowed lobe 1112 can be directed or steered towards the individual audio sources 1004 sitting around the table 1002 with greater precision and without picking up unwanted noise or room reflections.

Figure 12:
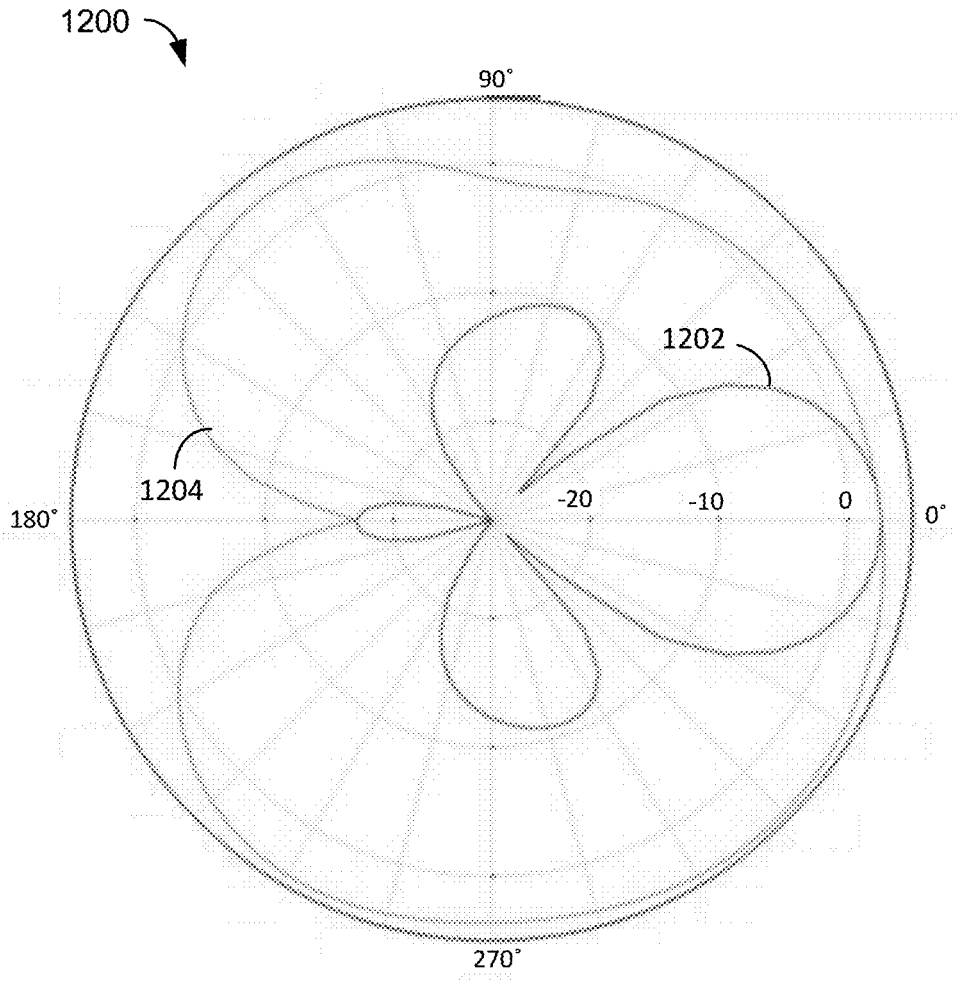
FIG. 12 is a polar plot showing select polar responses of the array microphone of FIG. 1, in accordance with one or more embodiments.

FIG. 12 is a polar plot 1200 of both horizontal and vertical directivities of the array microphone 100 in FIGS. 10A and 10B for 2500 Hz, in accordance with embodiments. Specifically, curve 1202 depicts the frequency response of the array microphone 100 for 2500 Hz in the plane of the table 1002 and in an unsteered or broadside condition (e.g., directed toward a talker positioned at zero degrees). Curve 1204 depicts the frequency response of the array microphone 100 for 2500 Hz perpendicular to the table 1002 and also in a broadside condition. As shown, the vertical directional response depicted by curve 1202 forms a cardioid polar pattern with a main lobe that is narrower than the full 360 degrees pick up patterns of the individual omni-directional microphones 102. As also shown, the horizontal directional response depicted by curve 1204 forms a uni-directional or array polar pattern with a main lobe that is narrower than 180 degrees. Typically, for harmonic sub-arrays, the higher the frequency, the greater the directivity (i.e. the narrower the beamwidth). This is demonstrated at least in FIGS. 11A, 11B, and 12 where the horizontal directional response curve 1202 for 2500 Hz has a narrower beamwidth than the horizontal directional response curve 1112 for 1900 Hz.

FIG. 13 illustrates an exemplary environment 1300 wherein the array microphone 100 is mounted, or attached, horizontally to a wall 1302, or other vertical or upright surface, in accordance with embodiments. The wall 1302 may be in a conference room or other environment having one or more audio sources (not shown) seated or situated in front of the wall 1302. For example, the audio sources (e.g., human speakers) may be seated at a table (not shown) and facing the wall 1302 for a conference call, telecast, webcast, etc. In such cases, the array microphone 100 may be placed horizontally on the wall under a television or other display screen (not shown), such that the front face 120 of the array microphone 100 is pointed down towards a bottom 1304 of the wall 1302 (or the floor) and the rear face 122 of the array microphone 100 is pointed up towards a top 1306 of the wall 1302 (or the ceiling), as shown in FIG. 13.

Figure 14:
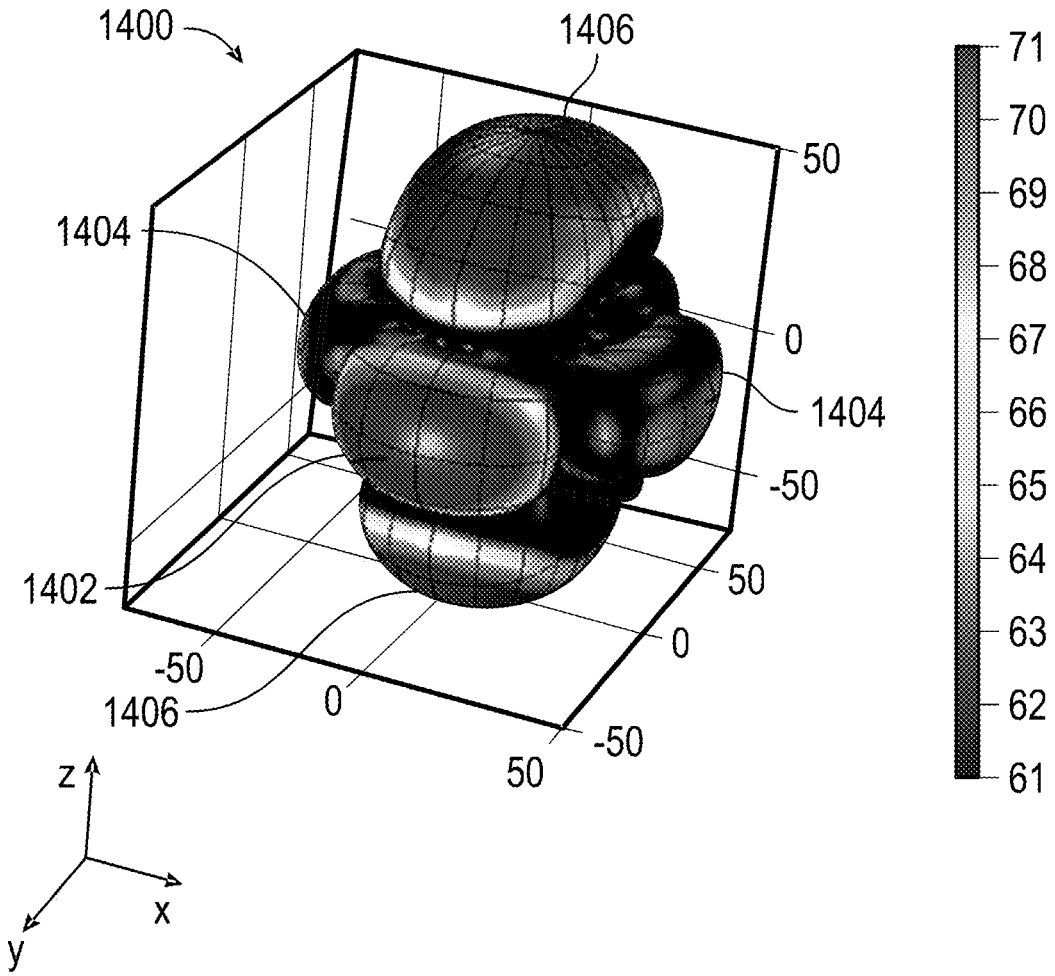
FIG. 14 is a directional response plot of the array microphone shown in FIG. 13, in accordance with embodiments.

FIG. 14 is a plot 1400 of the directional response of the array microphone 100 shown in FIG. 13, in accordance with embodiments. More specifically, plot 1400 depicts the normalized sensitivity of the array microphone 100 for 94 dB SPL (sound pressure level) with respect to the zero-degree azimuth of the array microphone 100, or in an unsteered (or broadside) condition. As shown by segment 1402, the microphone sensitivity is significantly higher directly in front of the array microphone 100, or substantially perpendicular to the front face 120 of the array. In embodiments, segment 1402 represents a focused sound beam (or lobe) created normal to the array microphone 100, or pointing straight out from the wall 1302 towards the opposite side of the room. This sound beam may be created by combining the audio signals received from the microphones 102 in each microphone set using delay and sum formation techniques. For example, the beamformer 800 in FIG. 8 may be used to apply strict and/or optimized delay and sum beamforming techniques to create a resulting directional beam that is configured to reject unwanted noise and reflections from the ceiling and floor within the octaves covered by the microphones being summed.

As shown by segments 1404, the microphone sensitivity is significantly low at the left and right sides of the array microphone 100. In embodiments, segments 1404 may represent nulls formed at opposite sides of the array 100 due to the placement of the array microphone 100 on the wall 1302. In particular, when mounted on the wall 1302, the array microphone 100 may be able to reject or ignore sounds coming from the far left side and the far right side because the array geometry naturally creates nulls on the left and right sides and the use of a delay and sum network allows for null generation within the axis of the array 100. As shown by segments 1406 of the plot 1400, microphone sensitivity may be significantly higher in either direction within the plane of the microphones 102.

Thus, the techniques described herein provide an array microphone with a narrow, one-dimensional form factor, and improved frequency-dependent directivity in multiple dimensions, thus resulting in an improved signal-to-noise ratio (SNR) and wideband audio application (e.g., 20 hertz (Hz)≤f≤20 kilohertz (kHz)). The microphones of the array microphone are arranged in harmonically-nested orthogonal pairs configured to create a linear pattern relative to a front face of the array microphone and duplicate the linear pattern in one or more orthogonal layers for increased directivity. One or more beamformers can be used to generate a directional output for each microphone pair and to combine the directional outputs to form a cardioid polar pattern for the entire array, for example, when the array microphone is placed on a horizontal surface. When the array microphone is mounted to a vertical surface, the microphones can be combined to create a focused narrow beam directed straight ahead, or normal to the vertical surface. As a result, despite being comprised of low profile microphones (e.g., MEMS microphones), the array microphone can provide increased rear rejection and isolated forward acceptance in both wall-mounted and table-mounted orientations.

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. An array microphone, comprising:

a plurality of microphones configured to cover a plurality of frequency bands, the microphones arranged in microphone sets configured to form a linear pattern along a first axis and extend orthogonally from the first axis, wherein a distance between adjacent microphones along the first axis is determined based on a frequency value included in the plurality of frequency bands.

2. The array microphone of claim 1, wherein the linear pattern places the microphone sets in a harmonically-nested configuration.

3. The array microphone of claim 1, wherein a number of the microphone sets are co-located on a second axis orthogonal to the first axis.

4. The array microphone of claim 1, wherein each microphone set comprises a first microphone located on the first axis and a second microphone located on a second axis orthogonal to the first microphone, and the distance between the first and second microphones is determined based on a linear aperture size of the array microphone.

5. The array microphone of claim 1, wherein the microphone sets are configured to form a first sub-array for covering a first octave included in the plurality of frequency bands and a second sub-array for covering a second octave included in the plurality of frequency bands, and the distance between adjacent microphones in the second sub-array along the first axis is twice the distance between adjacent microphones in the first sub-array along the first axis.

6. The array microphone of claim 5, wherein a number of the microphone sets are co-located on a second axis orthogonal to the first axis, and the distance between adjacent microphones in the second sub-array along the second axis is twice the distance between adjacent microphones in the first sub-array along the second axis.

7. The array microphone of claim 1, wherein each microphone is a micro-electrical mechanical system (MEMS) microphone.

8. A method performed by one or more processors to generate an output signal for an array microphone comprising a plurality of microphones for covering a plurality of frequency bands, the method comprising:

receiving audio signals from the plurality of microphones, the plurality of microphones comprising a first plurality of microphones arranged to form a linear pattern along a first axis and a second plurality of microphones arranged to extend orthogonally from the first axis;

selecting one of a plurality of beamforming patterns based on a direction of arrival of the received audio signals, pairing each of the first plurality of microphones with one or more of the second plurality of microphones to form microphone sets in accordance with the selected beamforming pattern;

generating a directional output for each microphone set; and aggregating the directional outputs to generate an overall array output.

9. The method of claim 8, wherein the directional output is configured to reject audio sources from one or more other directions.

10. The method of claim 8, wherein each directional output has a first-order polar pattern.

11. The method of claim 8, wherein each directional output has a cardioid polar pattern.

12. The method of claim 8, wherein generating the directional output for each microphone set includes using a sum-difference beamforming technique to combine the audio signals received from the microphones in the microphone set.

13. The method of claim 8, wherein the microphone sets are further arranged to form a plurality of sub-arrays, each sub-array configured to cover a different octave included in the plurality of frequency bands, the method further comprising:

for each sub-array, combining the directional outputs for the microphone sets included in the sub-array to generate a sub-array output, wherein aggregating the directional outputs includes aggregating the sub-array outputs for the plurality of sub-arrays to generate the overall array output.

14. The method of claim 8, further comprising: applying one or more beamforming techniques to steer the overall array output towards a desired direction.

15. The method of claim 8, wherein the plurality of beamforming patterns includes a broadside pattern and at least one oblique angle pattern.

16. A microphone system, comprising:

an array microphone comprising a plurality of microphones and configured to cover a plurality of frequency bands, the plurality of microphones comprising a first plurality of microphones arranged to form a linear pattern along a first axis and a second plurality of microphones arranged to extend orthogonally from the first axis;

a memory storing instructions thereon; and at least one processor in communication with the memory, wherein the instructions, when executed by the at least one processor, cause the microphone system to:

receive audio signals from the plurality of microphones;

select one of a plurality of beamforming patterns based on a direction of arrival of the received audio signals;

pair each of the first plurality of microphones with one or more of the second plurality of microphones to form microphone sets in accordance with the selected beamforming pattern;

generate a directional output for each microphone set; and aggregate the directional outputs to generate an overall array output.

17. The microphone system of claim 16, wherein the directional output is configured to reject audio sources from one or more other directions.

18. The microphone system of claim 16, wherein the memory stores each of the plurality of beamforming patterns in association with a corresponding direction of arrival, and the instructions further cause the microphone system to retrieve the selected beamforming pattern from the memory.

19. The microphone system of claim 16, wherein the directional output includes sound beams directed normal to the first axis of the array microphone when the direction of arrival is broadside.

20. The microphone system of claim 16, wherein the directional output includes sound beams steered towards a select angle when the direction of arrival is an oblique angle relative to the first axis.

21. The microphone system of claim 16, wherein a distance between adjacent microphones along the first axis is determined based on a frequency value included in the plurality of frequency bands.

22. The method of claim 8, wherein a distance between adjacent microphones along the first axis is determined based on a frequency value included in the plurality of frequency bands.

* * * * *